US009114631B2

(12) United States Patent
Fujita et al.

(10) Patent No.: US 9,114,631 B2
(45) Date of Patent: Aug. 25, 2015

(54) ADJUSTMENT METHOD OF PRINTING POSITIONS, PRINTING APPARATUS AND PRINTING SYSTEM

(75) Inventors: Miyuki Fujita, Tokyo (JP); Hiroshi Tajika, Yokohama (JP); Yuji Konno, Kawasaki (JP); Shuichi Murakami, Kawasaki (JP); Norihiro Kawatoko, Kawasaki (JP); Takayuki Ogasahara, Kawasaki (JP); Tetsuya Edamura, Kawasaki (JP); Tetsuhiro Maeda, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/407,051

(22) Filed: Feb. 28, 2012

(65) Prior Publication Data

US 2012/0218330 A1 Aug. 30, 2012

Related U.S. Application Data

(62) Division of application No. 11/207,817, filed on Aug. 22, 2005, now Pat. No. 8,147,019, which is a division of application No. 09/639,743, filed on Aug. 15, 2000, now Pat. No. 6,960,036.

(30) Foreign Application Priority Data

Aug. 24, 1999 (JP) ..... 11-236260
Jul. 19, 2000 (JP) ..... 2000-219758

(51) Int. Cl.

| | |
|---|---|
| ***B41J 29/38*** | (2006.01) |
| ***B41J 29/393*** | (2006.01) |
| ***B41J 2/21*** | (2006.01) |
| ***B41J 19/14*** | (2006.01) |

(52) U.S. Cl.

CPC ..... *B41J 2/2135* (2013.01); *B41J 19/145* (2013.01)

(58) Field of Classification Search

CPC ..... B41J 29/393; B41J 2/2135; B41J 19/145; B41J 2/2132; B41J 29/38; B41J 2029/3935

USPC ..... 347/9, 12, 14, 19, 37

See application file for complete search history.

(56) References Cited

U.S. PATENT DOCUMENTS

| | | | |
|---|---|---|---|
| 4,920,355 | A | 4/1990 | Katerberg |
| 5,343,231 | A | 8/1994 | Suzuki |

(Continued)

FOREIGN PATENT DOCUMENTS

| | | | |
|---|---|---|---|
| EP | 0 540 245 | A2 | 5/1993 |
| EP | 0 616 896 | A2 | 9/1994 |

(Continued)

OTHER PUBLICATIONS

Ulichney, Digital Halftoning, "Dithering with Blue Noise," Chapter 8, pp. 233-238, Jun. 1987.

(Continued)

*Primary Examiner* — Jannelle M Lebron

(74) *Attorney, Agent, or Firm* — Fitzpatrick, Cella, Harper & Scinto

(57) ABSTRACT

With an ink jet head having for each color two parallel columns of nozzles arranged shifted by one-half the pitch, odd-numbered rasters and even-numbered rasters are printed by the two nozzle columns. The registration between the odd- and even-numbered rasters is secured during the printing to produce a high quality image. The ink ejection timing between the two raster groups is shifted by a predetermined interval to form adjustment patterns; the adjustment patterns are checked and, according to the check result, an adjustment value for the ink ejection timing between the two ink nozzle columns is entered, and the entered adjustment value is stored to be reflected on the actual printing operation. To facilitate the adjustment pattern check, the adjustment patterns have a dot distribution with a blue noise characteristic at a resolution at which the printing apparatus can print.

23 Claims, 41 Drawing Sheets

(56) References Cited

U.S. PATENT DOCUMENTS

| | | | |
|---|---|---|---|
| 5,625,384 | A | 4/1997 | Numate et al. |
| 5,754,198 | A | 5/1998 | Nishikawa |
| 5,898,443 | A | 4/1999 | Yoshino et al. |
| 5,949,965 | A | 9/1999 | Gondek |
| 6,053,596 | A | 4/2000 | Nakano et al. |
| 6,089,697 | A | 7/2000 | Tajika et al. |
| 6,092,939 | A | 7/2000 | Nishikori et al. |
| 6,113,210 | A | 9/2000 | Gotoh et al. |
| 6,310,637 | B1 | 10/2001 | Shimada et al. |
| 6,334,659 | B1 | 1/2002 | Maeda et al. |
| 6,364,446 | B1 | 4/2002 | Ishikawa et al. |
| 6,375,297 | B1 | 4/2002 | Hayashi et al. |
| 6,378,982 | B2 | 4/2002 | Ono et al. |
| 6,433,891 | B1 | 8/2002 | Yu et al. |
| 6,532,026 | B2 | 3/2003 | Takahashi et al. |
| 6,600,573 | B2 | 7/2003 | Shaked et al. |
| 7,789,476 | B2 | 9/2010 | Tomida et al. |

FOREIGN PATENT DOCUMENTS

| | | | |
|---|---|---|---|
| EP | 0 630 750 | A2 | 12/1994 |
| EP | 0 895 869 | A2 | 2/1999 |
| JP | 6-143724 | A | 5/1994 |
| JP | 6-320732 | A | 11/1994 |
| JP | 7-81190 | A | 3/1995 |
| JP | 7-242025 | A | 9/1995 |
| JP | 8-156286 | A | 6/1996 |
| JP | 9-277509 | A | 10/1997 |
| JP | 10-286957 | A | 10/1998 |
| JP | 10-329381 | A | 12/1998 |
| JP | 11-48587 | A | 2/1999 |
| JP | 11-77991 | A | 3/1999 |
| JP | 11-138861 | A | 5/1999 |
| JP | 11-170527 | A | 6/1999 |
| JP | 11179891 | A | 7/1999 |
| JP | 11-216856 | A | 8/1999 |
| WO | 02/05545 | A1 | 1/2002 |

OTHER PUBLICATIONS

Office Action dated Jul. 16, 2010, in Japanese Application No. 2000-219758, with English translation.

Office Action dated Oct. 7, 2010, in Japanese Patent Application No. 2010-146768, with English translation.

Office Action dated Jan. 7, 2011, in Japanese Application No. 2010-146767, with English translation.

Office Action dated Apr. 27, 2010, in Japanese Application No. 2000-219758, with English translation.

| FIG.8A | FIG.8B |
|---|---|

FIG.21A

| | HQ | HS |
|---|---|---|
| NORMAL POSITION | 3 | 4 |
| THICK SHEET POSITION | 4 | 6 |

UNIT(PIXEL)

FIG.21B

| | HQ | HS |
|---|---|---|
| NORMAL POSITION | 3 | 5 |
| THICK SHEET POSITION | 4 | 7 |

UNIT(PIXEL)

FIG.21C

| | HQ | HS |
|---|---|---|
| NORMAL POSITION | 3 | 5 |
| THICK SHEET POSITION | 4 | 7 |

UNIT(PIXEL)

FIG.21D

| | HQ | HS |
|---|---|---|
| NORMAL POSITION | 3 | 6 |
| THICK SHEET POSITION | 4 | 8 |

UNIT(PIXEL)

| EJECTION SPEED (m/s) | 12~12.4 | 12.4~114.2 | 14.2~15.3 | 15.3~16.0 | 16.0~16.9 | 16.9~18.0 |
|---|---|---|---|---|---|---|
| HS/THICK SHEET POSITION | 3 | 3 | 3 | 2 | 2 | 2 |
| HS/STANDARD POSITION | 5 | 4 | 4 | 4 | 3 | 3 |
| HQ/THICK SHEET POSITION | 5 | 4 | 4 | 4 | 4 | 4 |
| HQ/STANDARD POSITION | 8 | 7 | 6 | 6 | 6 | 5 |

UNIT (PIXEL)

FIG.23

| EJECTION SPEED (m/s) | | 10 | 11 | 12 | 13 | 14 | 15 | 16 |
|---|---|---|---|---|---|---|---|---|
| | | 01 | 02 | 03 | 04 | 05 | 06 | 07 |
| GAP + TOLERANCE (MAXIMUM) | 01 | 16 | 15 | 14 | 13 | 8 | 11 | 10 |
| GAP (MEDIAN) | 02 | 12 | 11 | 10 | 9 | 12 | 6 | 5 |
| GAP - TOLERANCE (MINIMUM) | 03 | 8 | 7 | 7 | 6 | 6 | 5 | 5 |

FIG.32

| INITIAL EJECTION SPEED (mm) | | 10 | 11 | 12 | 13 | 14 | 15 | 16 |
|---|---|---|---|---|---|---|---|---|
| | | 01 | 02 | 03 | 04 | 05 | 06 | 07 |
| HEAD TEMPERATURE (℃) | 20~30 | 01 | 02 | 03 | 04 | 05 | 06 | 07 |
| | 30~40 | 02 | 03 | 04 | 05 | 06 | 07 | 08 |
| | 40~50 | 03 | 04 | 05 | 06 | 07 | 08 | 09 |
| | 50~ | 04 | 05 | 06 | 07 | 08 | 09 | 0a |

FIG.34

| EJECTION SPEED (m/s) | | 10 | 11 | 12 | 13 | 14 | 15 | 16 | 17 | 18 | 19 | 20 |
|---|---|---|---|---|---|---|---|---|---|---|---|---|
| | | 01 | 02 | 03 | 04 | 05 | 06 | 07 | 08 | 09 | 0a | 0b |
| DRIVE FREQUENCY (KHz) | 25 | 21 | 11 | 10 | 9 | 9 | 8 | 8 | 7 | 7 | 6 | 6 |
| | 20 | 10 | 9 | 8 | 7 | 7 | 6 | 6 | 6 | 5 | 5 | 5 |

FIG.37

ADJUSTMENT METHOD OF PRINTING POSITIONS, PRINTING APPARATUS AND PRINTING SYSTEM

This application is a division of application Ser. No. 11/207,817 filed Aug. 22, 2005, which is a division of application Ser. No. 09/639,743 filed Aug. 15, 2000, now U.S. Pat. No. 6,960,036, which issued on Nov. 1, 2005. This application is based on Japanese Patent Application Nos. 11-236260 filed on Aug. 24, 1999, and 2000-219758 filed Jul. 19, 2000, the content of which is incorporated hereinto by reference.

BACKGROUND OF THE INVENTION

1. Field of the Invention

The present invention relates to a print position adjustment method and a printing apparatus and a printing system using the print position adjustment method, and is particularly suited for adjusting the positions of ink dots in a printing apparatus of an ink jet system. In addition to general printing apparatus, the present invention can also be applied to copying machines, facsimiles with a communication system, word processors with a printer, and industrial printing apparatus combined with a variety of processing devices.

2. Description of the Related Art

An image printing apparatus of a so-called serial scan type, which executes the print operation while scanning a print head, or a printing unit, over a print medium, has found a variety of image forming applications. The ink jet printing apparatus in particular has in recent years achieved high resolution and color printing, making a significant image quality improvement, which has resulted in a rapid spread of its use. Such an apparatus employs a so-called multi-nozzle head that has an array of densely arranged nozzles for ejecting ink droplets. Images with still higher resolution have now been made possible by increasing the nozzle density and reducing the amount of ink per dot. Further, to realize an image quality approaching that of a silver salt picture, various technologies have been developed, including the use of pale or light color ink with reduced concentration in addition to four basic color inks (cyan, magenta, yellow and black). A print speed reduction problem, which is feared to arise as the picture quality advances, is dealt with by increasing the number of print elements, improving the drive frequency and employing a bi-directional printing technique, thus realizing a satisfactory throughput.

FIG. 27 schematically shows a general construction of a printer that uses the multi-nozzle for printing. In the figure, reference number 1901 represents head cartridges corresponding to four inks, black (K), cyan (C)), magenta (M) and yellow (Y). Each head cartridge 1901 consists of an ink tank 1902T filled with a corresponding color ink and a head unit 1902H having an array of many nozzles for ejecting the ink supplied from the ink tank onto a print medium 1907.

Designated 1903 is a paper feed roller which, in cooperation with an auxiliary roller 1904, clamps a print medium (print paper) 1907 and rotates in the direction of arrow in the figure to feed the print paper 1907 in the Y direction as required. Denoted 1905 is a pair of paper supply rollers that clamps the print paper 1907 and carries it toward the print position. The paper supply rollers 1905 also keep the print paper 1907 flat and tight between the supply rollers and the feed rollers 1903, 1904.

Designated 1906 is a carriage that supports the four head cartridges 1901 and moves them in a main scan direction during the print operation. When the printing is not performed or during an ink ejection performance recovery operation for the head unit 1902H, the carriage 1906 is set at a home position h indicated by a dotted line.

The carriage 1906, which was set at the home position h before the print operation, starts moving in the X direction upon reception of a print start command and at the same time the head unit 1902H ejects ink from a plurality of nozzles (n nozzles) formed therein according to print data to perform printing over a band of a width corresponding to the length of the nozzle array. When the printing is done up to the X-direction end of the print paper 1907, the carriage 1906 returns to the home position h in the case of one-way printing and resumes printing in the X direction. In the case of bi-directional printing, the carriage 1906 also performs printing while it is moving in a −X direction toward the home position h. In either case, after one print operation (one scan) in one direction has been finished before the next print operation is started, the paper feed roller 1903 is rotated a predetermined amount in the direction of arrow in the figure to feed the print paper 1907 in the Y direction a predetermined distance (corresponding to the length of the nozzle array). By repeating the one-scan print operation and the print paper feeding by a predetermined distance, data for one sheet of paper is printed.

In the above serial type ink jet printer, various provisions have been made as to the construction of the head unit or the printing method in order to realize an image printing with higher resolution.

For example, the manufacture of the multi-nozzle head inevitably places a limit on the density of the nozzles in a single nozzle array.

FIG. 28A shows an example head that realizes a higher recording density. This head has two columns of nozzles extending in the Y direction and spaced a distance px (corresponding to a predetermined number of pixels) apart in the X direction. The two nozzle columns, each consisting of many nozzles arranged at a predetermined pitch py in the Y direction, are shifted from each other by a distance py/2 in the Y direction. This arrangement of the nozzles realizes a resolution two times higher than that achieved by a single nozzle column. When this head is applied to the apparatus shown in FIG. 27, the heads having the construction shown in FIG. 28A for one color can be arranged in parallel in the X direction for six colors. In this arrangement, simply adjusting the ejection timings of the two nozzle columns can achieve a color printing with two times the resolution of the single nozzle column.

In other technologies, such as U.S. Pat. No. 4,920,355 and Japanese Patent Application Laid-Open No. 7-242025 (1995), a high resolution printing is realized by setting the paper feed distance for each print scan to a predetermined number of pixels less than the length of the column of nozzles while leaving the multi-nozzle arrangement at a low resolution. Such a printing method is hereinafter called an interlace printing method.

The interlace printing method will be briefly explained by referring to FIG. 29. Here let us take up an example case where an image with resolution of 1200 DPI (dots/inch) is printed by using a head H with nozzles arranged at a pitch of 300 DPI. For the sake of simplicity, it is assumed that the head has nine nozzles and that the distance of the paper feed carried out after each print scan is nine pixels at 1200-DPI resolution. The rasters printed in the forward pass are shown as solid lines and the rasters printed in the backward pass are shown as dashed lines. These two kinds of lines are formed alternately.

While in this example the paper is fed a fixed distance of 9 pixels at 1200-DPI resolution, other arrangements may be made in the interlace printing. The interlace printing method does not need to have a constant paper feed distance at all times as long as a picture is printed with a plurality of print scans arranged at a pitch finer than the arrangement pitch can be printed with a higher resolution than the nozzle arrangement resolution.

When a head as shown in FIG. 28A is used, because even-numbered rasters and odd-numbered rasters that are alternated in the Y direction (sub-scan direction) are printed by different columns of nozzles, the landing positions of ink droplets from the two columns of nozzles may deviate subtly from the correct positions, degrading the image quality. One of possible causes for this problem may be explained as follows. When a head face on which nozzles are formed is deformed due to swelling with ink or temperature rise, causing a part of the head face between the nozzle column associated with the odd-numbered rasters and the nozzle column associated with the even-numbered rasters to bulge, as shown in FIG. 28B, the ink droplets from the respective nozzle columns will be projected in two different directions slightly away from each other. The ink landing position deviation between the rasters due to this phenomenon, even if small in magnitude, will have bad effects on the image quality and pose a critical problem in realizing a high resolution photographic image quality, one of the objects of the present invention.

Many proposals have been put forward as to the method of correcting ink landing position deviations among different colors and, in the bi-directional printing, the method of correcting deviations in ink landing position of the same color between the forward scan and the backward scan. However, as for the correction of the ink landing position deviations between the rasters of the same color produced by the head shown in FIG. 28A, an effective adjustment method has yet to be proposed although the allowable range for the deviation is narrow and the effects of such deviations on the image formation are large. Further, the deviation in ejection direction between the even-numbered nozzle column and the odd-numbered nozzle column is caused by the ink composition, ink ejection history such as ejection frequency, and printing environment, as well as the characteristic variations of individual heads. Therefore, even if the ink ejection timing for a head is determined which does not cause ink landing position deviations under a particular condition, that ejection timing cannot be applied to all circumstances. That is, not only should the ink ejection timing be adjusted before shipping according to the characteristic variations of individual heads, it is also strongly called for that the adjustment be able to be made as required demands being met, it is difficult to form a high quality image at all times.

Further, in the interlace printing method, because the same image area is completed by repeating the print scan and the paper feed a plurality of times, the printing time will increase. To cope with this problem, a bi-directional printing has been proposed and disclosed. In this case, the odd-numbered rasters are often printed by the forward scans and the even-numbered rasters by backward scans, as shown in FIG. 29. If the ink landing positions deviate from one raster to another, the similar problem to that when the head of FIG. 28A is used will occur.

There are many proposals already put forth as to the method of correcting ink landing position deviations between forward scan and backward scan. The proposed methods mostly take note of a vertical line pattern where the same image area is completed by a single scan (one pass printing), and do not address the problem of correcting subtle deviations among the rasters when performing the interlace printing.

SUMMARY OF THE INVENTION

The present invention has been accomplished under these circumstances and its object is to make it possible to prevent an image quality degradation due to subtle ink dot forming position deviations among the rasters and thereby form high quality images at all times.

Further, in the bi-directional printing, in particular, the higher the resolution of the image, the more stringent the required dot landing position accuracy becomes, so that a dot landing position deviation of even several μm will result in a perceivable degradation of image quality and, therefore, another object of the present invention is to make it possible to set the dot position adjustment value properly and in real time according to characteristic variations, within tolerance, of the print head and the printer body as well as according to the state of the printing operation.

In a first aspect of the present invention, there is provided a print position adjusting method for a printing apparatus, wherein the printing apparatus uses a print head having an array of a plurality of print elements and forms an image on a print medium by scanning the print head in a direction different from an arranging direction of the plurality of print elements and wherein rasters making up the image are divided into at least two raster groups according to a driving mode of the plurality of print elements, the method for adjusting print positions by the plurality of print elements between the at least two raster groups, the method comprising the steps of:

forming a plurality of adjustment patterns by the print head, in a manner that a print element drive timing between the at least two raster groups is shifted a predetermined interval, the print element drive timing being a timing of driving the plurality of print elements;

entering an adjustment value for the print element drive timing between the at least two raster groups, the adjustment value being determined from the plurality of adjustment patterns; and storing the entered adjustment value.

In a second aspect of the present invention, there is provided a print position adjusting method for a printing apparatus, wherein the printing apparatus uses a print head having an array of a plurality of nozzles for ejecting ink and forms an image on a print medium by scanning the print head in forward and backward directions different from an arranging direction of the plurality of nozzles and wherein a speed of the scan and a distance from the nozzles to the print medium can be set in at least two stages respectively, the method for adjusting positions of ink dots ejected from the plurality of nozzles between the scans in the forward and backward directions, the method comprising the steps of:

forming a plurality of adjustment patterns by the print head, in a manner that an ink ejection timing between the forward and backward scans is shifted by a predetermined interval, the ink ejection timing being a timing of ejecting ink from the plurality of nozzles;

entering an adjustment value for the ink ejection timing between the forward and backward scans, the adjustment value being determined from the plurality of adjustment patterns;

storing the entered adjustment value; and correcting the adjustment value according to a combination of the scan speed and the distance in performing a print operation.

In a third aspect of the present invention, there is provided a printing apparatus using a print head having an array of a plurality of print elements and forming an image on a print medium by scanning the print head in a direction different from an arranging direction of the plurality of print elements, wherein rasters making up the image are divided into at least two raster groups according to a driving mode of the plurality of print elements, the apparatus comprising:

means for forming a plurality of adjustment patterns by the print head, in a manner that a print element drive timing between the at least two raster groups is shifted a predetermined interval, the print element drive timing being a timing of driving the plurality of print elements; and means for storing an adjustment value for the print element drive timing between the at least two raster groups, the adjustment value being supplied based on judgement of the plurality of adjustment patterns.

In a fourth aspect of the present invention, there is provided a printing apparatus using a print head having an array of a plurality of nozzles for ejecting ink and forming an image on a print medium by scanning the print head in forward and backward directions different from an arranging direction of the plurality of nozzles, wherein a speed of the scan and a distance from the nozzles to the print medium can be set in at least two stages respectively, the apparatus comprising:

means for forming a plurality of adjustment patterns by the print head, in a manner that an ink ejection timing between the forward and backward scans is shifted by a predetermined interval, the ink ejection timing being a timing of ejecting ink from the plurality of nozzles;

means for storing an adjustment value for the ink ejection timing between the forward and backward scans, the adjustment value being supplied based on judgement of the plurality of adjustment patterns; and means for correcting the adjustment value according to a combination of the scan speed and the distance in performing a print operation.

In a fifth aspect of the present invention, there is provided a printing system comprising:

a printing apparatus using a print head having an array of a plurality of print elements and forming an image on a print medium by scanning the print head in a direction different from an arranging direction of the plurality of print elements, wherein rasters making up the image are divided into at least two raster groups according to a driving mode of the plurality of print elements, the apparatus having:

means for forming a plurality of adjustment patterns by the print head, in a manner that a print element drive timing between the at least two raster groups is shifted a predetermined interval, the print element drive timing being a timing of driving the plurality of print elements; and means for storing an adjustment value for the print element drive timing between the at least two raster groups, the adjustment value being supplied based on judgement of the plurality of adjustment patterns; and a host apparatus for supplying image data to the printing apparatus, having:

means for controlling the printing apparatus to form the plurality of adjustment patterns;

means for accepting entering of the adjustment value based on judgement of the plurality of adjustment patterns; and means for supplying the adjustment data to the printing apparatus.

In a sixth aspect of the present invention, there is provided a printing system comprising:

a printing apparatus using a print head having an array of a plurality of nozzles for ejecting ink and forming an image on a print medium by scanning the print head in forward and backward directions different from an arranging direction of the plurality of nozzles, wherein a speed of the scan and a distance from the nozzles to the print medium can be set in at least two stages respectively, the apparatus having:

means for forming a plurality of adjustment patterns by the print head, in a manner that an ink ejection timing between the forward and backward scans is shifted by a predetermined interval, the ink ejection timing being a timing of ejecting ink from the plurality of nozzles;

means for storing an adjustment value for the ink ejection timing between the forward and backward scans, the adjustment value being supplied based on judgement of the plurality of adjustment patterns; and means for correcting the adjustment value according to a combination of the scan speed and the distance in performing a print operation; and a host apparatus for supplying image data to the printing apparatus, having:

means for controlling the printing apparatus to form the plurality of adjustment patterns;

means for accepting entering of the adjustment value based on judgement of the plurality of adjustment patterns; and means for supplying the adjustment data to the printing apparatus.

In a seventh aspect of the present invention, there is provided a storage medium storing a program for performing a print position adjusting method for a printing apparatus, wherein the printing apparatus uses a print head having an array of a plurality of print elements and forms an image on a print medium by scanning the print head in a direction different from an arranging direction of the plurality of print elements and wherein rasters making up the image are divided into at least two raster groups according to a driving mode of the plurality of print elements, the method for adjusting print positions by the plurality of print elements between the at least two raster groups, the method comprising the steps of:

forming a plurality of adjustment patterns by the print head, in a manner that a print element drive timing between the at least two raster groups is shifted a predetermined interval, the print element drive timing being a timing of driving the plurality of print elements;

entering an adjustment value for the print element drive timing between the at least two raster groups, the adjustment value being determined from the plurality of adjustment patterns; and storing the entered adjustment value.

In an eighth aspect of the present invention, there is provided a storage medium storing a program for performing a print position adjusting method for a printing apparatus, wherein the printing apparatus uses a print head having an array of a plurality of nozzles for ejecting ink and forms an image on a print medium by scanning the print head in forward and backward directions different from an arranging direction of the plurality of nozzles and wherein a speed of the scan and a distance from the nozzles to the print medium can be set in at least two stages respectively, the method for adjusting positions of ink dots ejected from the plurality of nozzles between the scans in the forward and backward directions, the method comprising the steps of:

forming a plurality of adjustment patterns by the print head, in a manner that an ink ejection timing between the forward and backward scans is shifted by a predetermined interval, the ink ejection timing being a timing of ejecting ink from the plurality of nozzles;

entering an adjustment value for the ink ejection timing between the forward and backward scans, the adjustment value being determined from the plurality of adjustment patterns;

storing the entered adjustment value; and correcting the adjustment value according to a combination of the scan speed and the distance in performing a print operation.

In a ninth aspect of the present invention, there is provided a print position adjusting method for adjusting a print position on a print medium during a forward scan and a print position on the print medium during a backward scan in a printing apparatus, wherein the printing apparatus removably supports a print head on which a plurality of ink ejection openings are arranged, and reciprocally scans the print head in a direction different from the arranging direction while ejecting ink to form an image, the method comprising the steps of:

referring first memory means in the printing apparatus storing first print position information associated with characteristic variations of the printing apparatus and second memory means in the print head storing second print position information associated with characteristic variations of the print head, before forming an image by mounting the print head on the printing apparatus; and determining an adjustment value for adjusting the print position, based on the first and second print position information obtained by the referring.

In a tenth aspect of the present invention, there is provided a print position adjusting method for adjusting a print position on a print medium during a forward scan and a print position on the print medium during a backward scan in a printing apparatus, wherein the printing apparatus removably supports a print head on which a plurality of ink ejection openings are arranged, and reciprocally scans the print head in a direction different from the arranging direction while ejecting ink to form an image, the method comprising the steps of:

detecting a temperature of the print head;

estimating an ejection speed of ink ejected from said print head based on the detected temperature; and determining an adjustment value for adjusting the print positions based on the estimated ejection speed.

In an eleventh aspect of the present invention, there is provided a print position adjusting method for adjusting a print position on a print medium during a forward scan and a print position on the print medium during a backward scan in a printing apparatus, wherein the printing apparatus removably supports a print head on which a plurality of ink ejection openings are arranged, and reciprocally scans the print head in a direction different from the arranging direction while ejecting ink to form an image, the method comprising the steps of:

detecting a temperature of the print head;

switching a drive frequency and a scan speed of the print head based on the detected temperature;

estimating an ejection speed of ink ejected from the print head based on the detected temperature; and determining an adjustment value for adjusting the print positions based on the estimated ejection speed and the scan speed.

In a twelfth aspect of the present invention, there is provided a printing apparatus removably supporting a print head on which a plurality of ink ejection openings are arranged, and reciprocally scanning the print head in a direction different from the arranging direction while ejecting ink to form an image, the apparatus comprising:

first memory means for storing first print position information associated with characteristic variations of the printing apparatus;

means for referring the first memory means and second memory means in the print head storing second print position information associated with characteristic variations of the print head, before forming an image by mounting the print head on the printing apparatus; and means for determining an adjustment value for adjusting a print position on a print medium during a forward scan and a print position on the print medium during a backward scan, based on the first and second print position information obtained by the referring.

In a thirteenth aspect of the present invention, there is provided a printing apparatus removably supporting a print head on which a plurality of ink ejection openings are arranged, and reciprocally scanning the print head in a direction different from the arranging direction while ejecting ink to form an image, the apparatus comprising:

means for detecting a temperature of the print head;

means for estimating an ejection speed of ink ejected from said print head based on the detected temperature; and means for determining an adjustment value for adjusting a print position on a print medium during a forward scan and a print position on the print medium during a backward scan based on the estimated ejection speed.

In a fourteenth aspect of the present invention, there is provided a printing apparatus removably supporting a print head on which a plurality of ink ejection openings are arranged, and reciprocally scanning the print head in a direction different from the arranging direction while ejecting ink to form an image, the apparatus comprising:

means for detecting a temperature of the print head;

means for switching a drive frequency and a scan speed of the print head based on the detected temperature;

means for estimating an ejection speed of ink ejected from the print head based on the detected temperature; and determining an adjustment value for adjusting a print position on a print medium during a forward scan and a print position on the print medium during a backward scan based on the estimated ejection speed and the scan speed.

The above and other objects, effects, features and advantages of the present invention will become more apparent from the following description of embodiments thereof taken in conjunction with the accompanying drawings.

BRIEF DESCRIPTION OF THE DRAWINGS

FIGS. 21A to 21D are examples of automatic correction tables used for bi-directional registration considering a carriage speed and a paper gap;

FIG. 23 is an example of automatic correction table considering the ink ejection speed factor shown in FIG. 22;

FIG. 32 shows an example of an adjustment value table for registration using the relationship of FIG. 30;

FIG. 34 is an example of an adjustment value table for registration considering the temperature changes of the print head;

FIG. 37 is an example of an adjustment value table for registration using the relationship of FIG. 36.

DESCRIPTION OF THE PREFERRED EMBODIMENTS

Embodiments of the printing apparatus according to the present invention will be described by referring to the accompanying drawings.

In the following description we take up as an example a printing apparatus using an ink jet printing system.

In this specification, a word "print" (or "record") refers to not only forming significant information, such as characters and figures, but also forming images, designs or patterns on printing medium and processing media, whether the information is significant or insignificant or whether it is visible so as to be perceived by humans.

The word "print medium" or "print sheet" includes not only paper used in common printing apparatus, but cloth, plastic films, metal plates, glass, ceramics, wood, leather or any other material that can receive ink. This word will be also referred to as "paper".

Further, the word "ink" (or "liquid") should be interpreted in its wide sense as with the word "print" and refers to liquid that is applied to the printing medium to form images, designs or patterns, process the printing medium or process ink (for example, coagulate or make insoluble a colorant in the ink applied to the printing medium).

1. Apparatus Body

Figure 1:
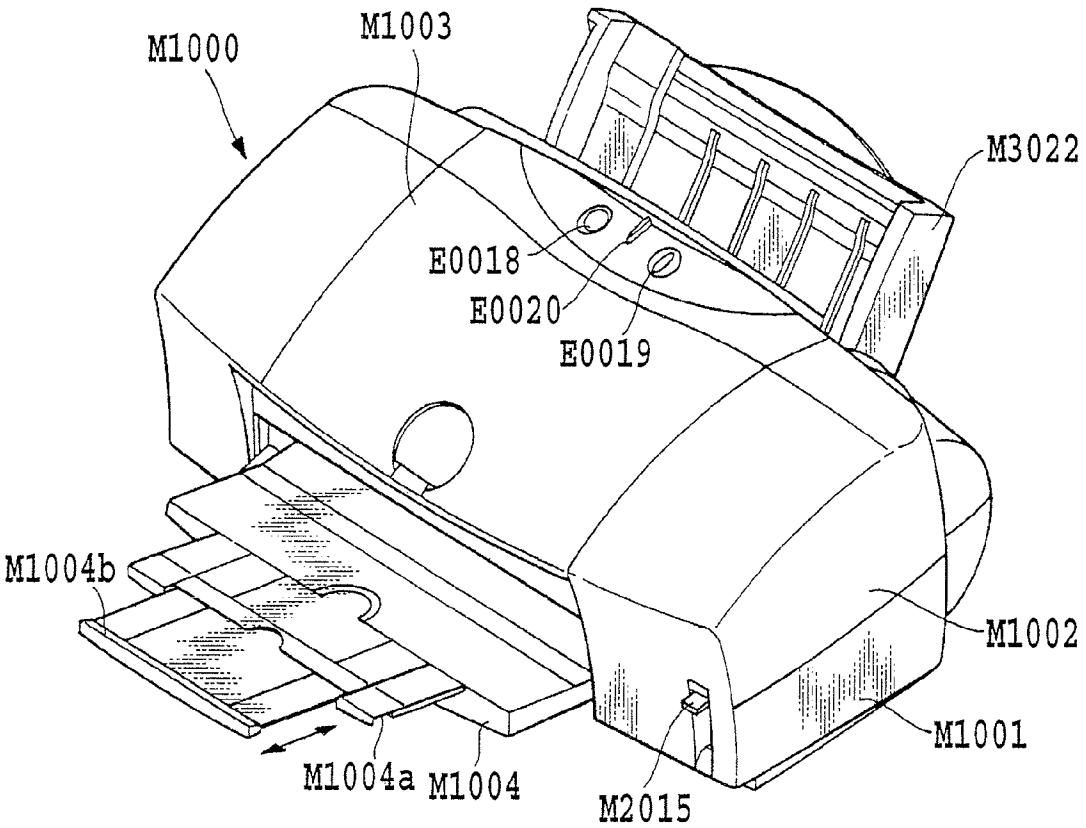
FIG. 1 is a perspective view showing an external construction of an ink jet printer as one embodiment of the present invention.
Figure 2:
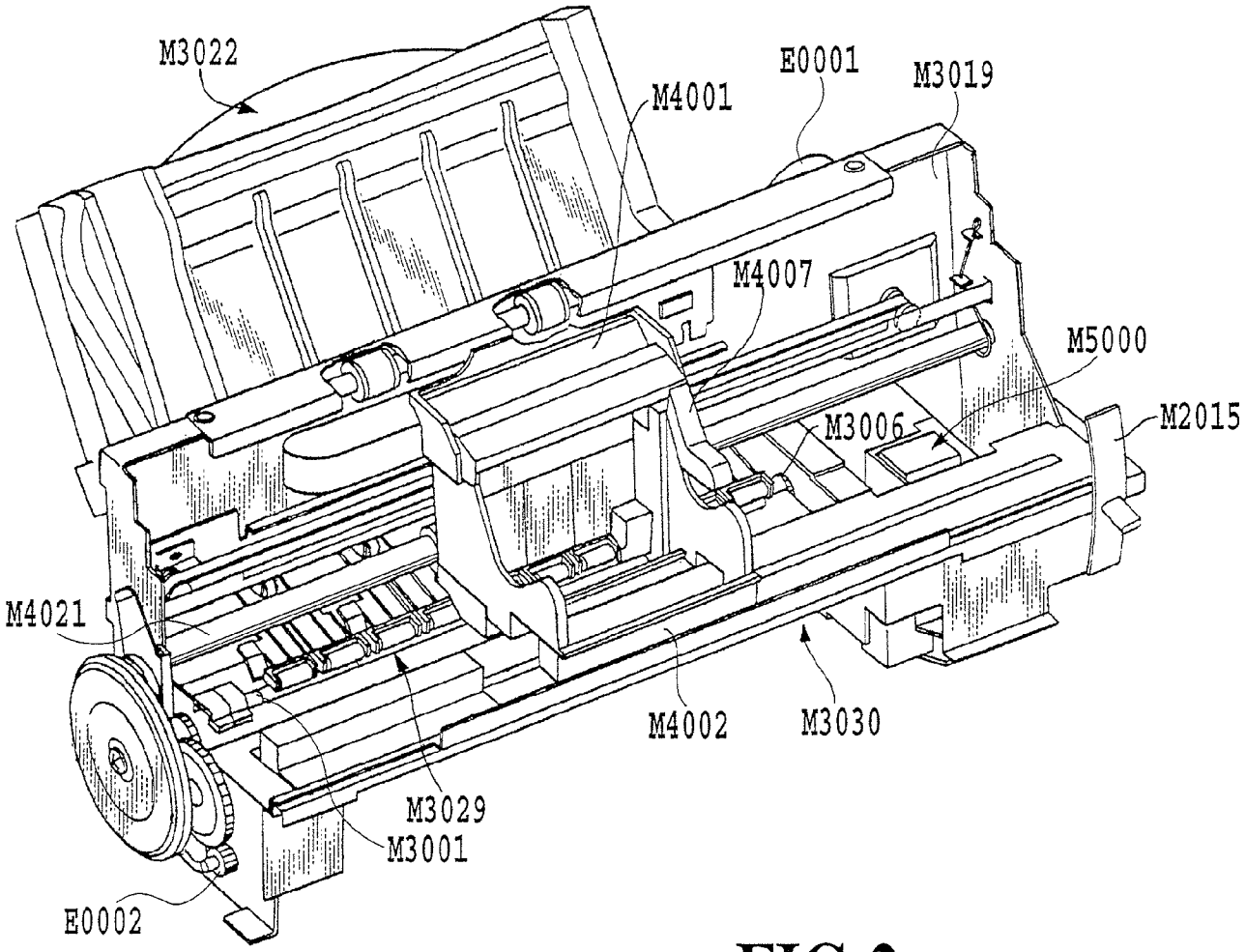
FIG. 2 is a perspective view showing the printer of FIG. 1 with an enclosure member removed.

FIGS. 1 and 2 show an outline construction of a printer using an ink jet printing system. In FIG. 1, a housing of a printer body M1000 of this embodiment has an enclosure member, including a lower case M1001, an upper case M1002, an access cover M1003 and a discharge tray M1004, and a chassis M3019 (see FIG. 2) accommodated in the enclosure member.

The chassis M3019 is made of a plurality of plate-like metal members with a predetermined rigidity to form a skeleton of the printing apparatus and holds various printing operation mechanisms described later.

The lower case M1001 forms roughly a lower half of the housing of the printer body M1000 and the upper case M1002 forms roughly an upper half of the printer body M1000. These upper and lower cases, when combined, form a hollow structure having an accommodation space therein to accommodate various mechanisms described later. The printer body M1000 has an opening in its top portion and front portion.

The discharge tray M1004 has one end portion thereof rotatably supported on the lower case M1001. The discharge tray M1004, when rotated, opens or closes an opening formed in the front portion of the lower case M1001. When the print operation is to be performed, the discharge tray M1004 is rotated forwardly to open the opening so that printed sheets can be discharged and successively stacked. The discharge tray M1004 accommodates two auxiliary trays M1004*a*, M1004*b*. These auxiliary trays can be drawn out forwardly as required to expand or reduce the paper support area in three steps.

The access cover M1003 has one end portion thereof rotatably supported on the upper case M1002 and opens or closes an opening formed in the upper surface of the upper case M1002. By opening the access cover M1003, a print head cartridge H1000 or an ink tank H1900 installed in the body can be replaced. When the access cover M1003 is opened or closed, a projection formed at the back of the access cover, not shown here, pivots a cover open/close lever. Detecting the pivotal position of the lever as by a micro-switch and so on can determine whether the access cover is open or closed.

At the upper rear surface of the upper case M1002 a power key E0018, a resume key E0019 and an LED E0020 are provided. When the power key E0018 is pressed, the LED E0020 lights up indicating to an operator that the apparatus is ready to print. The LED E0020 has a variety of display functions, such as alerting the operator to printer troubles as by changing its blinking intervals and color. Further, a buzzer E0021 (FIG. 7) may be sounded. When the trouble is eliminated, the resume key E0019 is pressed to resume the printing.

2. Printing Operation Mechanism

Next, a printing operation mechanism installed and held in the printer body M1000 according to this embodiment will be explained.

The printing operation mechanism in this embodiment comprises: an automatic sheet feed unit M3022 to automatically feed a print sheet into the printer body; a sheet transport unit M3029 to guide the print sheets, fed one at a time from the automatic sheet feed unit, to a predetermined print position and to guide the print sheet from the print position to a discharge unit M3030; a print unit to perform a desired printing on the print sheet carried to the print position; and an ejection performance recovery unit M5000 to recover the ink ejection performance of the print unit.

Here, the print unit will be described. The print unit comprises a carriage M4001 movably supported on a carriage shaft M4021 and a print head cartridge H1000 removably mounted on the carriage M4001.

2.1 Print Head Cartridge

First, the print head cartridge used in the print unit will be described with reference to FIGS. 3 to 5.

Figure 3:
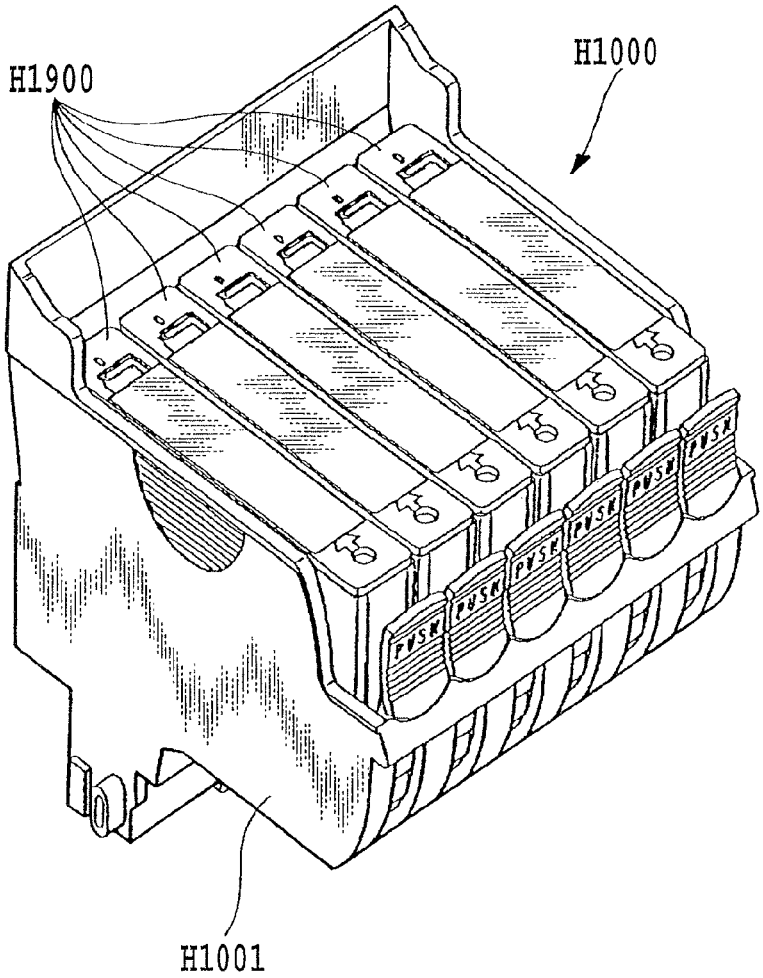
FIG. 3 is a perspective view showing an assembled print head cartridge used in the printer of one embodiment of the present invention.
Figure 4:
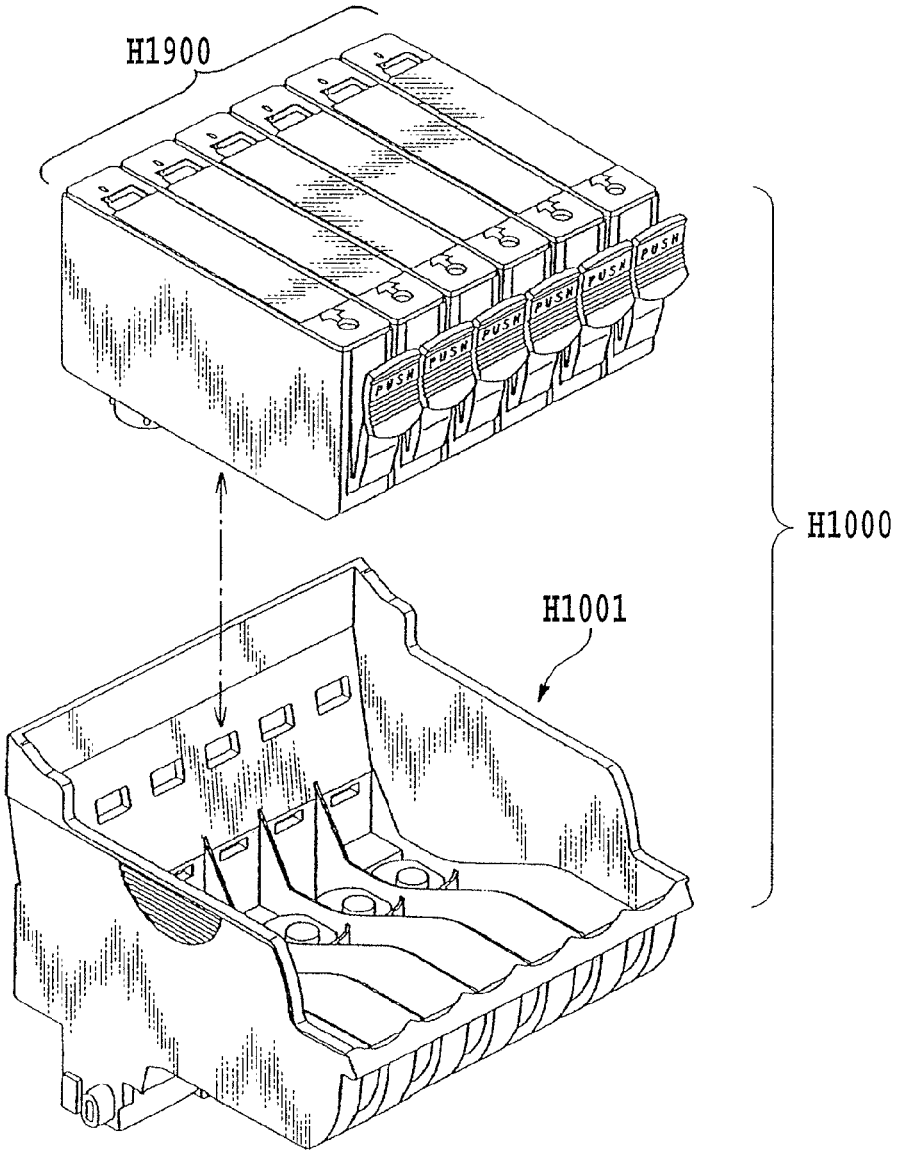
FIG. 4 is an exploded perspective view showing the print head cartridge of FIG. 3.

The print head cartridge H 1000 in this embodiment, as shown in FIG. 3, has an ink tank H1900 containing inks and a print head H1001 for ejecting ink supplied from the ink tank 111900 out through nozzles according to print information. The print head H1001 is of a so-called cartridge type in which it is removably mounted to the carriage M4001 described later.

The ink tank for this print head cartridge H1000 consists of separate ink tanks H1900 of, for example, black, light cyan, light magenta, cyan, magenta and yellow to enable color printing with as high an image quality as a photograph. As shown in FIG. 4, these individual ink tanks are removably mounted to the print head H1001.

Figure 5:
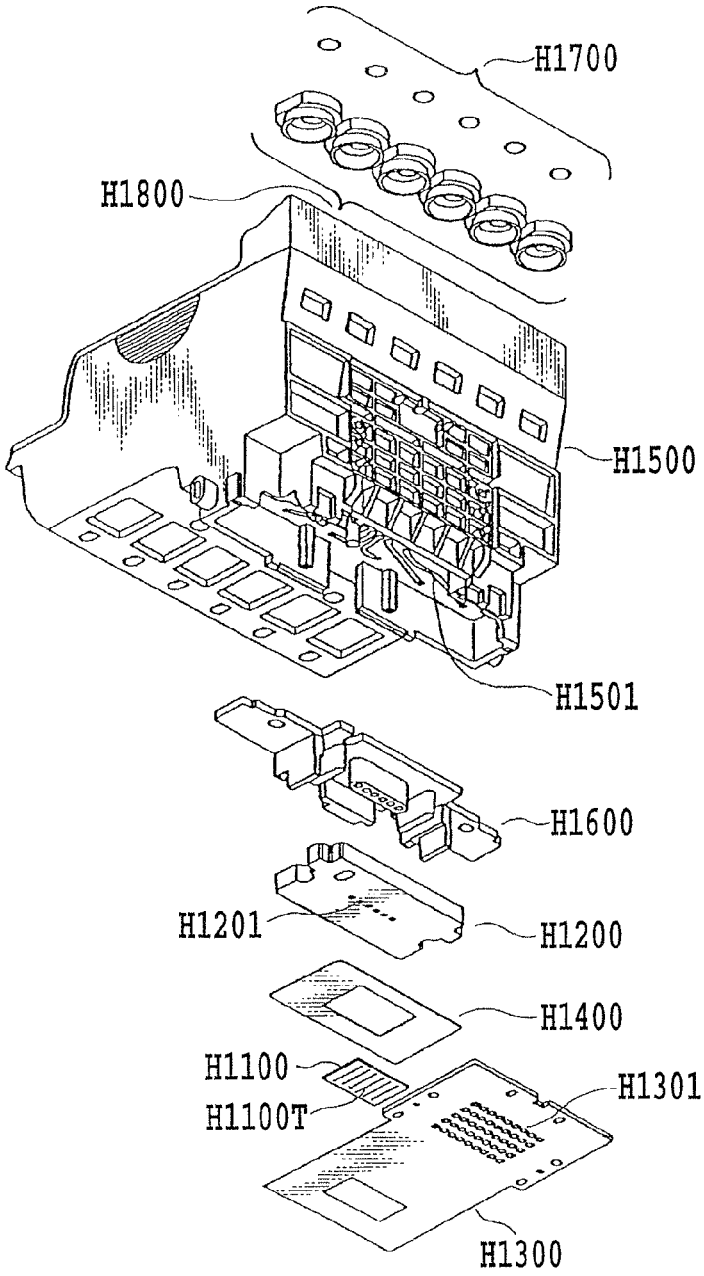
FIG. 5 is an exploded perspective view of the print head of FIG. 4 as seen diagonally below.

Then, the print head H1001, as shown in the perspective view of FIG. 5, comprises a print element substrate H1100, a first plate H1200, an electric wiring board H1300, a second plate H1400, a tank holder H1500, a flow passage forming member H1600, a filter H1700 and a seal rubber H1800.

The print element silicon substrate H1100 has formed in one of its surfaces, by the film deposition technology, a plurality of print elements to produce energy for ejecting ink and electric wires, such as aluminum, for supplying electricity to individual print elements. A plurality of ink passages and a plurality of nozzles H1100T, both corresponding to the print elements, are also formed by the photolithography technology. In the back of the print element substrate H1100, there are formed ink supply ports for supplying ink to the plurality of ink passages. The print element substrate H1100 is securely bonded to the first plate H1200 which is formed with ink supply ports H1201 for supplying ink to the print element substrate H1100. The first plate H1200 is securely bonded with the second plate H1400 having an opening. The second plate H1400 holds the electric wiring board H1300 to electrically connect the electric wiring board H1300 with the print element substrate H1100. The electric wiring board H1300 is to apply electric signals for ejecting ink to the print element substrate H1100, and has electric wires associated with the print element substrate HI100 and external signal input terminals H1301 situated at electric wires' ends for receiving electric signals from the printer body. The external signal input terminals H1301 are positioned and fixed at the back of a tank holder H1500 described later.

The tank holder H1500 that removably holds the ink tank H1900 is securely attached, as by ultrasonic fusing, with the flow passage forming member H1600 to form an ink passage H1501 from the ink tank H1900 to the first plate H1200. At the ink tank side end of the ink passage H1501 that engages with the ink tank H1900, a filter H1700 is provided to prevent external dust from entering. A seal rubber H1800 is provided at a portion where the filter H1700 engages the ink tank H1900, to prevent evaporation of the ink from the engagement portion.

As described above, the tank holder unit, which includes the tank holder H1500, the flow passage forming member H1600, the filter H1700 and the seal rubber H1800, and the print element unit, which includes the print element substrate H1100, the first plate H1200, the electric wiring board H1300 and the second plate H1400, are combined as by adhesives to form the print head H1001.

2.2 Carriage

Next, by referring to FIG. 2, the carriage M4001 carrying the print head cartridge H1000 will be explained.

As shown in FIG. 2, the carriage M4001 has a carriage cover M4002 for guiding the print head H1001 to a predetermined mounting position on the carriage M4001, and a head set lever M4007 that engages and presses against the tank holder H1500 of the print head H1001 to set the print head H1001 at a predetermined mounting position.

That is, the head set lever M4007 is provided at the upper part of the carriage M4001 so as to be pivotable about a head set lever shaft. There is a spring-loaded head set plate (not shown) at an engagement portion where the carriage M4001 engages the print head H1001. With the spring force, the head set lever M4007 presses against the print head H1001 to mount it on the carriage M4001.

At another engagement portion of the carriage M4001 with the print head H1001, there is provided a contact flexible printed cable (see FIG. 7: simply referred to as a contact FPC hereinafter) E0011 whose contact portion electrically contacts a contact portion (external signal input terminals)

H1301 provided in the print head H1001 to transfer various information for printing and supply electricity to the print head H1001.

Between the contract portion of the contact FPC E0011 and the carriage M4001 there is an elastic member not shown, such as rubber. The elastic force of the elastic member and the pressing force of the head set lever spring combine to ensure a reliable contact between the contact portion of the contact FPC E0011 and the carriage M4001. Further, the contact FPC E0011 is connected to a carriage substrate E0013 mounted at the back of the carriage M4001 (see FIG. 7).

3. Scanner

The printer of this embodiment can mount a scanner in the carriage M4001 in place of the print head cartridge H1000 and be used as a reading device.

The scanner moves together with the carriage M4001 in the main scan direction, and reads an image on a document fed instead of the printing medium as the scanner moves in the main scan direction. Alternating the scanner reading operation in the main scan direction and the document feed in the sub-scan direction enables one page of document image information to be read.

Figure 6B:
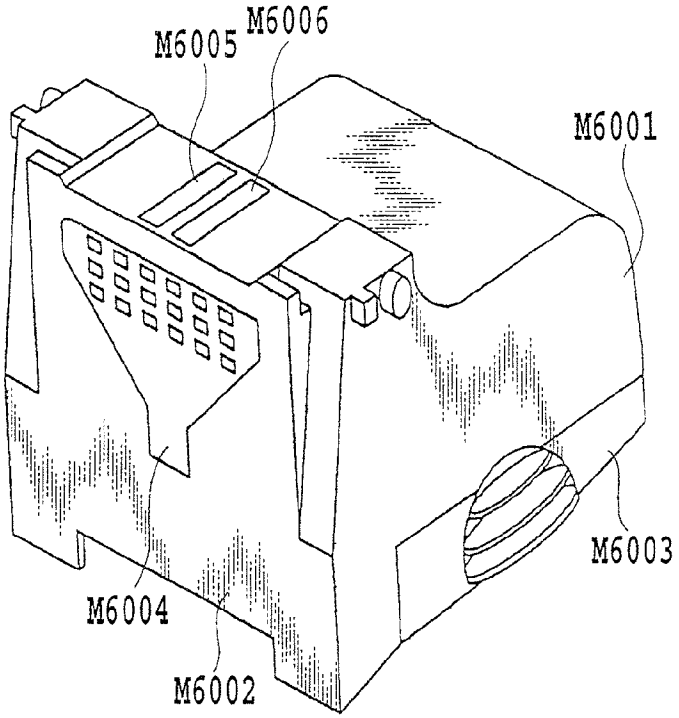
FIGS. 6A and 6B are perspective views showing a construction of a scanner cartridge upside down which can be mounted in the printer of one embodiment of the present invention instead of the print head cartridge of FIG. 3.
Figure 6A:
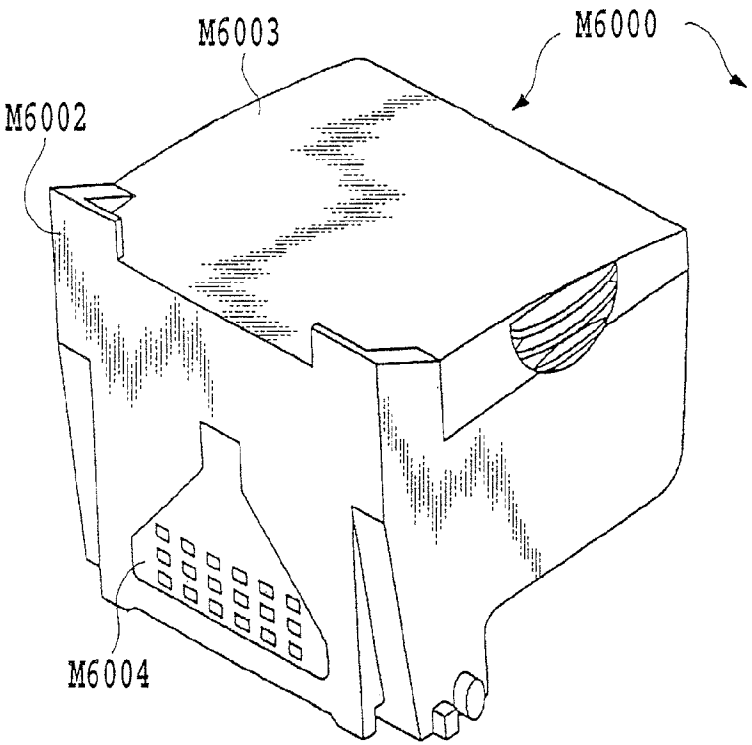

FIGS. 6A and 6B show the scanner M6000 upside-down to explain its outline construction.

As shown in the figure, a scanner holder M6001 is shaped like a box and contains an optical system and a processing circuit necessary for reading. A reading lens M6006 is provided at a portion that faces the surface of a document when the scanner M6000 is mounted on the carriage M4001. The lens M6006 focuses light reflected from the document surface onto a reading unit inside the scanner to read the document image. An illumination lens M6005 has a light source not shown inside the scanner. The light emitted from the light source is radiated onto the document through the lens M6005.

The scanner cover M6003 secured to the bottom of the scanner holder M6001 shields the interior of the scanner holder M6001 from light. Louver-like grip portions are provided at the sides to improve the ease with which the scanner can be mounted to and dismounted from the carriage M4001. The external shape of the scanner holder M6001 is almost similar to that of the print head H1001, and the scanner can be mounted to or dismounted from the carriage M4001 in a manner similar to that of the print head H1001.

The scanner holder M6001 accommodates a substrate having a reading circuit, and a scanner contact PCB M6004 connected to this substrate is exposed outside. When the scanner M6000 is mounted on the carriage M4001, the scanner contact PCB M6004 contacts the contact FPC E0011 of the carriage M4001 to electrically connect the substrate to a control system on the printer body side through the carriage M4001.

4. Example Configuration of Printer Electric Circuit

Next, an electric circuit configuration in this embodiment of the invention will be explained.

Figure 7:
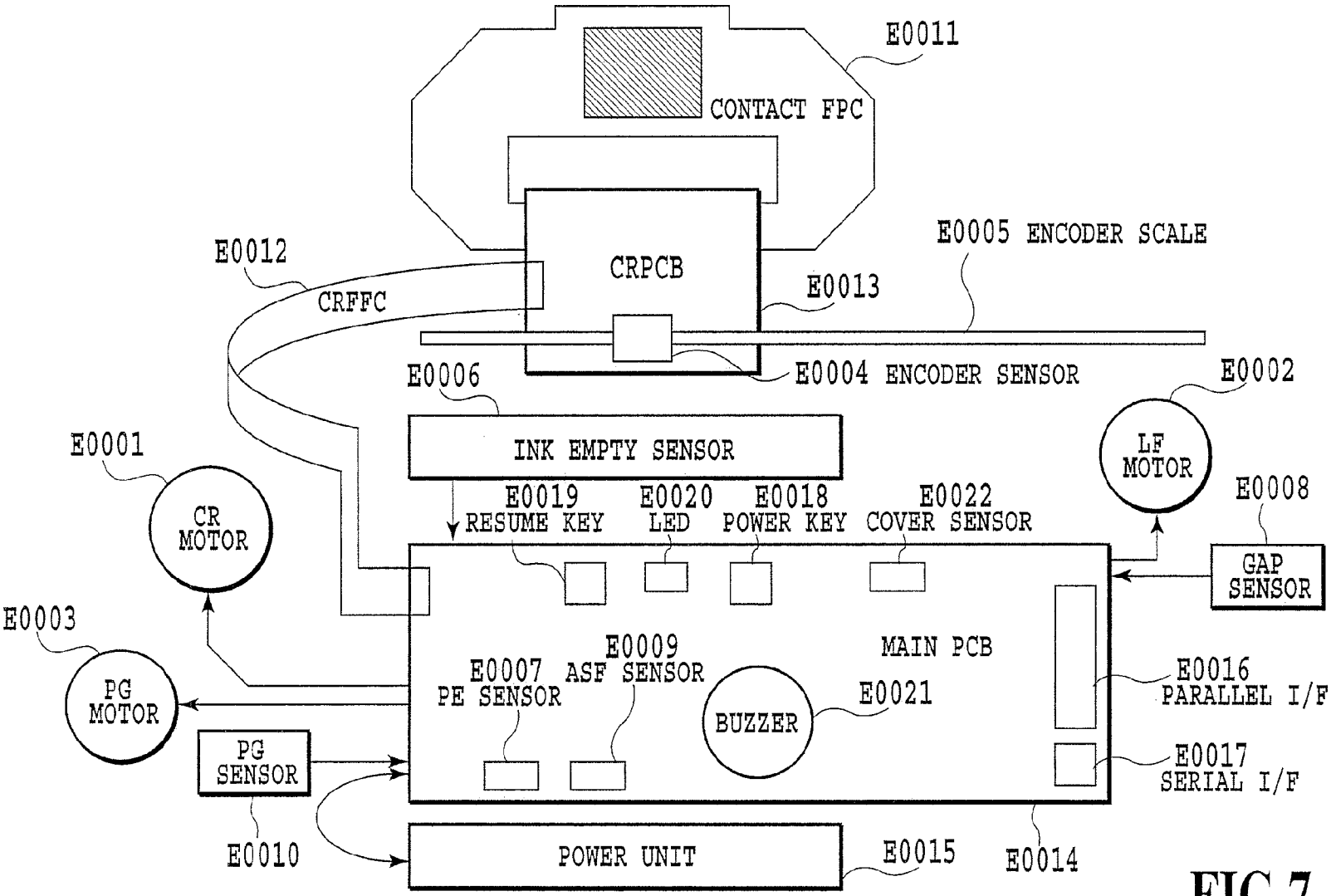
FIG. 7 is a block diagram schematically showing the overall configuration of an electric circuitry of the printer according to one embodiment of the present invention.

FIG. 7 schematically shows the overall configuration of the electric circuit in this embodiment.

The electric circuit in this embodiment comprises mainly a carriage substrate (CRPCB) E0013, a main PCB (printed circuit board) E0014 and a power supply unit E0015.

The power supply unit E0015 is connected to the main PCB E0014 to supply a variety of drive power.

The carriage substrate E0013 is a printed circuit board unit mounted on the carriage M4001 (FIG. 2) and functions as an interface for transferring signals to and from the print head through the contact FPC E0011. In addition, based on a pulse signal output from an encoder sensor E0004 as the carriage M4001 moves, the carriage substrate E0013 detects a change in the positional relation between an encoder scale E0005 and the encoder sensor E0004 and sends its output signal to the main PCB E0014 through a flexible flat cable (CRFFC) E0012.

Further, the main PCB E0014 is a printed circuit board unit that controls the operation of various parts of the ink jet printing apparatus in this embodiment, and has I/O ports for a paper end sensor (PE sensor) E0007, an automatic sheet feeder (ASF) sensor E0009, a cover sensor E0022, a parallel interface (parallel I/F) E0016, a serial interface (Serial I/F) E0017, a resume key E0019, an LED E0020, a power key E0018 and a buzzer E0021. The main PCB E0014 is connected to and controls a motor (CR motor) E0001 that constitutes a drive source for moving the carriage M4001 in the main scan direction; a motor (LF motor) E0002 that constitutes a drive source for transporting the printing medium; and a motor (PG motor) E0003 that performs the functions of recovering the ejection performance of the print head and feeding the printing medium. The main PCB E0014 also has connection interfaces with an ink empty sensor E0006, a gap sensor E0008, a PG sensor E0010, the CRFFC E0012 and the power supply unit E0015.

Figures 8, 8A:
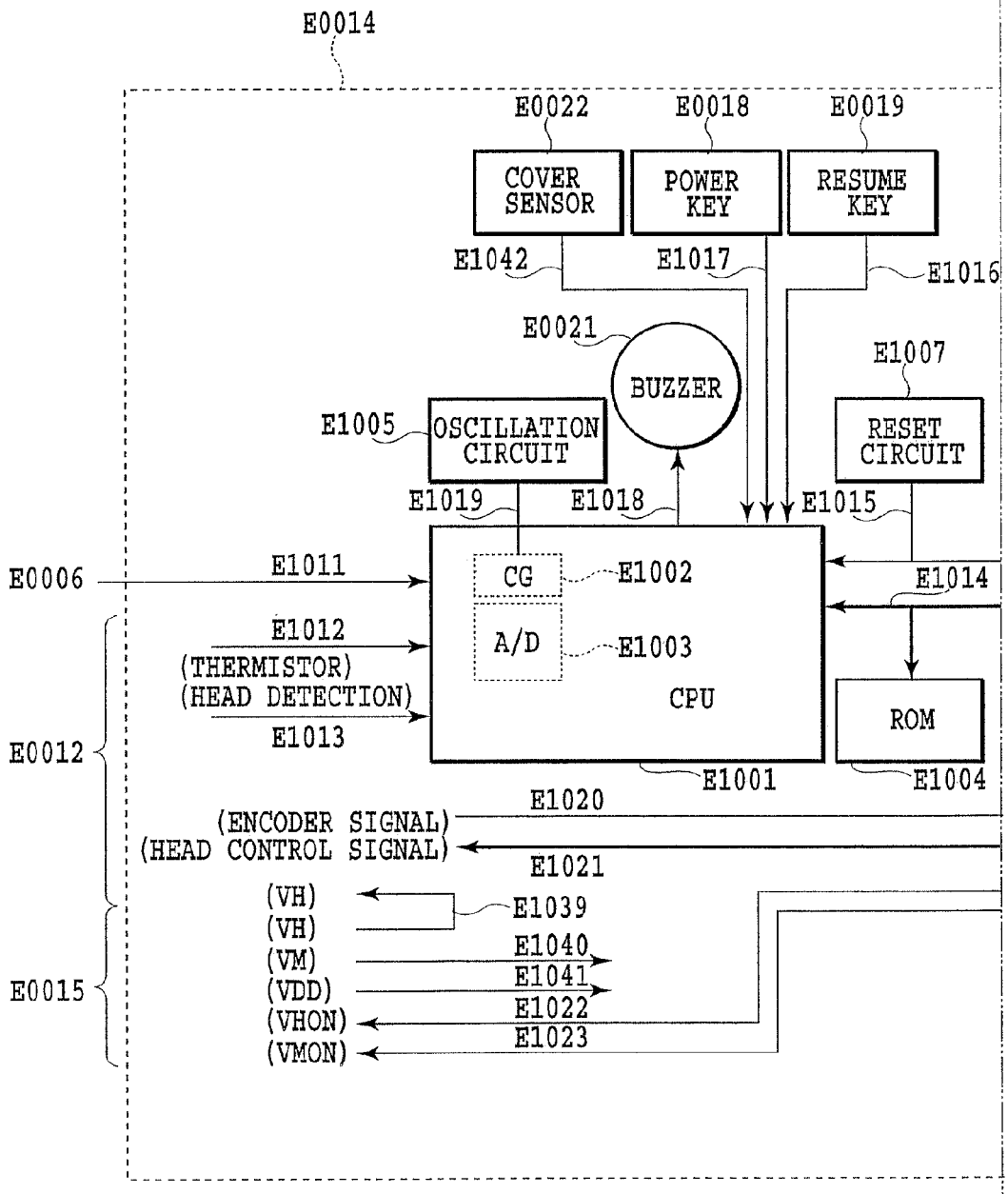
FIG. 8 is a diagram showing the relation between FIGS. 8A and 8B, FIGS. 8A and 8B being block diagrams representing an example inner configuration of a main printed circuit board (PCB) in the electric circuitry of FIG. 7.
Figure 8B:
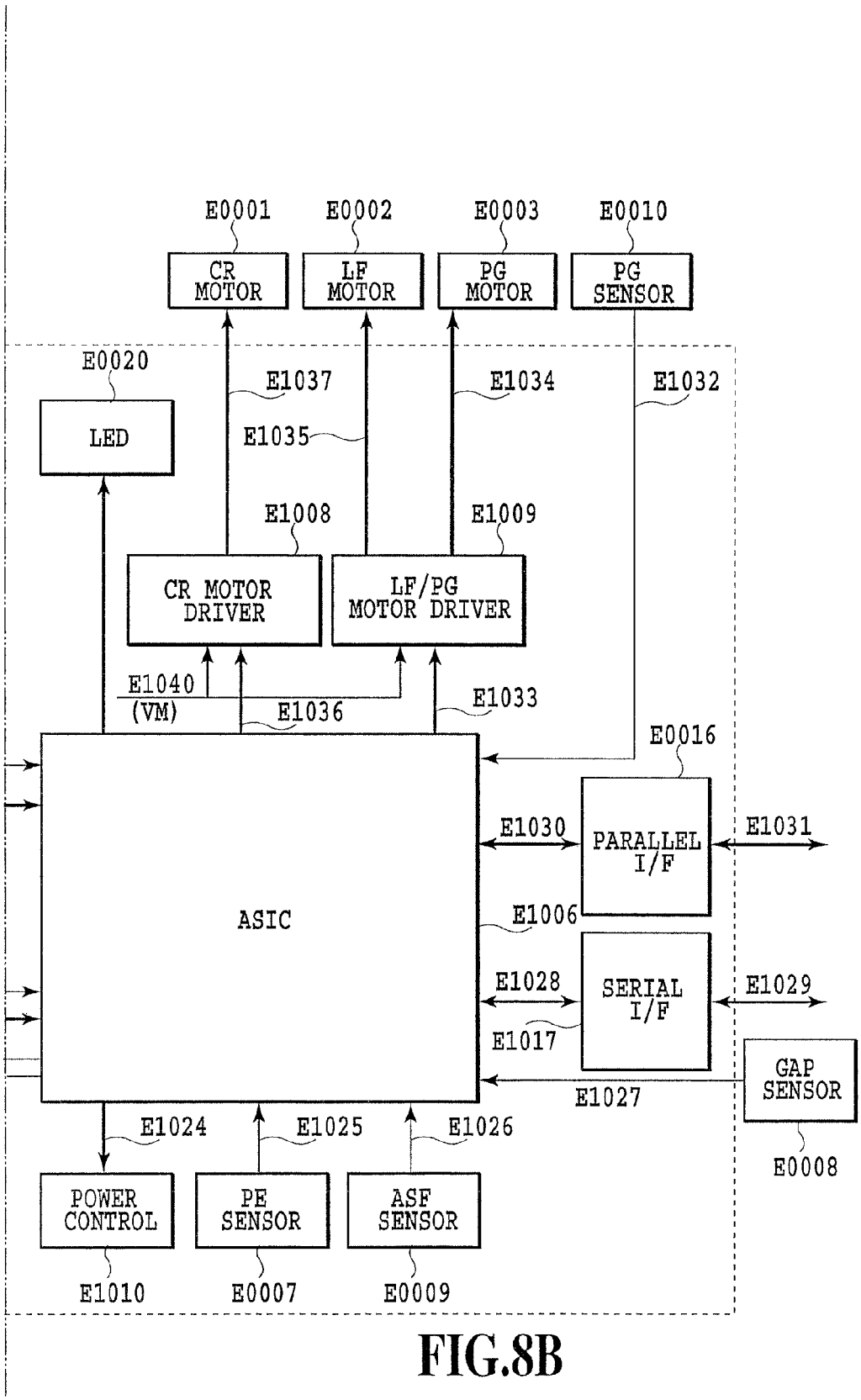

FIG. 8 is a diagram showing the relation between FIGS. 8A and 8B, and FIGS. 8A and 8B are block diagrams showing an inner configuration of the main PCB E0014.

Reference number E1001 represents a CPU, which has a clock generator (CG) E1002 connected to an oscillation circuit E1005 to generate a system clock based on an output signal E1019 of the oscillation circuit E1005. The CPU E1001 is connected to an ASIC (application specific integrated circuit) and a ROM E1004 through a control bus E1014. According to a program stored in the ROM E1004, the CPU E1001 controls the ASIC E1006, checks the status of an input signal E1017 from the power key, an input signal E1016 from the resume key, a cover detection signal. E1042 and a head detection signal (HSENS) E1013, drives the buzzer E0021 according to a buzzer signal (BUZ) E1018, and checks the status of an ink empty detection signal (INKS) E1011 connected to a built-in A/D converter E1003 and of a temperature detection signal (TH) E1012 from a thermistor. The CPU E1001 also performs various other logic operations and makes conditional decisions to control the operation of the ink jet printing apparatus.

The head detection signal. E1013 is a head mount detection signal entered from the print head cartridge H1000 through the flexible flat cable E0012, the carriage substrate E0013 and the contact FPC E0011. The ink empty detection signal E1011 is an analog signal output from the ink empty sensor E0006. The temperature detection signal E1012 is an analog signal from the thermistor (not shown) provided on the carriage substrate E0013.

Designated E1008 is a CR motor driver that uses a motor power supply (VM) E1040 to generate a CR motor drive signal E1037 according to a CR motor control signal E1036 from the ASIC E1006 to drive the CR motor E0001. E1009 designates an LF/PG motor driver which uses the motor power supply E1040 to generate an LF motor drive signal E1035 according to a pulse motor control signal (PM control signal) E1033 from the ASIC E1006 to drive the LF motor. The LF/PG motor driver E1009 also generates a PG motor drive signal E1034 to drive the PG motor.

Designated E1010 is a power supply control circuit which controls the supply of electricity to respective sensors with light emitting elements according to a power supply control signal E1024 from the ASIC E1006. The parallel OF E0016 transfers a parallel I/F signal E1030 from the ASIC E1006 to a parallel I/F cable E1031 connected to external circuits and also transfers a signal of the parallel I/F cable E1031 to the ASIC E1006. The serial I/F E0017 transfers a serial I/F signal E1028 from the ASIC E1006 to a serial I/F cable E1029 connected to external circuits, and also transfers a signal from the serial I/F cable E1029 to the ASIC E1006.

The power supply unit E0015 provides a head power signal (VH) E1039, a motor power signal (VM) E1040 and a logic power signal (VDD) E1041. A head power ON signal (VHON) E1022 and a motor power ON signal (VMON) E1023 are sent from the ASIC E1006 to the power supply unit E0015 to perform the ON/OFF control of the head power signal E1039 and the motor power signal E1040. The logic power signal (VDD) E1041 supplied from the power supply unit E0015 is voltage-converted as required and given to various parts inside or outside the main PCB E0014.

The head power signal E1039 is smoothed by a circuit of the main PCB E0014 and then sent out to the flexible flat cable E0011 to be used for driving the print head cartridge H1000. E1007 denotes a reset circuit which detects a reduction in the logic power signal E1041 and sends a reset signal (RESET) to the CPU E1001 and the ASIC E1006 to initialize them.

The ASIC E1006 is a single-chip semiconductor integrated circuit and is controlled by the CPU E1001 through the control bus E1014 to output the CR motor control signal E1036, the PM control signal E1033, the power supply control signal E1024, the head power ON signal E1022 and the motor power ON signal E1023. It also transfers signals to and from the parallel interface E0016 and the serial interface E0017. In addition, the ASIC E1006 detects the status of a PE detection signal (PES) E1025 from the PE sensor E0007, an ASF detection signal (ASFS) E1026 from the ASF sensor E0009, a gap detection signal (GAPS) E1027 from the GAP sensor E0008 for detecting a gap between the print head and the printing medium, and a PG detection signal (PGS) E1032 from the PG sensor E0010, and sends data representing the statuses of these signals to the CPU E1001 through the control bus E1014. Based on the data received, the CPU E1001 controls the operation of an LED drive signal E1038 to turn on or off the LED E0020.

Further, the ASIC E1006 checks the status of an encoder signal (ENC) E1020, generates a timing signal, interfaces with the print head cartridge H1000 and controls the print operation by a head control signal E1021. The encoder signal (ENC) E1020 is an output signal of the CR encoder sensor E0004 received through the flexible flat cable E0012. The head control signal E1021 is sent to the print head H1001 through the flexible flat cable E0012, carriage substrate E0013 and contact FPC E0011.

Figures 9, 9A:
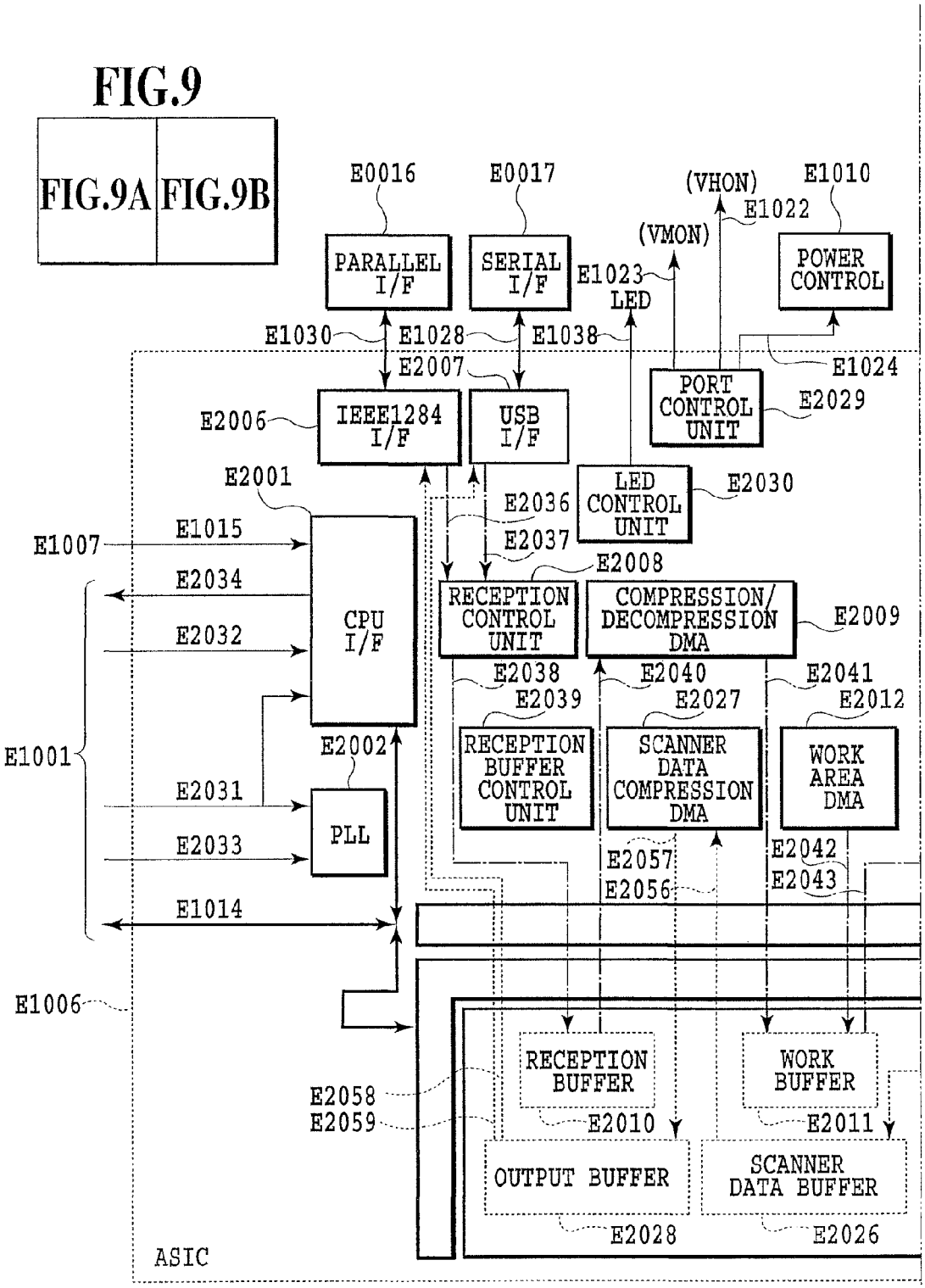
FIG. 9 is a diagram showing the relation between FIGS. 9A and 9B, FIGS. 9A and 9B being block diagrams representing an example inner configuration of an application specific integrated circuit (ASIC) in the main PCB of FIGS. 8A and 8B.
Figure 9B:
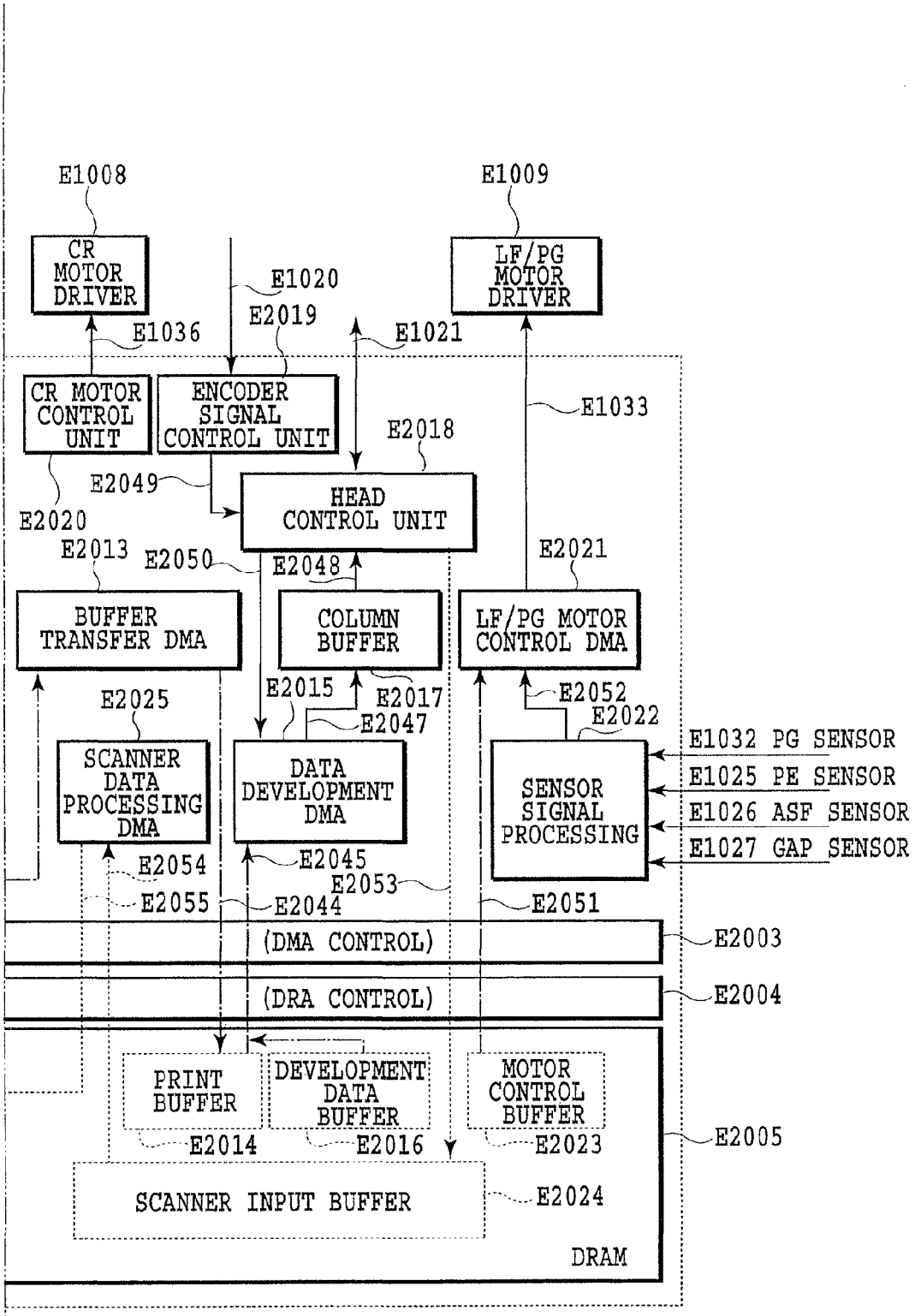

FIG. 9 is a diagram showing the relation between FIGS. 9A and 9B, and FIGS. 9A and 9B are block diagrams showing an example internal configuration of the ASIC E1006.

In these figures, only the flow of data, such as print data and motor control data, associated with the control of the head and various mechanical components is shown between each block, and control signals and clock associated with the read/write operation of the registers incorporated in each block and control signals associated with the DMA control are omitted to simplify the drawing.

In the figures, reference number E2002 represents a PLL controller which, based on a clock signal (CLK) E2031 and a PLL control signal (PLLON) E2033 output from the CPU E1001, generates a clock (not shown) to be supplied to most of the components of the ASIC E1006.

Denoted E2001 is a CPU interface (CPU I/F) E2001, which controls the read/write operation of register in each block, supplies a clock to some blocks and accepts an interrupt signal (none of these operations are shown) according to a reset signal E1015, a software reset signal (PDWN) E2032 and a clock signal (CLK) E2031 output from the CPU El 001, and control signals from the control bus E1014. The CPU I/F E2001 then outputs an interrupt signal (INT) E2034 to the CPU E1001 to inform it of the occurrence of an interrupt within the ASIC E1006.

E2005 denotes a DRAM which has various areas for storing print data, such as a reception buffer E2010, a work buffer E2011, a print buffer E2014 and a development data buffer E2016. The DRAM E2005 also has a motor control buffer E2023 for motor control and, as buffers used instead of the above print data buffers during the scanner operation mode, a scanner input buffer E2024, a scanner data buffer E2026 and an output buffer E2028.

The DRAM E2005 is also used as a work area by the CPU E1001 for its own operation. Designated E2004 is a DRAM control unit E2004 which performs read/write operations on the DRAM E2005 by switching between the DRAM access from the CPU E1001 through the control bus and the DRAM access from a DMA control unit E2003 described later.

The DMA control unit E2003 accepts request signals (not shown) from various blocks and outputs address signals and control signals (not shown) and, in the case of write operation, write data E2038, E2041, E2044, E2053, E2055, E2057 etc. to the DRAM control unit to make DRAM accesses. In the case of read operation, the DMA control unit E2003 transfers the read data E2040, E2043, E2045, E2051, E2054, E2056, E2058, E2059 from the DRAM control unit E2004 to the requesting blocks.

Denoted E2006 is an IEEE 1284 I/F which functions as a bi-directional communication interface with external host devices, not shown, through the parallel I/F E0016 and is controlled by the CPU E1001 via CPU I/F E2001. During the printing operation, the IEEE 1284 I/F E2006 transfers the receive data (PIF receive data E2036) from the parallel I/F E0016 to a reception control unit E2008 by the DMA processing. During the scanner reading operation, the 1284 I/F E2006 sends the data (1284 transmit data (RDPIF) E2059) stored in the output buffer E2028 in the DRAM E2005 to the parallel I/F E0016 by the DMA processing.

Designated E2007 is a universal serial bus (USB) I/F which offers a bi-directional communication interface with external host devices, not shown, through the serial I/F E0017 and is controlled by the CPU E1001 through the CPU I/F E2001. During the printing operation, the universal serial bus (USB) I/F E2007 transfers received data (USB receive data E2037) from the serial I/F E0017 to the reception control unit E2008 by the DMA processing. During the scanner reading, the universal serial bus (USB) I/F E2007 sends data (USB transmit data (RDUSB) E2058) stored in the output buffer E2028 in the DRAM E2005 to the serial I/F E0017 by the DMA processing. The reception control unit E2008 writes data (WDIF E2038) received from the 1284 I/F E2006 or universal serial bus (USB) I/F E2007, whichever is selected, into a reception buffer write address managed by a reception buffer control unit E2039.

Designated E2009 is a compression/decompression DMA controller which is controlled by the CPU E1001 through the CPU I/F E2001 to read received data (raster data) stored in a reception buffer E2010 from a reception buffer read address managed by the reception buffer control unit E2039, compress or decompress the data (RDWK) E2040 according to a specified mode, and write the data as a print code string (WDWK) E2041 into the work buffer area.

Designated E2013 is a print buffer transfer DMA controller which is controlled by the CPU E1001 through the CPU I/F E2001 to read print codes (RDWP) E2043 on the work buffer E2011 and rearrange the print codes onto addresses on the print buffer E2014 that match the sequence of data transfer to the print head cartridge H1000 before transferring the codes (WDWP E2044). Reference number E2012 denotes a work area DMA controller which is controlled by the CPU E1001 through the CPU I/F E2001 to repetitively write specified work fill data (WDWF) E2042 into the area of the work buffer whose data transfer by the print buffer transfer DMA controller E2013 has been completed.

Designated E2015 is a print data development DMA controller E2015, which is controlled by the CPU E1001 through the CPU I/F E2001. Triggered by a data development timing signal E2050 from a head control unit E2018, the print data development DMA controller E2015 reads the print code that was rearranged and written into the print buffer and the development data written into the development data buffer E2016 and writes developed print data (RDHDG) E2045 into the column buffer E2017 as column buffer write data (WDHDG) E2047. The column buffer E2017 is an SRAM that temporarily stores the transfer data (developed print data) to be sent to the print head cartridge H1000, and is shared and managed by both the print data development DMA CONTROLLER and the head control unit through a handshake signal (not shown).

Designated E2018 is a head control unit E2018 which is controlled by the CPU E1001 through the CPU I/F E2001 to interface with the print head cartridge H1000 or the scanner through the head control signal. It also outputs a data development timing signal E2050 to the print data development DMA controller according to a head drive timing signal E2049 from the encoder signal processing unit E2019.

During the printing operation, the head control unit E2018, when it receives the head drive timing signal E2049, reads developed print data (RDHD) E2048 from the column buffer and outputs the data to the print head cartridge H1000 as the head control signal E1021.

In the scanner reading mode, the head control unit E2018 DMA-transfers the input data (WDHD) E2053 received as the head control signal E1021 to the scanner input buffer E2024 on the DRAM E2005. Designated E2025 is a scanner data processing DMA controller E2025 which is controlled by the CPU E1001 through the CPU I/F E2001 to read input buffer read data (RDAV) E2054 stored in the scanner input buffer E2024 and writes the averaged data (WDAV) E2055 into the scanner data buffer E2026 on the DRAM E2005.

Designated E2027 is a scanner data compression DMA controller which is controlled by the CPU E1001 through the CPU I/F E2001 to read processed data (RDYC) E2056 on the scanner data buffer E2026, perform data compression, and write the compressed data (WDYC) E2057 into the output buffer E2028 for transfer.

Designated E2019 is an encoder signal processing unit which, when it receives an encoder signal (ENC), outputs the head drive timing signal E2049 according to a mode determined by the CPU E1001. The encoder signal processing unit E2019 also stores in a register information on the position and speed of the carriage M4001 obtained from the encoder signal E1020 and presents it to the CPU E1001. Based on this information, the CPU E1001 determines various parameters for the CR motor E0001. Designated E2020 is a CR motor control unit which is controlled by the CPU E1001 through the CPU I/F E2001 to output the CR motor control signal E1036.

Denoted E2022 is a sensor signal processing unit which receives detection signals E1032, E1025, E1026 and E1027 output from the PG sensor E0010, the PE sensor E0007, the ASF sensor E0009 and the gap sensor E0008, respectively, and transfers this sensor information to the CPU E1001 according to the mode determined by the CPU E1001. The sensor signal processing unit E2022 also outputs a sensor detection signal E2052 to a DMA controller E2021 for controlling the LF/PG motor.

The DMA controller E2021 for controlling LF/PG motor is controlled by the CPU E1001 through the CPU I/F E2001 to read a pulse motor drive table (RDPM) E2051 from the motor control buffer E2023 on the DRAM E2005 and output a pulse motor control signal E1033. Depending on the operation mode, the controller outputs the pulse motor control signal E1033 upon reception of the sensor detection signal as a control trigger.

Designated E2030 is an LED control unit which is controlled by the CPU E1001 through the CPU I/F E2001 to output an LED drive signal E1038. Further, designated E2029 is a port control unit which is controlled by the CPU E1001 through the CPU I/F E2001 to output the head power ON signal E1022, the motor power ON signal E1023 and the power supply control signal E1024.

5. Operation of Printer

Figure 10:
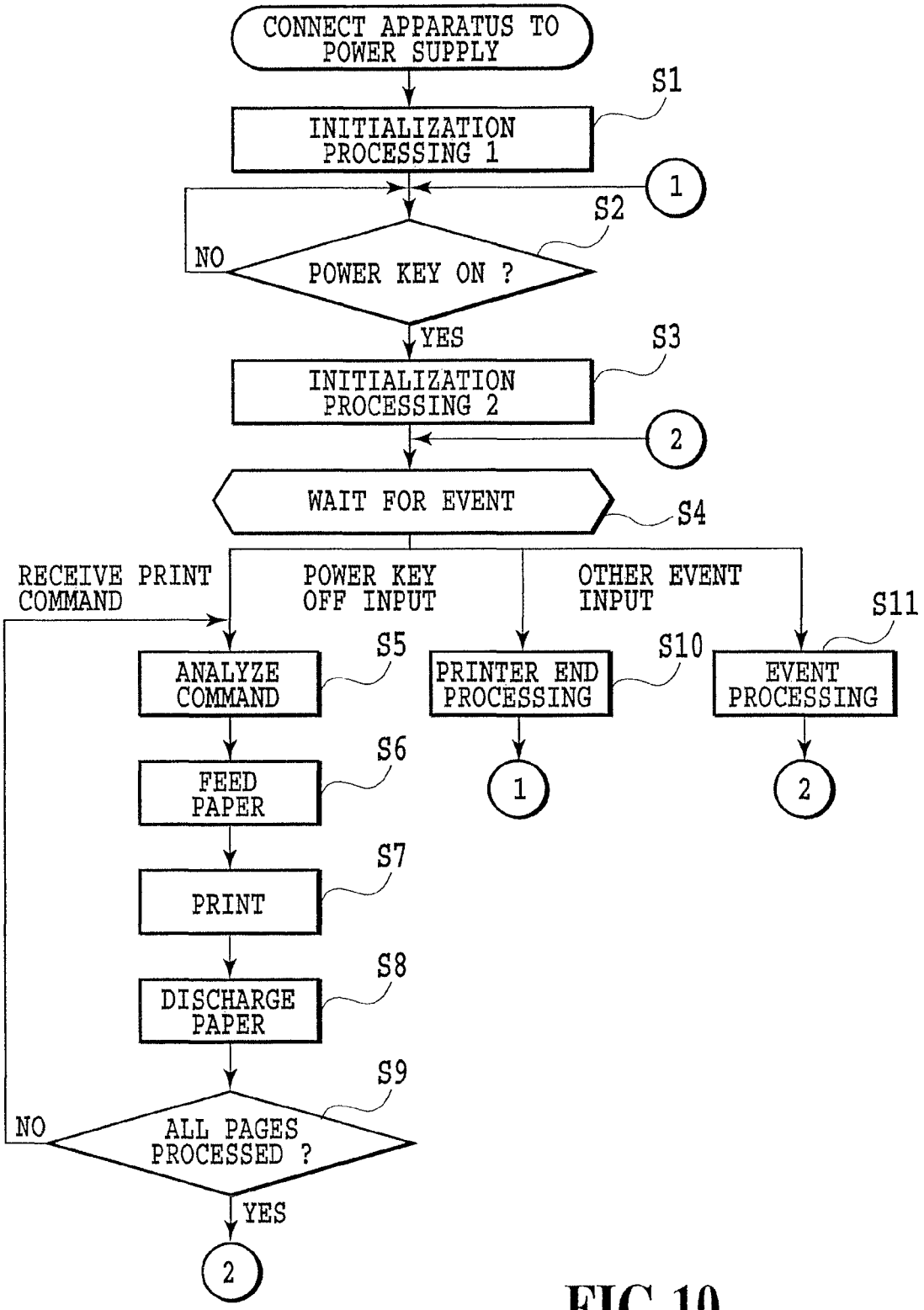
FIG. 10 is a flow chart showing an example of operation of the printer as one embodiment of the present invention.

Next, the operation of the ink jet printing apparatus in this embodiment of the invention with the above configuration will be explained by referring to the flow chart of FIG. 10.

When the printer body M1000 is connected to an AC power supply, a first initialization is performed at step S1. In this initialization process, the electric circuit system including the ROM and RAM in the apparatus is checked to confirm that the apparatus is electrically operable.

Next, step S2 checks if the power key E0018 on the upper case M1002 of the printer body M1000 is turned on. When it is decided that the power key E0018 is pressed, the processing moves to the next step S3 where a second initialization is performed.

In this second initialization, a check is made of various drive mechanisms and the print head of this apparatus. That is, when various motors are initialized and head information is read, it is checked whether the apparatus is normally operable.

Next, step S4 waits for an event. That is, this step monitors a demand event from the external I/F, a panel key event from the user operation and an internal control event and, when any of these events occurs, executes the corresponding processing.

When, for example, step S4 receives a print command event from the external I/F, the processing moves to step S5. When a power key event from the user operation occurs at step S4, the processing moves to step S10. If another event occurs, the processing moves to step S11.

Step S5 analyzes the print command from the external I/F, checks a specified paper kind, paper size, print quality, paper feeding method and others, and stores data representing the check result into the DRAM E2005 of the apparatus before proceeding to step S6.

Next, step S6 starts feeding the paper according to the paper feeding method specified by the step S5 until the paper is situated at the print start position. The processing moves to step S7.

At step S7 the printing operation is performed. In this printing operation, the print data sent from the external I/F is stored temporarily in the print buffer. Then, the CR motor E0001 is started to move the carriage M4001 in the main-scanning direction. At the same time, the print data stored in the print buffer E2014 is transferred to the print head H1001 to print one line. When one line of the print data has been printed, the LF motor E0002 is driven to rotate the LF roller M3001 to transport the paper in the sub-scanning direction.

After this, the above operation is executed repetitively until one page of the print data from the external I/F is completely printed, at which time the processing moves to step S8.

At step S8, the LF motor E0002 is driven to rotate the paper discharge roller M2003 to feed the paper until it is decided that the paper is completely fed out of the apparatus, at which time the paper is completely discharged onto the paper discharge tray M1004.

Next at step S9, it is checked whether all the pages that need to be printed have been printed and if there are pages that remain to be printed, the processing returns to step S5 and the steps S5 to S9 are repeated. When all the pages that need to be printed have been printed, the print operation is ended and the processing moves to step S4 waiting for the next event.

Step S10 performs the printing termination processing to stop the operation of the apparatus. That is, to turn off various motors and print head, this step renders the apparatus ready to be cut off from power supply and then turns off power, before moving to step S4 waiting for the next event.

Step S11 performs other event processing. For example, this step performs processing corresponding to the ejection performance recovery command from various panel keys or external I/F and the ejection performance recovery event that occurs internally. After the recovery processing is finished, the printer operation moves to step S4 waiting for the next event.

6. Head Configuration

The construction and arrangement of nozzles in the print head H1001 used in this embodiment will be described.

Figure 11:
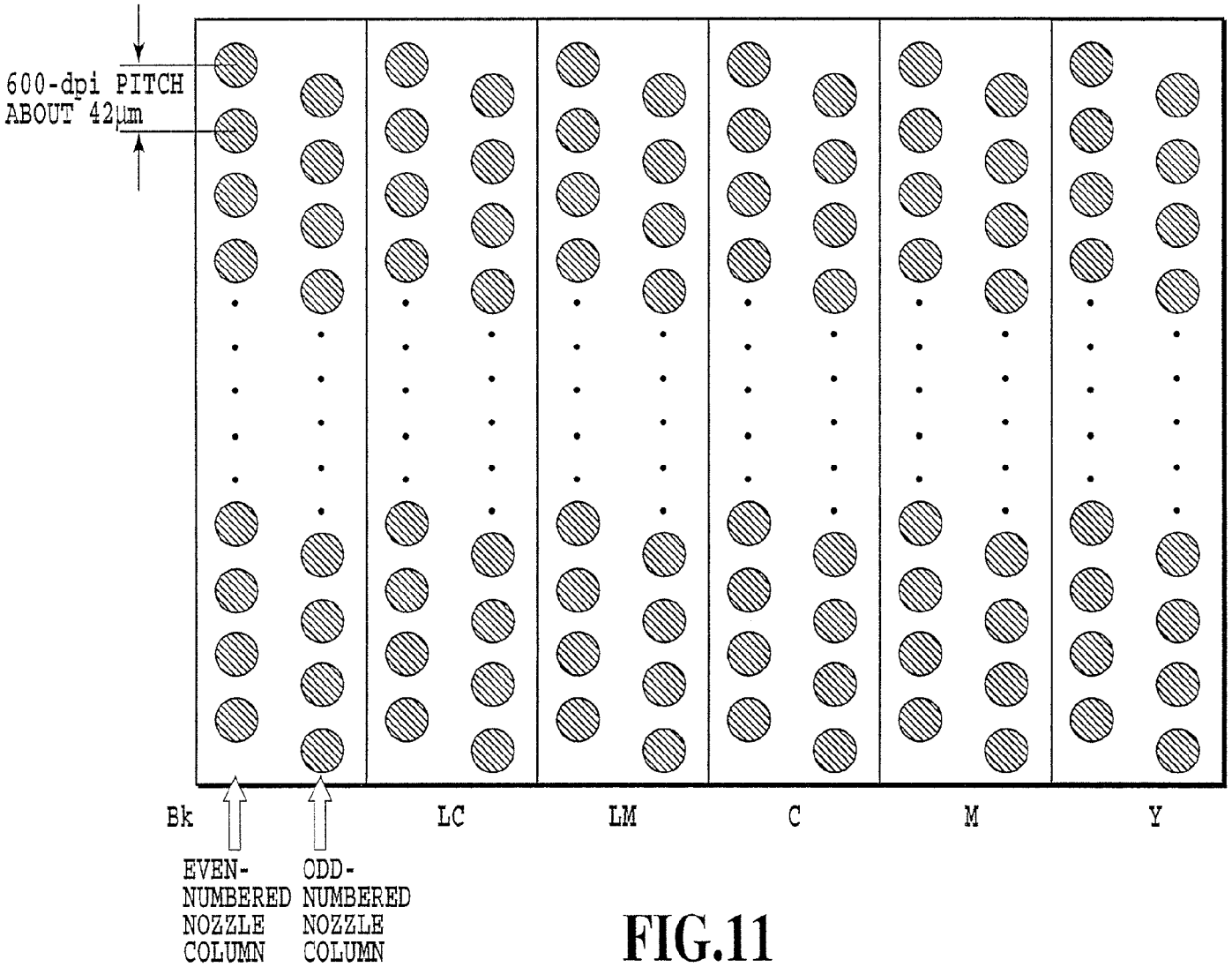
FIG. 11 is a schematic diagram showing an example of nozzle arrangement on the print head used in one embodiment of the present invention.

FIG. 11 is a schematic front view of the head used in this embodiment to realize high resolution printing. In this example, two parallel columns each having 128 nozzles are spaced from each other in the main scan direction (carriage scan direction) and staggered or shifted by about 21 μm from each other in the sub-scan direction (paper feed direction), with the 128 nozzles in each column arranged at a 600-DPI pitch (about 42 μm pitch). These two nozzle columns are used for each color and therefore a total of 256 nozzles are used to achieve a 1200 DPI resolution for each color. Further, in the example shown, the print head has 12 such nozzle columns integrally arranged side by side in the main scan direction to produce six colors with the 1200 DPI resolution. In the process of manufacture, the columns of two adjoining colors are fabricated simultaneously in one chip and then three such chips are bonded side by side. Hence, the nozzle columns of two adjoining colors in each chip (a set of black (Bk) and light cyan (LC), a set of light magenta (LM) and cyan (C) and a set of magenta (M) and yellow (Y)) have more similar driving conditions than other colors. With this construction, simply adjusting the ejection timings of the two adjoining colors can realize the 1200 DPI printing resolution.

Various processing to achieve the object of the present invention by using the printing apparatus and head with the above construction will be explained in the following. The processing for obtaining a registration value described later can be defined as corresponding to the second initialization processing (step S3) in the procedure of FIG. 10 or to the other event processing (step S11). The adjustment value for registration obtained by these processing can be reflected on the printing operation (step S7).

7. Multi-pass Printing

Because this embodiment is intended to enable the printing of mainly photographic images with high resolution, a multi-pass printing is normally performed. Here, the multi-pass printing will be briefly explained.

Unlike a monochromatic printing that prints only characters such as letters, numbers and symbols, the color image printing must meet various requirements such as color development, grayscale characteristic and uniformity. As to the uniformity in particular, slight variations among individual nozzles that are produced during the manufacture of a multi-nozzle head formed integrally with many nozzles (in this specification the nozzle generally refers to an ejection opening, a liquid passage communicating with the ejection opening and an element for generating energy used to eject ink) influence the amounts of ink ejected from the individual nozzles and the directions of ink ejection during printing and eventually degrade the image quality in the form of density variations of the printed image.

Figures 12A, 12B, 12C:
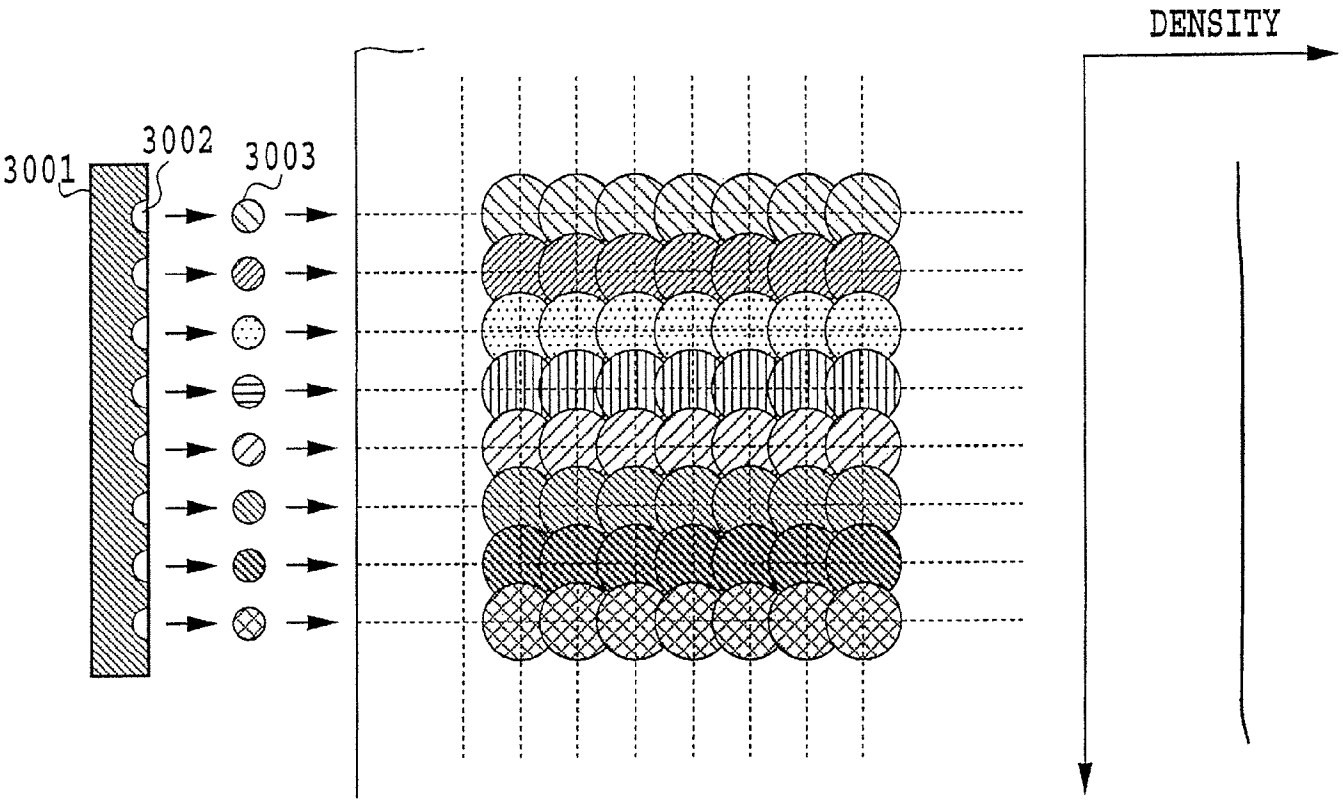
FIGS. 12A to 12C are explanatory diagrams showing a state in which an ideal ink jet printing is performed.

Detailed examples will be explained by referring to FIGS. 12A-12C, 13A-13C and 14A-14C. In FIG. 12A, designated 3001 is a multi-nozzle head, which is shown to have only eight nozzles 3002 for simplicity. Denoted 3003 are ink droplets ejected from the nozzles 3002. It is ideal that the ink droplets are ejected in equal amounts and in the same direction. If ink ejection is done in this manner, ink dots of equal sizes land on the print medium, as shown in FIG. 12B, resulting in a uniform density distribution with no unevenness in density (FIG. 12C).

Figures 13A, 13B, 13C:
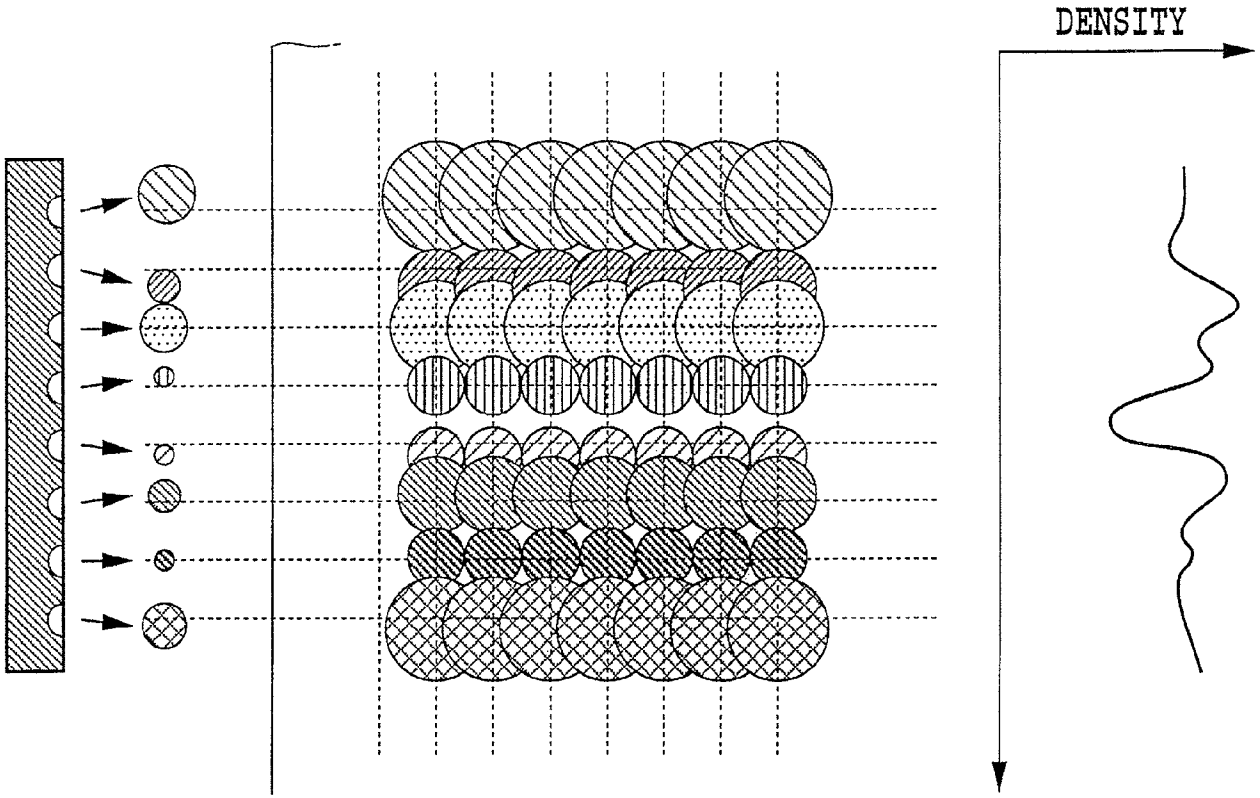
FIGS. 13A to 13C are explanatory diagrams showing a state in which density unevenness occurs during the ink jet printing.

In reality, however, individual nozzles have their own variations and if the printing is done in a manner described above, the ink droplets ejected from individual nozzles vary in size and direction as shown in FIG. 13A, forming ink dots on the paper surface as shown in FIG. 13B. From this figure it is seen that a blank part appears cyclically in the head main scan direction, dots overlap excessively in other parts, or a white line occurs at the central part in the figure. The ink dots printed in this way produce a density distribution in the direction of nozzle arrangement or nozzle column as shown in FIG. 13C, which is perceived as unevenness in density by normal human eye.

To deal with the problem of the unevenness in density, the following method has been proposed.

Figures 14A, 14B, 14C:
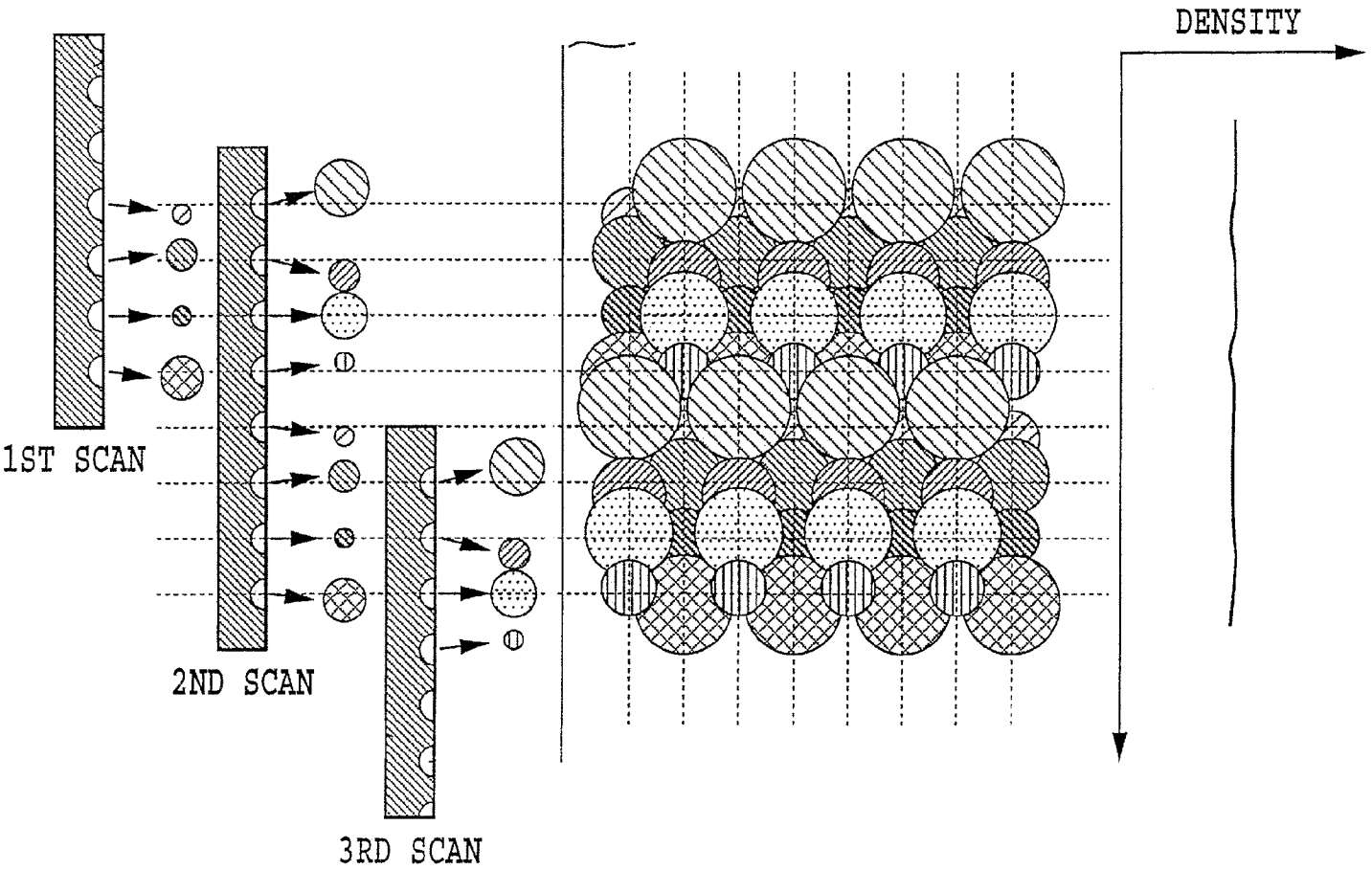
FIGS. 14A to 14C are explanatory diagrams showing a principle of a multi-pass printing for preventing density unevenness explained in FIG. 13.

This method will be explained by referring to FIGS. 14A to 14C. Although the head 3001 is scanned three times as shown in FIG. 14A to complete the print in an area similar to that shown in FIGS. 12A-12C and FIGS. 13A-13C, an area of four pixels, one-half the vertically arranged eight pixels, is completed with two scans (passes). In this case, the eight nozzles of the head 3001 are divided into two halves, the upper four nozzles and the lower four nozzles, and the number of dots formed by one nozzle in one scan is equal to the image data culled to one-half according to a predetermined image data arrangement. During the second scan, dots are embedded at the remaining half of the image data to complete the print in the four-pixel area. This method of printing is called a multi-pass printing method. With this printing method, if a print head similar to the one shown in FIG. 13A is used, the individual nozzle influence on the printed image is halved, so that the printed image will be as shown in FIG. 14B, rendering the white lines or dark lines shown in FIG. 13B less noticeable. Hence, the unevenness in density is significantly improved as shown in FIG. 14C when compared with FIG. 13C.

While the same print area has been described to be completed in two scans, the multi-pass printing improves the image quality as the number of passes increases. This however elongates the print time, which means that there is a trade-off relation between the image quality and the print time. The printer of this embodiment, therefore, has provisions to enable not only a one-pass mode, which does not perform the multi-pass printing, but also multi-pass modes ranging from two passes to eight passes, allowing the user to select a desired print mode according to the kind of print medium and usage.

8. Adjustment of Dot Formation Position

The head H1001 used in the printer of this embodiment has the construction explained in FIG. 11 and can print at the resolution of 1200 DPI, as described above. The actual input data, however, has a maximum resolution of 600 DPI and one data is printed with 2×2=4 pixels. Each input data has five grayscale levels and the dot arrangement for each grayscale level is determined in advance in the 2×2-pixel area so that, during printing, five grayscale levels can be represented in the 2×2-pixel area.

A major point of the invention concerns the adjustment of dot formation positions, i.e., the adjustment of ink droplet landing positions (also referred to as print position adjustment or registration). The printer of this embodiment has a means to perform the landing position adjustment during the forward scan and the backward scan in the bi-directional printing (bi-directional registration) and a means to perform the landing position adjustment on even-numbered rasters formed by even-numbered columns of nozzles in FIG. 11 and on odd-numbered rasters formed by odd-numbered columns of nozzles (O/E registration). The O/E registration depends on the condition of the head, such as head individuality, environment and printing history, while the bi-directional registration depends more on the printer body characteristics, such as the carriage encoder E0004 of the printer body and the distance between the carriage M4001 and a member (platen) restricting the printed surface of the print medium. In this embodiment, therefore, the adjustment value for the O/E registration is stored in a nonvolatile memory such as EEPROM provided at an appropriate location on the head H1001 and the adjustment value for the bi-directional registration is stored at time of shipping in a nonvolatile memory such as EEPROM provided at an appropriate location on the printer body. With these adjustment values provided in this manner, the user can obtain a printed medium on which dot print positions are adjusted at least at the start of the initial use.

The EEPROM of the head H1001 may store various other information characteristic of the head H1001 in addition to the adjustment value for the O/E registration. Although the construction and effect of the EEPROM on the print head H1001 used in this embodiment conform basically to those of the technology disclosed in Japanese Patent Application Laid-Open No. 6-320732 (1994), the content of the stored data in the printing apparatus of this embodiment will be described in detail.

Figures 15, 15A, 15B:
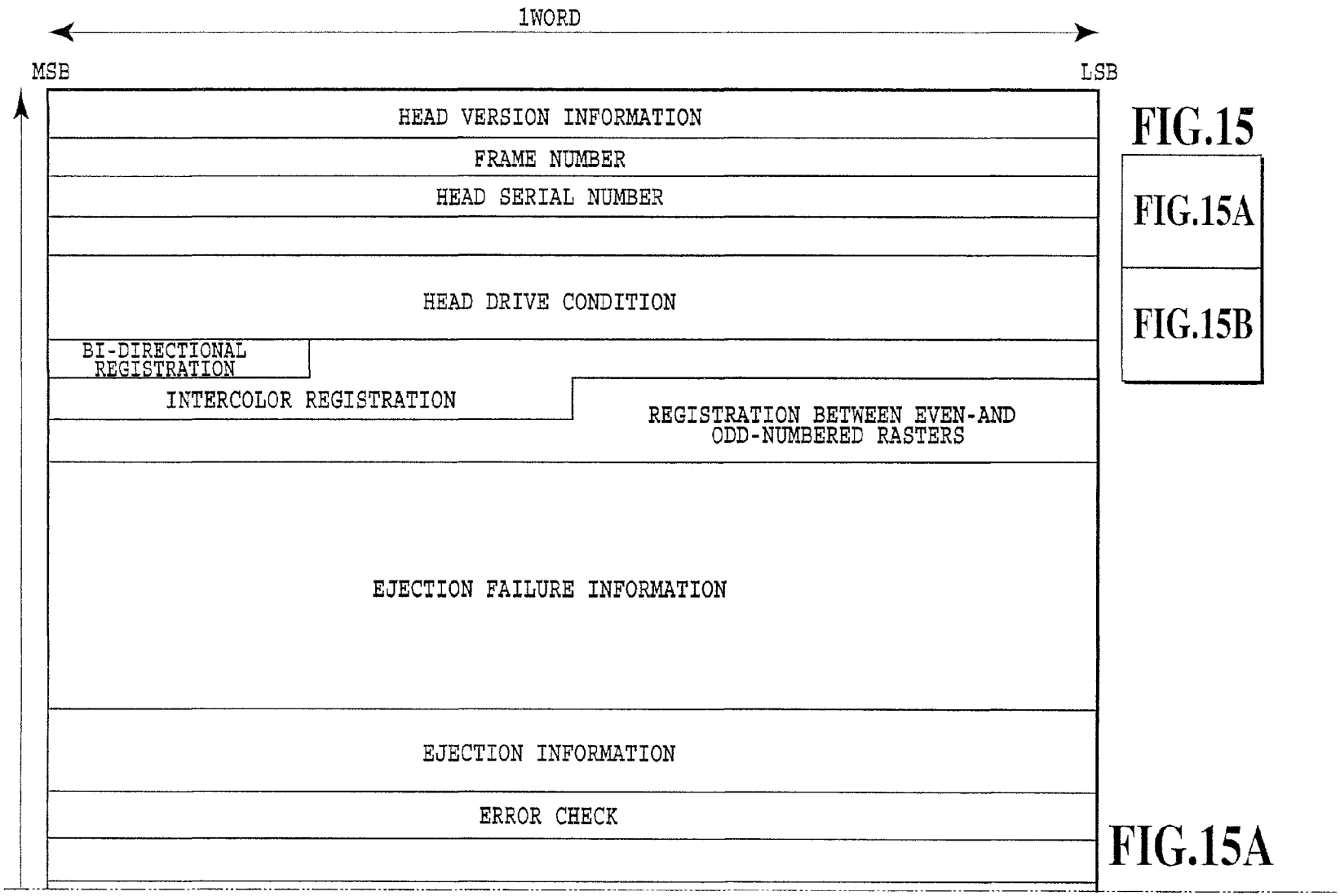
FIG. 15 is a diagram showing the relation between FIGS. 15A and 15B, FIGS. 15A and 15B being diagrams showing an example map of data stored in a non-volatile memory (EEPROM) in the print head.
Figure 15B:
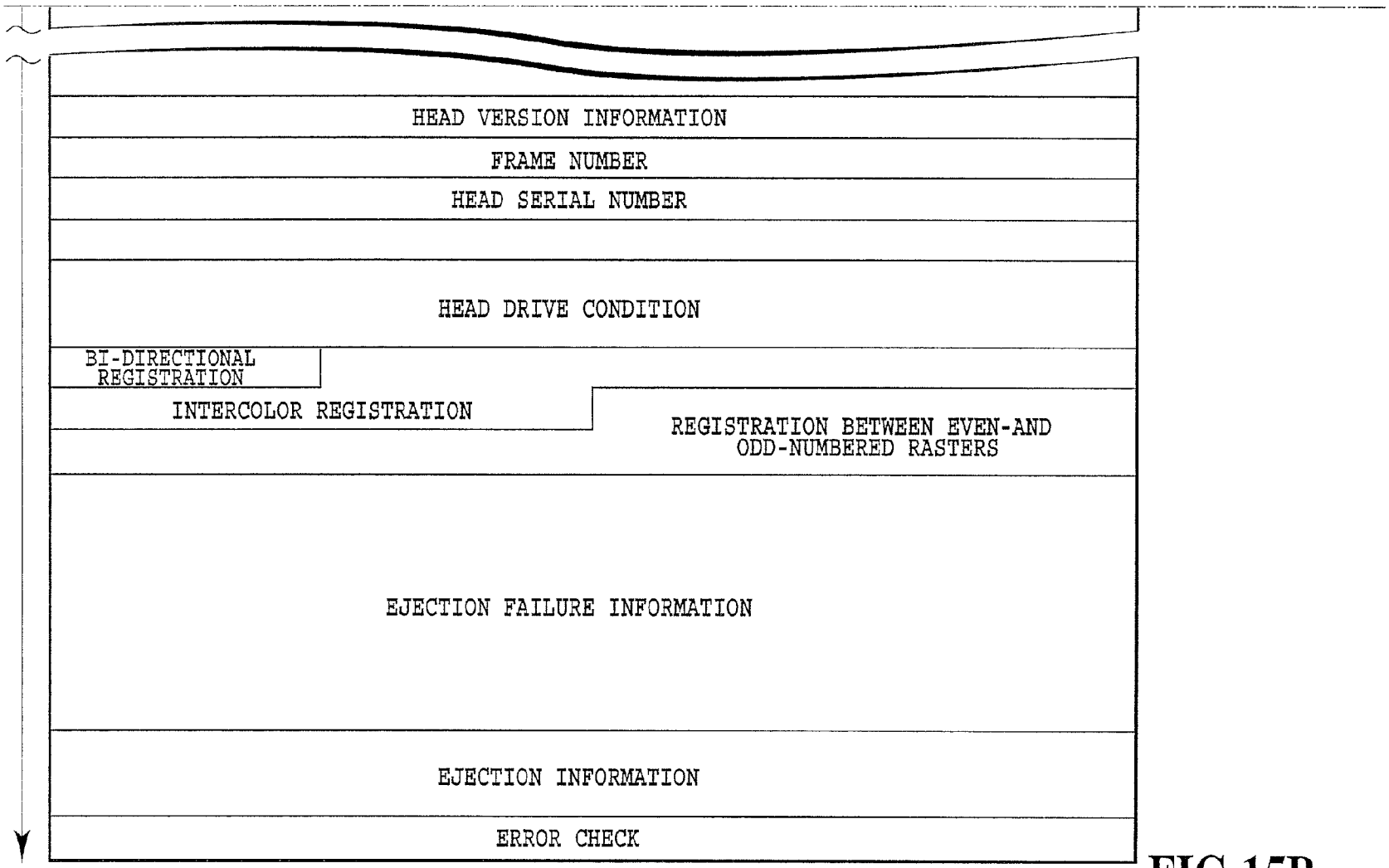

FIG. 15 is a diagram showing the relation between FIGS. 15A and 15B, FIGS. 15A and 15B show an example of data stored in the EEPROM of the head. It is assumed that the following items and contents are stored in the EEPROM. They include "head version information" for updating the drive condition according to a renewed version of the head, "frame number" for preventing erroneous reading of memory content, "head serial number" for identifying an individual head, "head drive conditions" (for three chips) for selecting an appropriate drive pulse for each chip (two colors in each chip) of the print head, "bi-directional registration data" for correcting print position deviations for the forward printing and backward printing (not used in this embodiment), "inter-color registration data" (for five colors) for correcting print position deviations of each color with respect to Bk color, "O/E registration data" (for six colors) for correcting the print position deviations between the odd- and even-numbered nozzle columns of each color, "ejection failure information" (for 12 columns) for representing positions of failed nozzles in each column, "ejection amount information" (for six colors) for representing the amount of ink ejected for each color, and "error check information".

Further, as shown in FIGS. 15A and 15B, the same content is stored twice in the EEPROM to prevent erroneous retrieval of information.

When the user obtains a print head H1001, mounts it on the carriage M4001 of the printer body and turns on power, the control unit of the printer body reads the content of the EEPROM of the head H1001 and copies it to the EEPROM in the printer body. The EEPROM in the printer body has at least two memory locations to store adjustment value for the O/E registration and the bi-directional registration. At first, the same content is stored in these two memory locations.

Upon reception of the printing apparatus or according to the frequency of use, the user may activate the registration processing (hereinafter called a user registration).

Figure 16A:
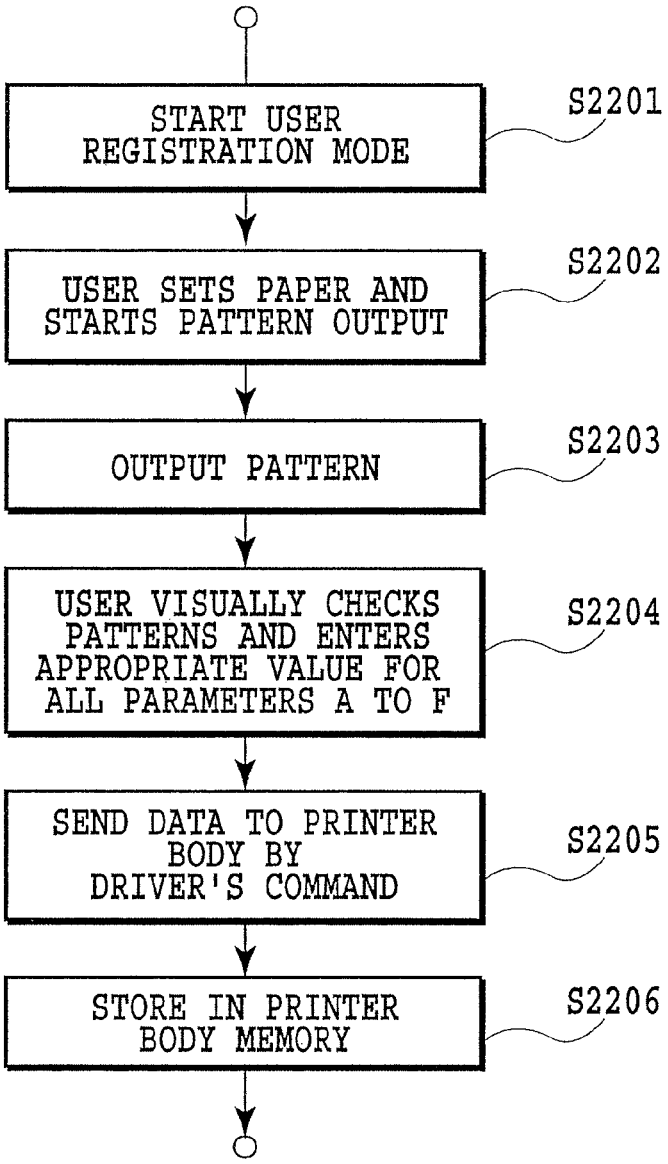
FIG. 16A is a flow chart showing an example sequence of steps for a user registration.
Figure 16B:
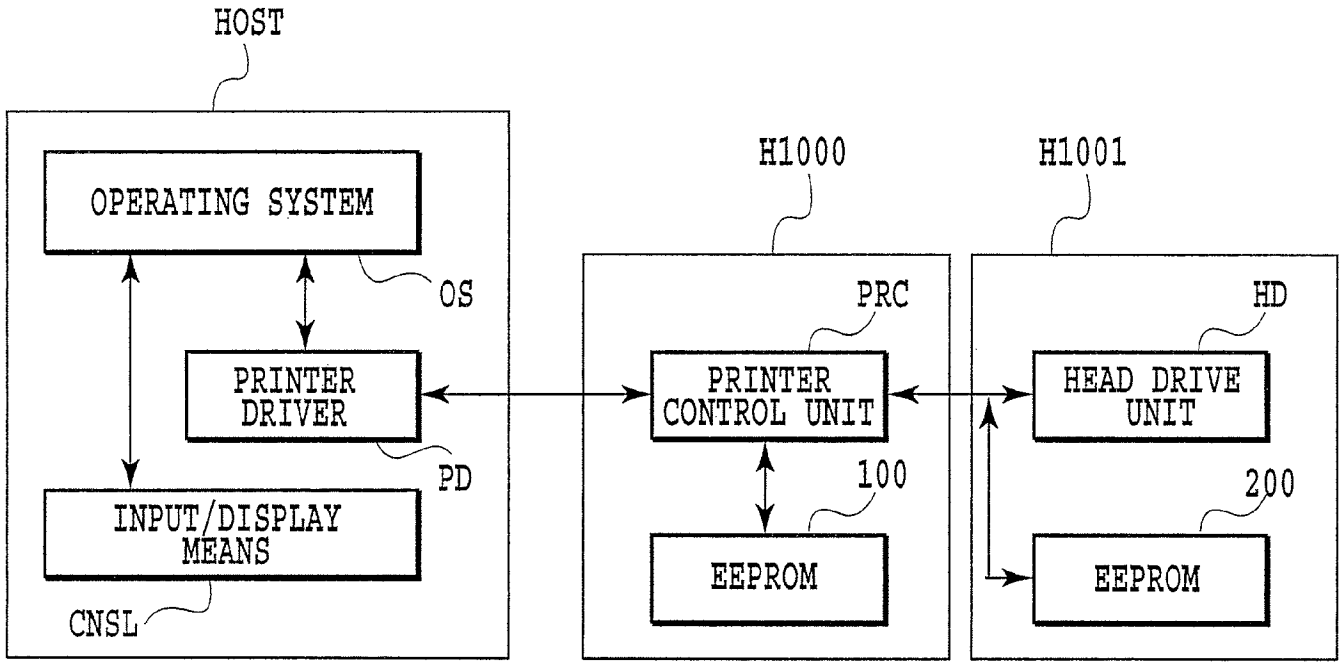
FIG. 16B is a schematic diagram showing a system comprising a host device and a printing apparatus to illustrate mainly a flow of data in the process of FIG. 16A.

FIG. 16A shows a sequence of steps performed by the user registration. FIG. 16B schematically illustrates a system comprising a host device and a printing apparatus to show the data flow during the user registration.

Using a printer driver PD, or a utility program, operating on a predetermined operating system OS of a host device HOST, which may be a personal computer, the user selects a registration mode with an input/display means CNSL including key, pointing device and display (step S2201). Then, the user sets a sheet of paper in the printer body M1000 and starts the printer (step S2202). The printer control unit PRC sends predetermined data to a drive unit HD of the head H1001, which then forms a pattern (FIG. 17) for registration (step S2203). Checking the printed pattern, the user enters an appropriate value into a predetermined area on the printer setting screen of the host device HOST (step S2004). The host device HOST, triggered by a command from the printer driver PD, transfers the registration data to the printer control unit PRC (step S2205). The transferred registration data is stored in the EEPROM 100 in the printer body (step S2206).

Figure 17:
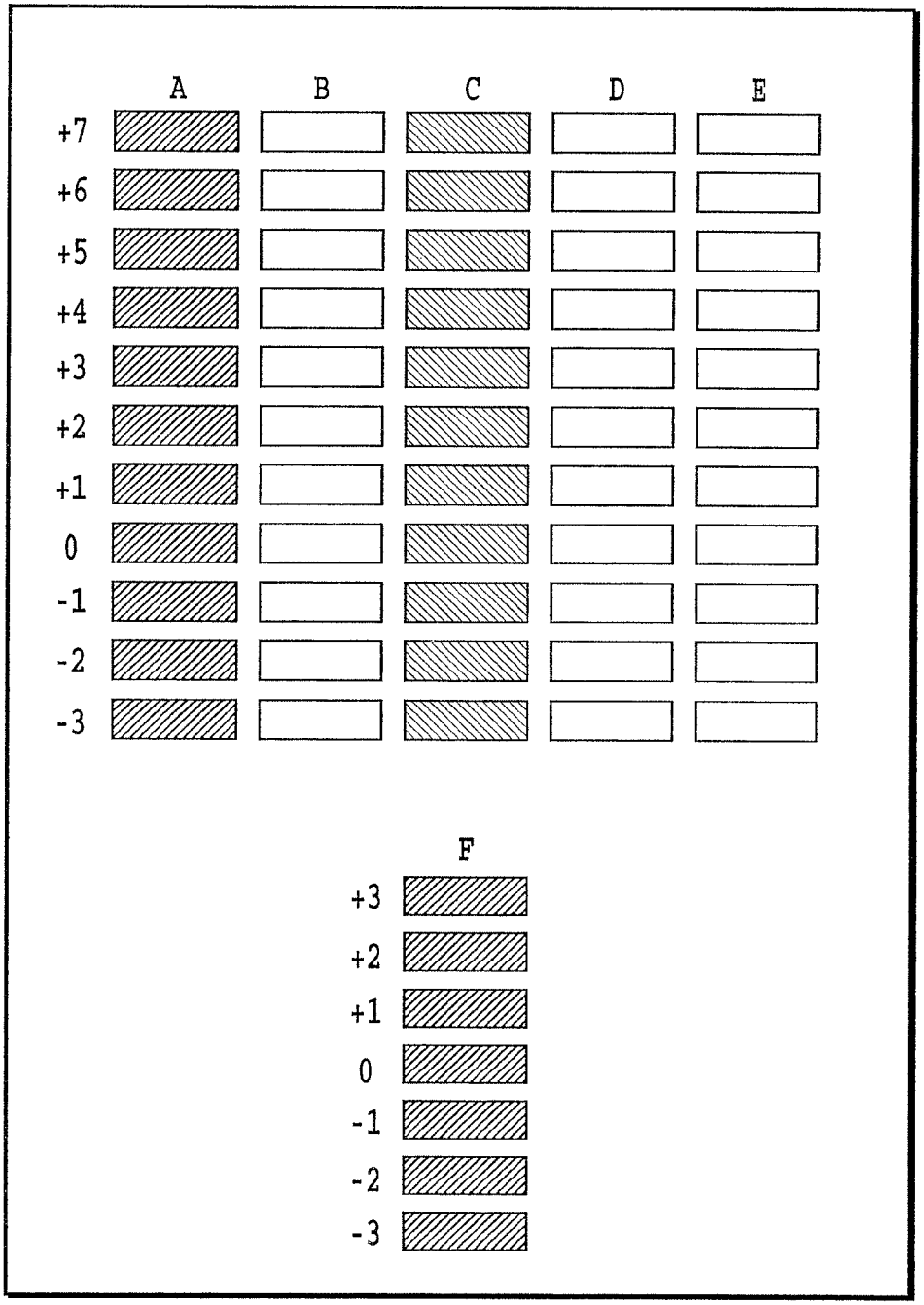
FIG. 17 is an example pattern output during the process of the user registration of FIG. 16A.

FIG. 17 shows patterns output by the user registration. In the figure, columns A to E are patterns for the O/E registration of various colors of the head H1001, with the column A corresponding to black, column B to cyan, column C to magenta, column D to light cyan and column E to light magenta. Yellow is omitted from the user registration patterns because the visual check on a yellow pattern is difficult to make and because the dot position deviations of yellow do not pose so serious a problem as other colors. As described in FIG. 11, the nozzles for yellow are formed in the same chip in which nozzles for magenta are formed and therefore the drive condition for yellow nozzles is similar to that for the magenta nozzles. In this embodiment, therefore, at step S2205 in FIG. 16A the same values as the registration data for magenta are transferred to the printer body. Hence, the data stored in the EEPROM 100 at step S2206 covers six colors.

The numbers "+7" to "−3" on the left side of FIG. 17 represent the adjustment values for registration and the patterns with these adjustment values are the same. The patterns with these adjustment values, however, are printed by differentiating the relative ejection timings between the even-numbered nozzle column and the odd-numbered nozzle column. In the printer of this embodiment, the minimum unit for adjustment is one pixel and the ejection timing is changed in increments of one pixel. The adjustment value for the O/E registration is stored in the EEPROM 200 (FIG. 16B) at time of shipment, and the patterns at the "0" position (default value) are printed with the adjustment value that was set at time of shipment from factory.

As for other adjustment values "+7" to "+1" and "−1" to "−3", the ejection timing of the odd-numbered nozzle columns is changed from the default value to +7 pixels and to −3 pixels in increments of one pixel, with the ejection timing of the even-numbered nozzle columns fixed. The + direction is for increasing the ejection timing time difference between the even-numbered nozzle column and the odd-numbered nozzle column. As already mentioned, as the face of the head between the even-numbered nozzle column and the odd-numbered nozzle column is bulged by ink swelling or temperature rise, the two columns tend to widen with elapse of time. Thus, the adjustment range in the plus direction is set large, up to 7 pixels (about 147 μm), and the minus direction is set up to −3 pixels (63 μm). The user can choose the most smooth pattern from among the range "+7" to "−3".

All patterns for the O/E registration are printed by two-pass one-way printing (two forward or backward scans). The reason that the two-pass divided printing is used instead of one-pass printing is to ensure that the pattern smoothness is not impaired by factors other than the dot formation position deviations between the even- and odd-numbered columns, such as the individual nozzle variations. The reason that the one-way printing is performed is to ensure that the print is not affected by the dot formation position deviations between the forward and backward scans.

Figure 18C:
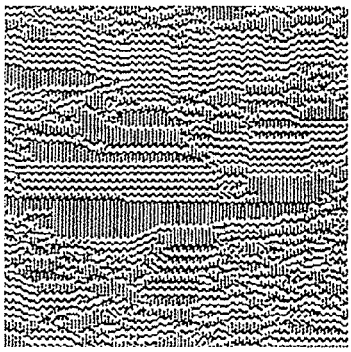
FIGS. 18A to 18C are enlarged views of those patterns in FIG. 17 which are used for even-odd registration, with FIG. 18A representing a state in which ink dots from the even-numbered nozzles and ink dots from the odd-numbered nozzles are printed at the correct positions, FIG. 18B representing a state in which the ink dots from both of the even- and odd-numbered nozzles are shifted one pixel, and FIG. 18C representing a state in which they are shifted two pixels.
Figure 18B:
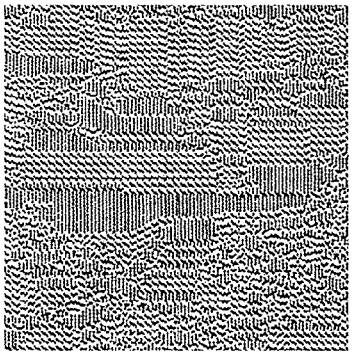
Figure 18A:
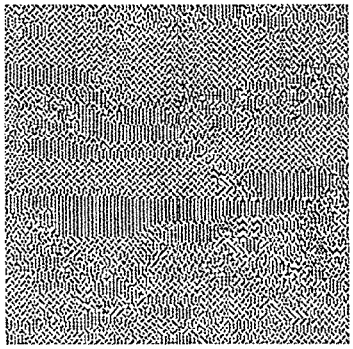

FIGS. 18A to 18C are enlarged views of the O/E registration patterns used in this embodiment. These are extracted from certain areas of the patterns that were printed by giving 25% of data to the 1200 DPI pixels, digitizing and printing the data. The digitizing method used is an error diffusion method, one method of dithering. Because the input resolution of the printer of this embodiment is 600 DPI at maximum, as already described, the printing with an input resolution of 1200 DPI is not actually performed but this test pattern is only for registration. The patterns themselves are stored in the memory of the printer body as bit maps of a predetermined size and are read and printed when the user registration is carried out. Of the patterns studied by the inventors, those that are digitized by a method belonging to the conditional decision making method, such as error diffusion method in dithering, or which have blue noise characteristics with the spatial frequency mainly shifted toward a high frequency side, are most desirable. "Desirable" means that a state in which the dot formation position deviations occur and a state in which they do not are easily distinguishable by visual check. FIG. 18A represents a state in which ink dots from the even-numbered nozzles and ink dots from the odd-numbered nozzles are printed at normal positions. FIG. 18B, on the other hand, represents a state in which both even-and odd-numbered dots are deviated by one pixel, and FIG. 18C represents a state in which they are deviated by two pixels. These differences are clearly distinguishable.

Applying this method to a random dithering method or an ordered dithering method using a matrix does not produce the effect described above. In the random dithering method, because the spatial frequency of the original pattern is distributed uniformly from low frequency to high frequency, deviations between the even-numbered rasters and the odd-numbered rasters do not result in a change in the spatial frequency distribution in the pattern. In the matrix-based ordered dithering, because the original image is completely cyclic, any deviation will cause a change in the spatial frequency of the pattern. However, because the entire pattern also changes similarly, regular alternations of dark and light parts rather than non-uniformity show. Such a pattern does not give a definite granular impression as in FIGS. 18B and 18C. The main point of this embodiment takes advantage of the fact that the uniform patterns digitized by using the conditional decision making method such as error diffusion method and the patterns with blue noise characteristics have spatial frequencies significantly sensitive to the dot formation position deviations. Because such patterns are characterized in that their spatial frequencies, though not uniform as in the ordered dithering method, lie as a whole in a high frequency range, even a slight deviation between a layer of the even-numbered rasters and a layer of the odd-numbered rasters will result in an entirely different spatial frequency of the image as a whole. The blue noise characteristic described above is quoted from "Digital Halftoning" by Robert Ulichney.

Referring again to FIG. 17, the column F is a pattern for bi-directional registration. A number of proposals for the bi-directional registration have been put forward and implemented as described above. The pattern of column F in this embodiment conforms to Japanese Patent Application Laid-Open No. 7-81190 (1995). This pattern allows easier visual check than that based on a line pattern, which is currently in a wider use, and makes it possible to detect a deviation of 1 pixel or smaller. The numbers at the left of the patterns "+3" to "−3" represent adjustment values for the bi-directional registration. In the bi-directional registration, the pattern at the "0" value (default value) is printed with the adjustment value that was set at time of shipment from factory, as in the O/E registration. The patterns corresponding to the adjustment values "+3" to "−3" are printed by shifting the ejection timing in increments of one pixel during the backward printing while fixing the ejection timing during the forward printing. All bi-directional registration patterns are printed by four-pass bi-directional printing. The reason for the use of the four-pass divided printing is to ensure that the smoothness of the pattern is not impaired as by variations of individual nozzles.

Figure 19A:
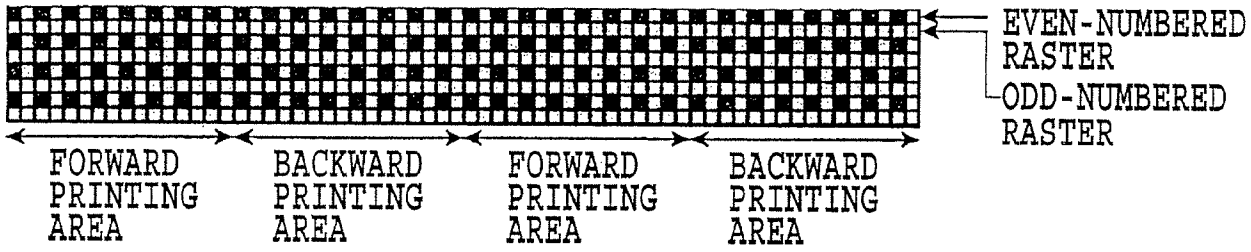
FIGS. 19A and 19B are explanatory diagrams showing enlarged those patterns in FIG. 17 which are used for bi-directional registration and explaining about the printing method, with FIG. 19A representing a state in which ink dots formed by the forward scan and ink dots formed by the backward scan are printed at correct positions, and with FIG. 19B representing a state in which the ink dots formed by both the forward and backward scans deviate.
Figure 19B:
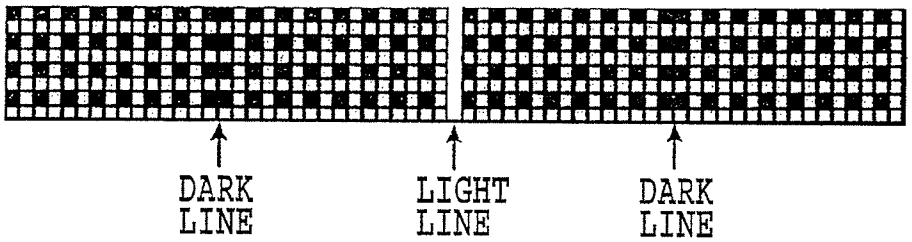

FIGS. 19A and 19B are enlarged views of the bi-directional registration patterns and show how they are printed. A series of adjustments in this embodiment also performs the O/E registration at the same time. To prevent the dot formation position deviations between the even-and odd-numbered columns from affecting the pattern, the print data only exists in the even-numbered rasters. The even-numbered rasters are printed every other dot and this is a limit pixel pitch (distance) at which the overlapping between the adjoining dots does not occur. With this setting, it is possible to make the printed image to react sensitively to a small dot formation position deviation.

In this embodiment, one raster of image is completed by four print scans. The first pass and third pass are printed by the forward scans while the second and fourth passes are printed by the backward scans. A 16-pixel forward printing area and a 16-pixel backward printing area are alternated as shown, with each area printed in two divided passes, first pass and third pass (or second pass and fourth pass).

When a bi-directional dot position deviation occurs, a black or white line appears at a boundary between the forward print area and the backward print area as shown in FIG. 19B. The width of each print area is about 336 μm and these vertical black or white lines 336 μm long are actually perceived by human eye as gray scale variations appearing at regular intervals in the lateral directions. The user can choose a uniform pattern with the fewest white lines.

The user then enters the adjustment value matching the selected pattern through the printer driver of the host device. The value thus entered is stored in the EEPROM 100 of the printer body.

Figure 20:
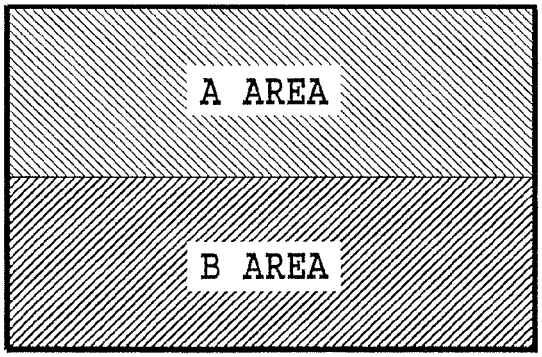
FIG. 20 is a diagram showing a map of storage area of EEPROM provided in the printing apparatus in which to store a registration value.

FIG. 20 schematically shows a simplified adjustment value write area in the EEPROM 100 in the printer body. The adjustment value for registration stored at time of shipment and the data read from the EEPROM 200 of the print head H1001 when the head is mounted are always stored in an area A. Then, when the user registration is to be carried out, the value in the area A is set as default (0) and patterns (FIG. 17) are output. The adjustment value entered by the user through the printer driver is stored in the area B. In the second or subsequent user registration the data in the area B is written over and the value stored in the area A is not changed. The value in the area A is only updated when the head is replaced or serviced. During the normal printing, the printing operation is performed by using an adjustment value obtained by adding the value of area B to the value of area A.

9. Correction of Registration Value according to Mode

The printer used in this embodiment outputs photographic images with high quality and allows the user to select between two carriage speeds according to usage: a mode in which the scan is performed at a carriage speed corresponding to the high image quality output (HQ mode) and a mode in which the scan is performed at a carriage speed about two times faster (HS mode).

This printing apparatus of this embodiment has a mechanism that enables adjustment in two steps of the distance from the platen to the carriage M4001 (referred to as a gap) to deal with such print media as thick sheets and envelopes. The gap can be set either to a standard position for normal printing or to a thick sheet position for printing thick sheets. The gap is adjusted by the user operating a gap adjust lever M2015 (FIG. 1). There is a gap sensor E0008 to check whether the present gap is in the thick sheet position or the standard position. Hence, the printer body can perform the print control according to the present gap position.

The gap adjust mechanism will be briefly explained. A sliding shaft of the carriage M4001 is mounted, under a force of an urging member such as spring, to a pair of gap adjust plates through a gap adjust lever 2015 at one end thereof and through a cam member at the other end. These gap adjust plates are adjustably fixed to the chassis of the printing apparatus so that the distance between the ejection surface of the print head cartridge H1000 and the print medium support surface of the platen can be set to an appropriate one.

Further, the gap adjust lever 2015 can be selectively set in two stop positions, an upper end position shown in FIG. 1 and a lower end position not shown, through the action of a spring. When it is moved to the lower end position, the carriage M4001 is retracted about 0.6 mm from the platen. Hence, when the print medium is thick, like an envelope, the gap adjust lever 2015 can be moved to the lower end position in advance. Further, the gap sensor detects the state of the gap adjust lever 2015. When the print medium feeding operation starts, it is checked whether the gap adjust lever 2015 is set in an appropriate position. When the lever position is found to be inappropriate, a warning message or buzzer is issued to alert the operator, preventing the printing operation from being executed under inappropriate condition.

In the O/E registration and in the bi-directional registration, the appropriate adjustment value also changes according to the carriage speed and the gap. This embodiment has a mechanism that automatically carries out the registration according to this information.

FIGS. 21A-21D show examples of automatic correction tables used for the bi-directional registration. In the printer of this embodiment, the carriage speed is 20.83 inches/m in the HS mode and 12.5 inches/m in the HQ mode, and the speed at which ink is ejected from the nozzles of the head is 15 m/s in standard. The distance from the head face to the paper surface is 1.3 mm for the standard position and 1.9 mm for the thick sheet position. Suppose the printer is set in the HQ mode and in the standard gap position. If the ink is ejected at exactly the same position in the forward scan and in the backward scan, the distance between a dot printed in the forward scan and a dot printed in the backward scan is about 55 μm. Because the resolution of the printer of this embodiment can be adjusted in units of one pixel (21 μm), an adjustment of three pixels is required at default setting. In the HS mode, on the other hand, the deviation between the two dots is 92 μm, which requires adjustment of four pixels. When only the gap is set to the thick sheet position with the carriage speed remaining in the HQ mode, the deviation is 80 μm, which requires a four-pixel adjustment. When the HS mode and the thick sheet position are set, the deviation is 134 μm, which requires correction of six pixels. From these results a table shown in FIG. 21A is generated.

In this embodiment, the actual printing is done according to the value shown in the table of FIG. 21 by adding the value entered during the user registration to the registration adjustment value adopted at time of shipment from factory.

The above tables may not be determined only by calculations. For example. the adjustment value for a bi-directional printing that attempts to produce a uniform image with multiple passes may be slightly different from the adjustment value for a bi-directional printing that aims to produce a good ruled line with one pass. A possible explanation for this may be that in the multi-pass printing the nozzles in the nozzle column are selected in a scattered manner and driven, causing only a small temperature rise, while in the one-pass printing the number of nozzles driven simultaneously is large, causing a large temperature rise. An appropriate adjustment value needs to be set depending on what purpose the HS mode, HQ mode, standard position and thick sheet position are used for. Suppose, for example, an appropriate adjustment value used when ruled lines are printed in one pass is larger by "1" than the appropriate adjustment value used when a uniform halftone is printed in multiple passes. In this case, if only the one-pass monochromatic printing is performed in the HS mode, the registration for the HS mode should place an emphasis on the ruled line pattern. That is, a value larger by "1" may be written in advance into the table of FIG. 21A only in the HS mode column, as shown in FIG. 21B.

Further, the adjustment value for the bi-directional registration also changes slightly due to variations in the ejection speed of the print head. The ejection speed of the head used in this embodiment is 15 m/s at the center but actually it varies in a range of 12-18 m/s.

Figure 22:
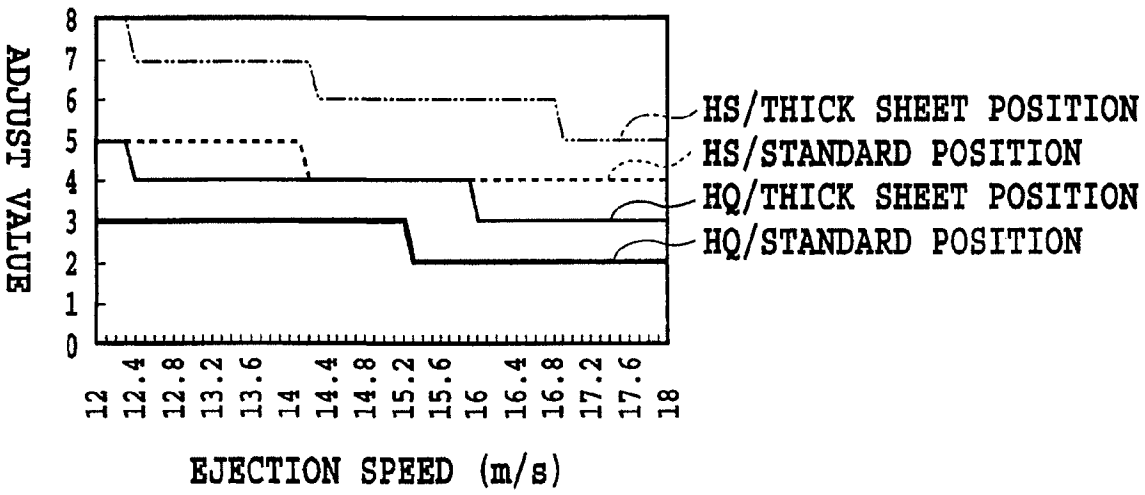
FIG. 22 is a diagram showing changes in the value of registration table according to variations of ink ejection speed of the head.

FIG. 22 shows changes in the appropriate registration table value with respect to the ejection speed for each carriage speed (HS mode, HQ mode) and gap position (standard position, thick sheet position). The table values as a whole decrease toward right, i.e., as the ejection speed increases, the correction value decreases. When the printer is set in the standard position and in the HQ mode, the adjustment can be made by the user registration, whatever ejection speed the mounted head has.

In other modes if their adjustment value differences from the normal mode do not change from those at the ejection speed of 15 m/s, the automatic adjustment can be done according to the automatic adjustment table of FIG. 21A without a problem. If the adjustment value difference changes, however, the automatic adjustment will not work. For example, for the standard position and HS mode, the appropriate adjustment value for an ejection speed of close to 15 m/s is "4" and the difference from the adjustment value of the standard position and HQ mode is "1", whereas in an ejection speed range slightly higher than 15 m/s, the adjustment value difference is "2". Although this automatic correction table is effective for a head with the ejection speed near the center value, it does not work for heads with ejection speeds away from the center value. If most of the heads actually shipped have ejection speeds near 15 m/s, the use of the table of FIG. 21A may be appropriate. Depending on the distribution of the ejection speed, the adjustment value may be set to "5" in advance as shown in FIG. 21C to be better able to deal with a large number of heads. Further, considering the adjustment value difference from that of the ruled lines explained in FIG. 21B, the values as shown in FIG. 21D may be stored.

In this case the problem can be solved by storing ejection speed information in the EEPROM 200 of the head H1001 and storing automatic correction tables corresponding to a plurality of speeds in the printer body. That is, in the above example the automatic correction table has two factors, carriage speed and gap position. One more factor, the ejection speed, is added. The automatic correction table in this case is shown in FIG. 23 which conforms to the graph of FIG. 22.

A phenomenon is confirmed in which, depending on the initial state of individual heads, as the temperature of the head rises after a series of printing operations, the ejection speed also increases. Hence, when the head temperature increases during printing, the appropriate registration value also changes. Conversely, when the temperature returns to normal after printing, the appropriate registration value also returns to the original value. This change, however, cannot be dealt with by only the user registration. In that case, if a correlation between the head temperature and the ejection speed is taken, the registration can be executed in real time according to the initial ejection speed, present registration adjustment value and the head temperature at each moment.

Further, if the ejection speed table of FIG. 23 is divided according to the measured temperature, the real time correction can be made for a plurality of carriage speeds and gaps.

More concrete construction and processing to cope with these matters are described later.

While in this embodiment an example case of using the registration unit of one pixel has been described, other registration units may be adopted. Adjustments in units of half-pixel or smaller can be made distinguishable by using the adjustment patterns of FIGS. 18 and 19. The more precise the adjustment value, the higher the image quality in the printing can be expected to become. The print timing in this case may be linked with timings owned by the printer body for other purposes, such as a timing that is set for the divided block driving of the head.

Mainly the automatic correction table for the bi-directional registration has been described. This invention is not limited to this embodiment. In the O/E registration, too, a change in the gap, carriage speed and ejection speed will result in a change in the appropriate adjustment value, so using the automatic correction table also for the O/E registration is advantageous.

It is difficult for the user to decide the proper timing for executing the registration after the printer has been received. It is desired that the correction be made before the image quality is degraded by repetitive printing operations. This embodiment allows the user to check the current adjustment state by using the head check pattern of the printer driver utility so that the user can recognize the need for the registration before the image deteriorates.

Figure 24:
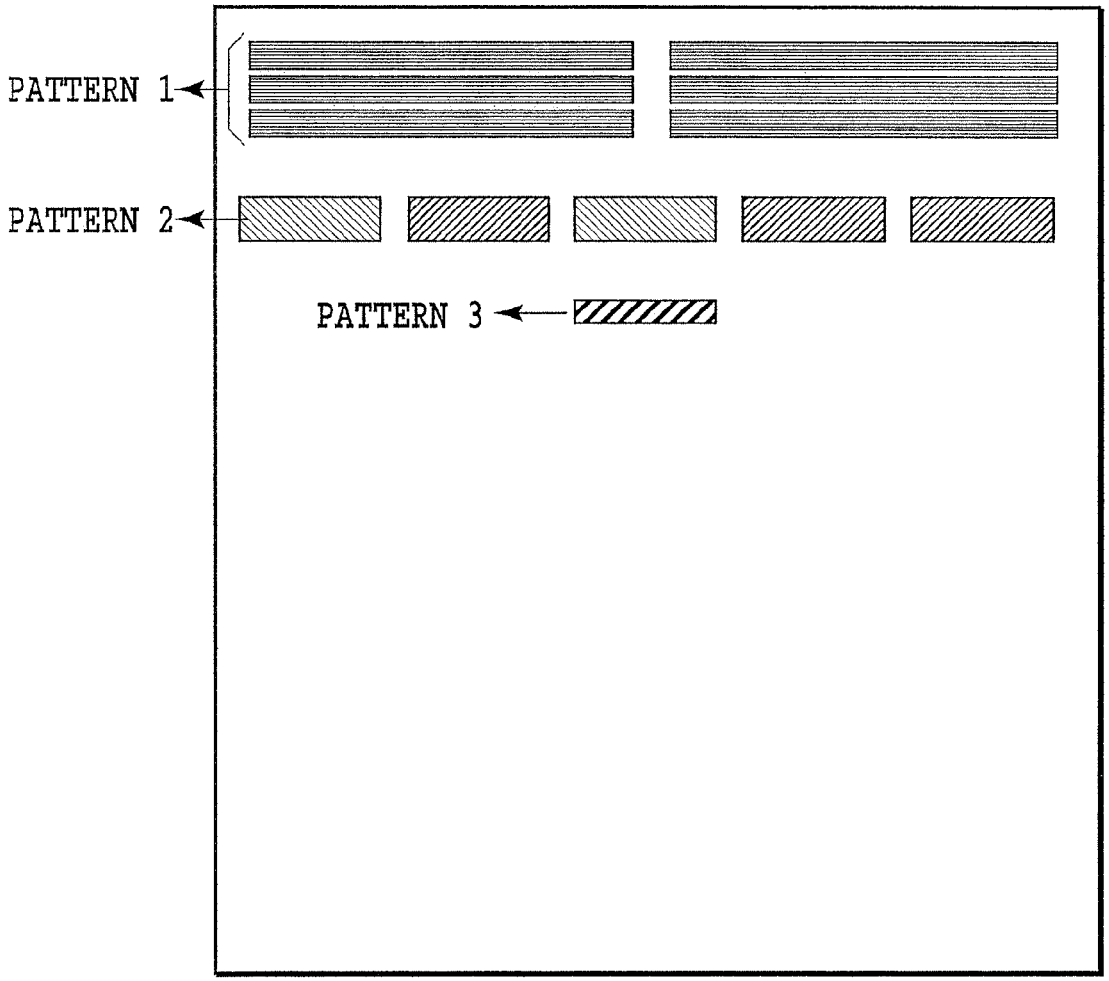
FIG. 24 is an example of head check pattern used to check for the necessity of registration.

FIG. 24 shows one example of the head check pattern. "Pattern 1" is printed in one pass using all the nozzles of all six colors. With this pattern it is possible to check whether all the nozzles eject ink normally. "Pattern 2" is obtained by printing the O/E registration pattern explained in FIG. 18 in two passes in one direction using the user registration adjustment value currently set. This pattern allows the user to check whether the O/E registration adjustment value currently set is appropriate or not. "Pattern 3" is obtained by printing the bi-directional registration pattern explained in FIG. 19 in four passes in both directions using the user registration adjustment value currently set. This pattern allows the user to check whether the currently set bi-directional registration adjustment value is appropriate or not.

This check pattern can be output in a shorter time than all the patterns of FIG. 17 and the operation is simple, so that the user can check the state of the head H1001 as frequently as he wishes.

In the above embodiment, only yellow is excluded from the pattern because its check is not easy, and the actually output patterns cover five colors, Bk, C, M, LC and LM. Depending on the dye density of LC and LM, these ink colors may also be difficult to check. In that case, the user registration is performed only on Bk, C and M. For LC and LM, the same values as those of the colors which are on the same chip as LC and LM can be used. That is, at the step S2205 of FIG. 16A, the value of BK and the value of C need to be entered from the printer driver into the printer body as the values of the color LC and color LM, respectively.

As described above, this embodiment is provided with a mechanism that enables the registration of even- and odd-numbered nozzles and the bi-directional registration to be initiated by the user as required and to be adjusted with high precision by using the high resolution print head formed with two nozzle columns for each color as shown in FIG. 11. This mechanism makes it possible to maintain high image quality at all times after the printing apparatus has been received.

10. Second Embodiment

Next, a second embodiment of the present invention will be described. This embodiment concerns a registration mechanism used when a bi-directional printing is performed by the interlace printing described in the Related Art.

Figure 29:
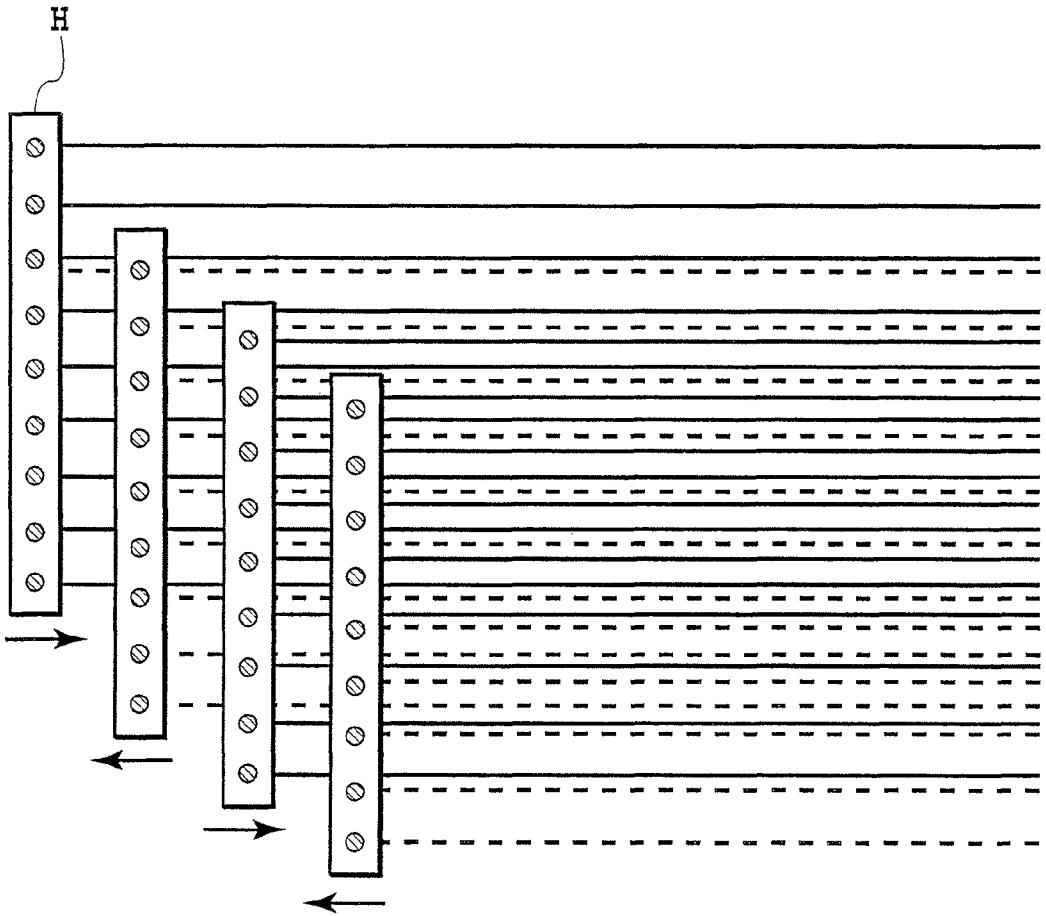
FIG. 29 is a schematic diagram for explaining an interlace printing method adopted in still another embodiment of the present invention.

As described by referring to FIG. 29, in the interlaced bi-directional printing, a dot formation position deviation between the forward and backward scans will result in a trouble similar to that caused by the dot position deviation between the even-numbered nozzle column and the odd-numbered nozzle column in the first embodiment.

Hence, in this embodiment, the pattern of FIG. 18, which has been shown to be used for the O/E registration in the first embodiment, is applied as the bi-directional registration pattern. Printing only the black, which is most easily distinguishable, will be enough because the pattern is used for the bi-directional registration.

When a bi-directional dot formation position deviation occurs, the patterns look similar to FIGS. 18B and 18C. The pattern printing may be carried out in the similar manner as during the actual printing, but a single raster is not divided into opposite scans. With this arrangement, it is possible to print the registration patterns under the condition where the troubles of the actual printed image occur. Therefore, the reliability of the real print after adjustment can be enhanced.

A method of using normal dither patterns as bi-directional registration patterns, though not limited to the interlaced printing, has already been disclosed in Japanese Patent Application Laid-Open No. 11-48587 (1999). According to this method, as the specification reads, "a normal dither pattern, with dots regularly arranged in the main scan and sub-scan directions, can be perceived as being uniform without a gray scale variation when the print timing is appropriate. When the print timing is deviated, the dot intervals vary causing gray scale variations." To be sure, the normal dither (an ordered dither using a matrix) has the original image arranged completely cyclically, so that any timing deviation will cause a change in the spatial frequency in the pattern. However, because the pattern as a whole also changes in the similar manner, this change is perceived as an overall density reduction or a regular repetition of dark and light parts, rather than nonuniformity. Further, because the cycle frequency of the dither pattern is significantly high, the change is often difficult to detect visually. The pattern of FIG. 18 used in this embodiment, on the other hand, is a uniform pattern that is digitized by using the conditional decision making method, such as error diffusion method. This pattern has a blue noise characteristic and is characterized in that the spatial frequency is substantially sensitive to a registration deviation between rasters. Therefore, because the spatial frequency, though not uniform as in the ordered dither method, lies as a whole in a high frequency region, even a slight deviation between a layer of the even-numbered rasters and a layer of the odd-numbered rasters will result in an entire different spatial frequency distribution, giving a granular impression.

With the provision of a mechanism that allows an inter-raster registration to be initiated by the user as required and to be adjusted highly precisely while performing the bi-directional interlaced printing, this embodiment makes it possible to maintain a high image quality at all times after the printing apparatus has been received.

While this embodiment feeds the paper a constant distance of nine pixels, this embodiment is not limited to this arrangement. As shown in FIG. 29, this embodiment can be applied to any interlaced construction that completes an image having pitches finer than the nozzle arrangement pitches by performing a plurality of scans. For each combination of gap, carriage speed and ejection speed, this embodiment like the first embodiment can also prepare automatic correction tables of values adjusted by the method described above.

11. Third Embodiment

Next, a third embodiment will be described. Here, we will describe a case where a plurality of nozzle columns with a low resolution are arranged on a print head.

Figure 25:
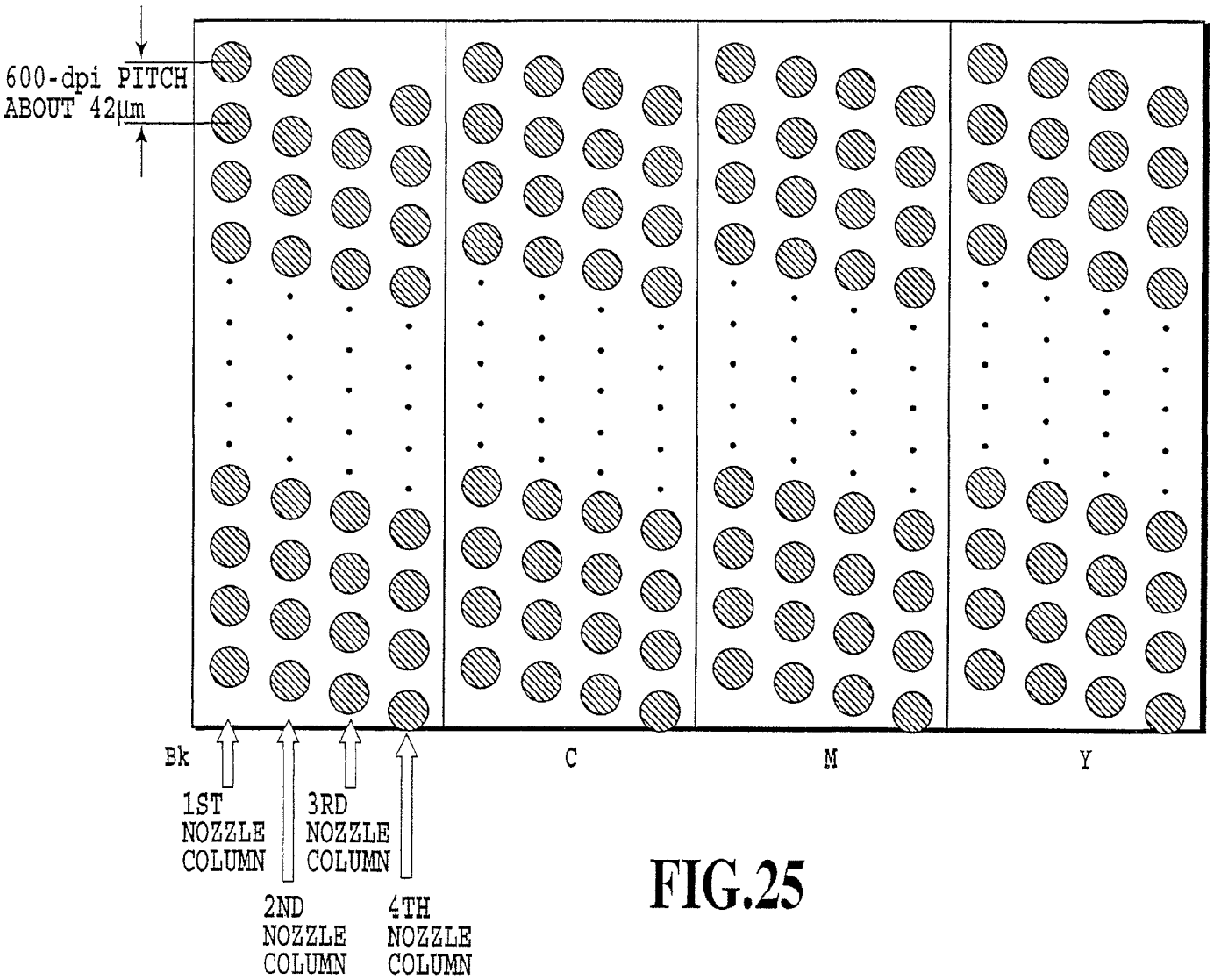
FIG. 25 is an example of nozzle arrangement on the print head used in another embodiment of the present invention.
Figure 26A:
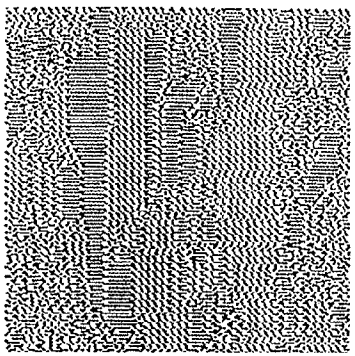
FIGS. 26A to 26D are enlarged views of patterns for registration formed by using the head of FIG. 25.
Figure 26B:
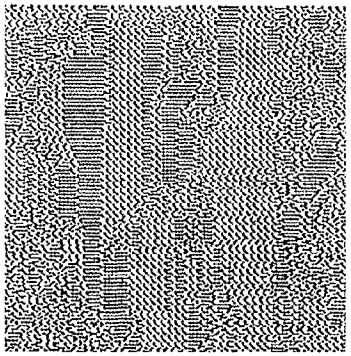
Figure 26C:
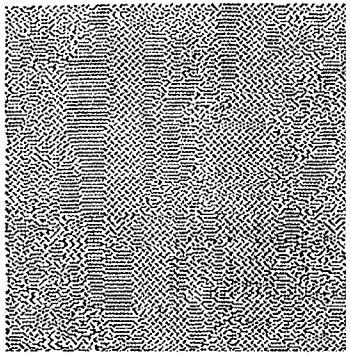
Figure 26D:
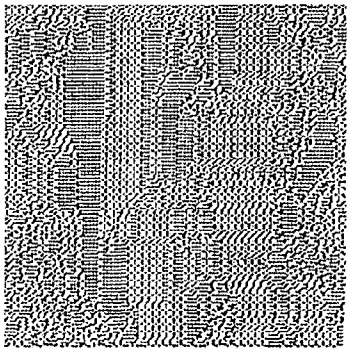
Figure 27:
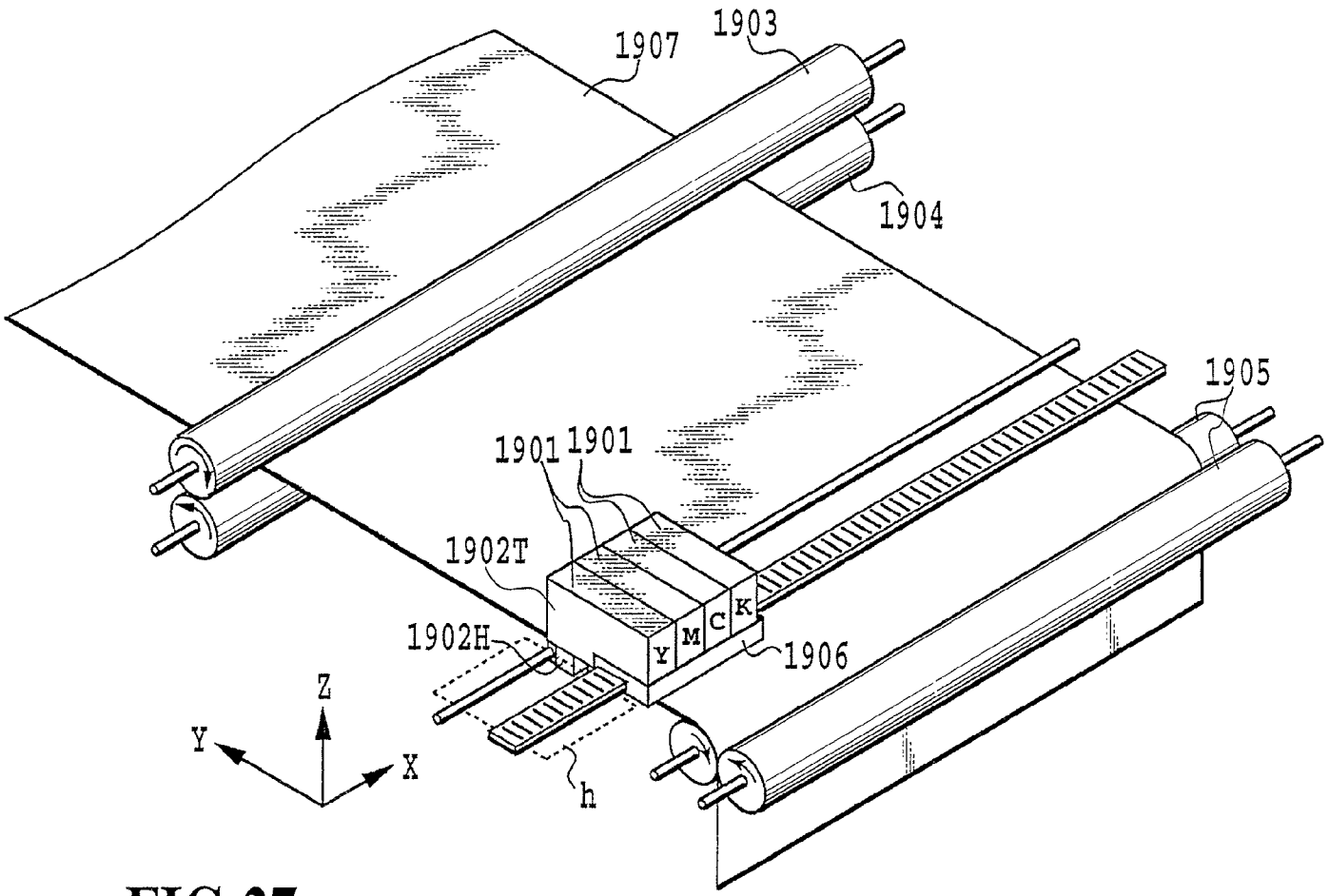
FIG. 27 is a perspective view showing simplified serial type color printer.
Figure 28A:
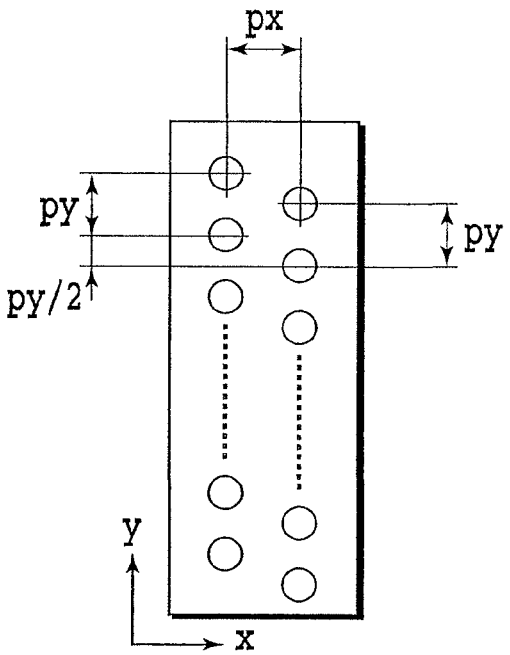
FIGS. 28A and 28B are a diagram showing an example of nozzle arrangement on the print head to realize a high resolution and a diagram showing a problem in realizing the high resolution, respectively.
Figure 28B:
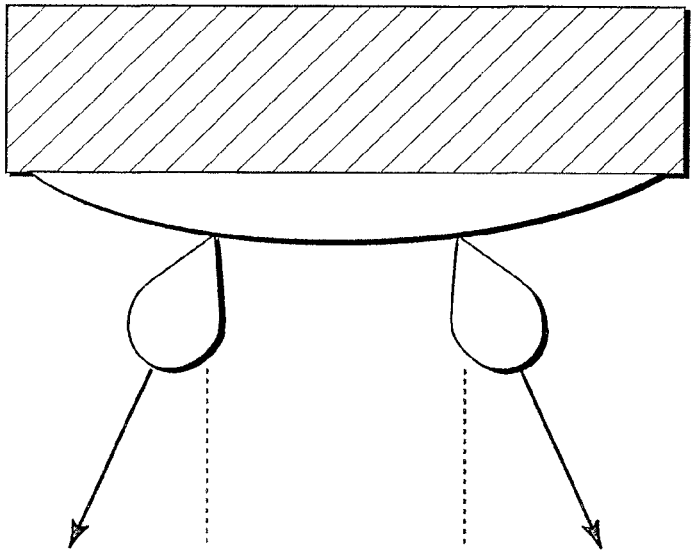

FIG. 25 shows a multi-nozzle construction used in this embodiment. Here, four columns of 128 nozzles with 600 DPI (about 42-μm pitch) are shifted about 10.5 μm from each other (512 nozzles in all) to achieve a resolution of 2400 DPI for one color. Four groups of four nozzle columns each, i.e., 16 nozzle columns in total, are integrally arranged side by side as shown to realize a four-color printing with 2400 DPI.

In this embodiment, too, image impairment due to ink landing position deviations among the nozzle columns is conceivable as in the first embodiment. It should be noted, however, that this embodiment requires not only an adjustment between even- and odd-numbered columns, but also adjustment for each of first column (nozzle column associated with the printing of first raster to (4n+1)th raster) to fourth column (nozzle column associated with the printing of fourth raster to (4n+4)th raster). This embodiment also uses a pattern similar to the first embodiment as the user registration pattern. Because the resolution is 2400 DPI, the image is obtained by giving 25% of data to the pixels corresponding to this resolution.

FIG. 26 shows printed states of a pattern when the dot formation positions are deviated. FIG. 26A shows a printed state when all the ink droplets ejected from the four nozzle columns have landed on the correct positions. FIG. 26B show a printed state when only a second raster printed by the second column is deviated one pixel from other rasters. FIG. 26C shows a printed state when only the second raster is deviated two pixels. FIG. 26D shows a printed state when the second raster is deviated one pixel and the third raster is deviated one pixel in the opposite direction. As can be seen from FIGS. 26B to 26D, the patterns give a significantly granular impression when compared with that of FIG. 26A in which the dot formation positions are not deviated.

The pattern digitized by the conditional decision making method used in this invention is characterized in that even when there are many conditions (rasters) to be adjusted, a pattern with slight deviations and a pattern with no deviations at all can be clearly distinguished. This pattern, although it is a single pattern that contains a plurality of adjustment conditions, can exhibit its intended smoothness only when all the conditions are met. Hence, the pattern area to be printed is the same whether the number of conditions is two as in the above embodiment or four as in this embodiment.

This embodiment is provided with a mechanism that enables the registration of nozzle columns to be initiated by the user as required and to be adjusted with high precision by using the high resolution print head formed with four nozzle columns for each color as shown in FIG. 25. This mechanism makes it possible to maintain high image quality at all times after the printing apparatus has been received.

12. Registration Dealing With Variation Factors

As described above, the O/E registration depends on individuality of the print head and on the state of the print head including the environment and the print history. On the other hand, the bi-directional registration often depends on the characteristics of the printer body side, such as carriage encoder E0004 of the printer body and the distance between the carriage M4001 and the platen as a member for restricting a printing surface of the print medium. In the above first embodiment, therefore, the adjustment value for O/E registration is stored before shipment in a nonvolatile memory such as EEPROM installed at an appropriate location in the print head H1001 and the adjustment value for bi-directional registration is stored before shipment in a nonvolatile memory such as EEPROM installed at an appropriate location in the printer body.

The printer of the above construction can select one of two carriage speeds according to the mode in order to output a picture image with high quality. Further, to be able to print on thick sheets and envelopes, the printer has a mechanism for adjusting the carriage-to-platen gap in two positions. Hence, an appropriate adjustment value either in the O/E registration or in the bi-directional registration changes depending on the conditions, such as carriage speed, gap, and ink ejection speed and ejection angle from the print head H1001. So, the printer is provided with a mechanism that allows registration to be performed automatically according to these conditions.

In the bi-directional printing, in particular, the higher the resolution of the image, the more stringent the required dot landing position accuracy becomes. A dot landing position deviation of even several μm will result in a perceivable degradation of image quality. Hence, it is strongly desired to perform the bi-directional registration described above. It is also desirable to automatically correct the adjusted value for bi-directional registration according to the printing conditions.

The appropriate value of the bi-directional registration is influenced by the individualities or characteristic variations of the printer body, such as carriage speed and the platen-to-carriage gap, and also by the individualities or characteristic variations of the print head, such as ink ejection speed and ejection angle that change according to the mode of the printer.

The above embodiment employs a method that automatically changes the adjustment value for bi-directional registration when the user intentionally switches the printing state, as by changing the gap amount to allow the use of a thick sheet such as an envelope or by increasing the carriage speed in a mode that gives priority to the print speed.

As the printing resolution is increased further and the required dot landing position precision becomes correspondingly severe, the characteristic variations or tolerances of the printer body side such as carriage speed and gap or the characteristic variations or individualities of the print head such as ink ejection speed and ejection angle cannot be ignored. Further, the ink ejection speed and ejection angle also change over time and according to the state of the printing operation and thus it is strongly desired that the correction be made according to these changes.

In the following, we will explain about an embodiment that can determine an adjustment value for bi-directional registration precisely and in real time according to variation factors that can adversely affect the image quality, such as characteristic variations of printer body and print head as well as characteristic changes depending on the printing operation state or occurring with the passage of time.

12.1 Setting of Adjustment Value for Bi-directional Registration Considering Characteristic Variations The print head used in this embodiment to perform the bi-directional registration processing that takes the characteristic variations into account has the similar construction to that shown in FIG. 11 and can realize printing with a resolution of 1200 DPI in the nozzle arrangement direction (subscan direction) for each color. In this embodiment, however, the printing in the main scan direction has a resolution of 2400 DPI, two times the subscan direction resolution. The actual resolution of input data is 600 DPI at maximum and each data is printed by using 8 pixels (=4 pixels in main scan direction×2 pixels in sub-scan direction). Each input data has one of 9 grayscale levels and the dot arrangement in each 4×2 pixel area is determined in advance so that one of the nine grayscale levels can be represented by the 4×2 pixel area during printing.

A main feature of this embodiment is an adjusting mechanism for bi-directional registration for the high-resolution printing. The bi-directional registration is affected not only by the factors dependent on the printer body characteristics, such as carriage speed and carriage-to-platen gap, but by the factors dependent on the print head characteristics, such as ink ejection speed and ejection angle. In this embodiment, because the resolution in the main scan direction is 2400 DPI, the bi-directional registration processing can be made at the 2400 DPI resolution for each pixel.

Figure 30:
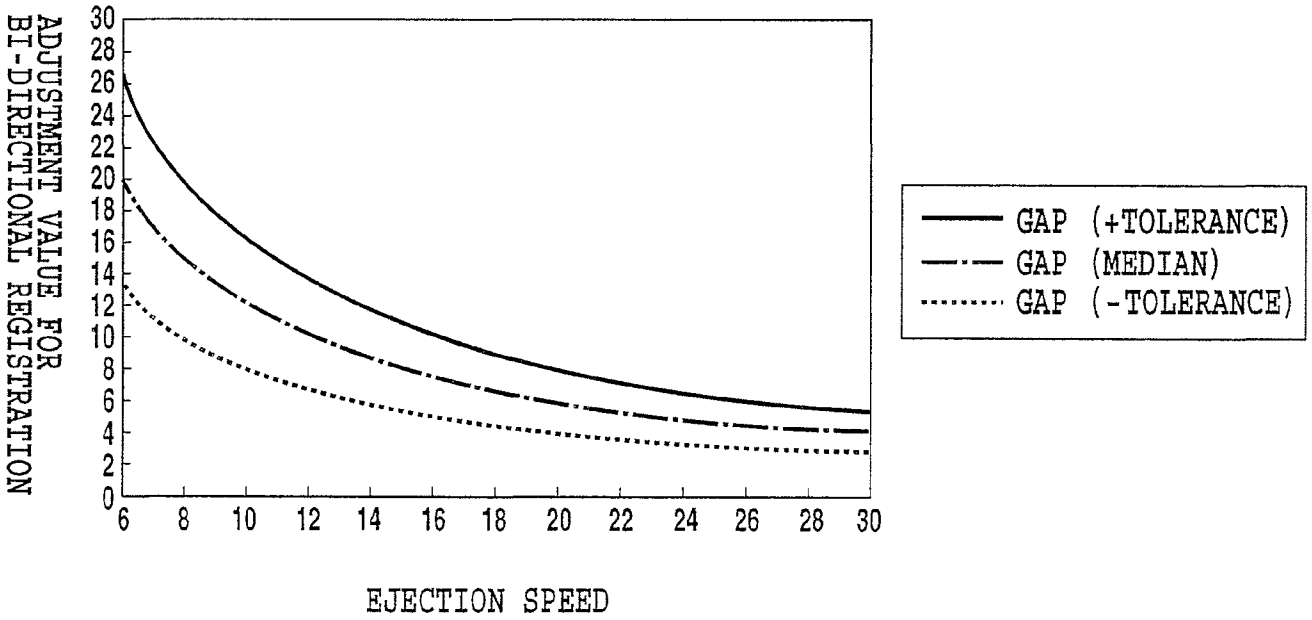
FIG. 30 is a graph showing one example relation between an ink ejection speed of the print head and an adjustment value for registration for each of maximum, median and minimum tolerances of platen-to-carriage distance or gap in the printer body of one embodiment of the invention.

FIG. 30 shows one example relation between the ejection speed and the adjustment value for registration for each of maximum, median and minimum values of carriage-to-platen gap in the printer body. The abscissa (ejection speed) represents a velocity component of an ink droplet ejected from a nozzle in the direction perpendicular to the paper surface, in msec. The ordinate represents an adjustment value for registration.

In the bi-directional printing, if ink is ejected when the carriage M4001 is at the same forward and backward positions, the inertia of the carriage scan speed causes the dot landing position on the paper during the forward (or backward) scan to deviate by several pixels from the dot landing position during the backward (or forward) scan. To cope with this problem, during the bi-directional printing in general, the ink ejection timings for the forward and backward scans are adjusted so that their dot landing positions on the paper will match. The adjustment value is shown on the ordinate in FIG. 30. The unit of adjustment is one pixel at the 2400 DPI resolution. The adjustment value for registration is influenced not only by the ink ejection speed but also by a distance from the nozzle to the print medium surface.

If the carriage-to-platen gap tolerance of the printer body used in this embodiment is 1.4±0.2 mm and the normal print medium thickness is about 100 μm, then the distance from the nozzle to the print medium surface is 1.3±0.2 mm. The curves shown in the figure represent the relations between the adjustment value and the ejection speed for the three different carriage-to-platen gaps: minimum gap (1.2 mm), median gap (1.4 mm) and maximum gap (1.6 mm).

As can be seen from this diagram, even when a uniform ink ejection speed, 13 m/s for example, can be obtained, the adjustment value for registration deviates by ±2 pixels if the gap is within the tolerance range. Experiments conducted by the inventors have found that in the printer of this embodiment the deviation of about 20 μm (2 pixels) resulted in a perceivable degradation of the image quality. That is, if the gap is within the tolerance range, it is strongly recommended in practice that the registration processing be executed to form a high quality image.

In this embodiment the ink ejection speed from the print head is set at 13±3 m/s. In this case, too, even if a uniform gap of 1.4 mm, for example, is obtained, the adjustment value for registration will deviate by as much as ±2 to 3 pixels when the ejection speed is within the tolerance range. Considering this, it is strongly desired in practice that the registration processing be carried out to form a high quality image.

From the above description it is seen that the adjustment value for bi-directional registration can deviate greatly even at the initial stage depending on a combination of the printer body and the print head. For example, let us consider a case where a printer with the minimum gap tolerance is combined with a print head with the maximum ejection speed tolerance and a case where a printer with the maximum gap tolerance is combined with a print head with the minimum ejection speed tolerance. A difference in the adjustment value between these two combinations can be as large as 10 pixels.

In a configuration in which the print head is of a replaceable cartridge type and the user can make any desired combination between the print head and the printer body, as in the printer of this embodiment, one possible method is to have the user perform the user registration processing after the cartridge is mounted. The user registration processing, however, places a burden on the user and there is no assurance that the user, unfamiliar with the printer operation immediately after the printer has been delivered, can perform adjustments correctly.

It is therefore desirable that the registration be already completed by the time the printer body or print head delivered is first used.

For this reason, in this embodiment, factors affecting the bi-directional registration are classed into a group associated with printer body and a group associated with the print head, and the group of factors associated with the printer body, such as gap, is stored in a storage means on the printer body and the group of factors associated with the print head, such as ejection speed, is stored in a storage means on the print head. These groups of factors become valid only when both of them are stored. This is explained in the following. Let us consider a case where the ejection speed is stored only in the storage means on the print head with nothing stored in the storage means on the printer body. In that case, if the median value of the ejection speed of 13 m/s is obtained, for example, the gap tolerance alone can produce a deviation of 6 pixels (FIG. 30). Conversely, if the gap is stored only in the storage means on the printer body, the ejection speed tolerance can produce a deviation of similar magnitude.

In this embodiment, the printer body and the print head each have a nonvolatile memory such as EEPROM as their storage means, in which the information on gap and ejection speed is stored in advance so that the registration processing can be done as soon as the print head is mounted on the printer body after the print head or printer body has been delivered. For this embodiment, the construction similar to the one shown in FIG. 16B for example may be used.

That is, when the tolerance of the ejection speed of the print head is 13±3 m/s, the tolerance is divided at intervals of 1 m/s into seven sections coded "01" to "07" for example, one of which is then stored in the EEPROMs 200 of the print head as the unique characteristic value of the print head. When the gap tolerance is 1.4±0.2 mm, this tolerance is divided into three sections coded "01" to "03" for example, one of which is then stored in the EEPROM 100 of the printer body as the unique characteristic value of the printer body.

Figure 31:
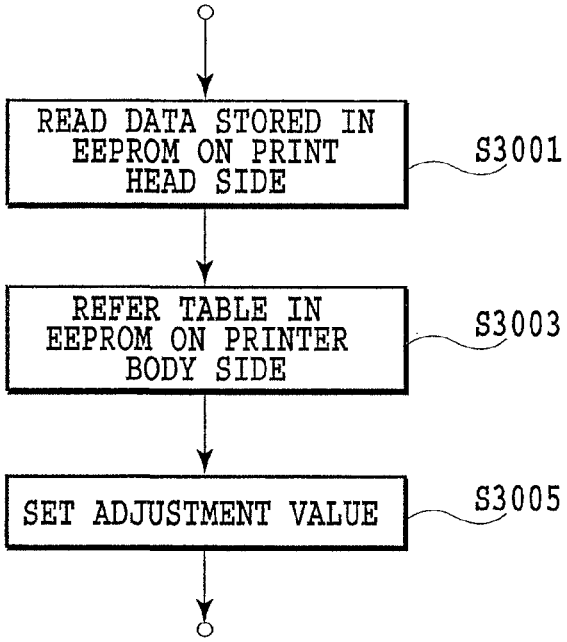
FIG. 31 is a flow chart showing an example procedure for determining an adjustment value for registration based on information from the printer body and the print head.

FIG. 31 shows an example procedure for determining the adjustment value for registration based on the information on the printer body side and on the print head side. This procedure can be taken as part of the step S3 in the processing shown in FIG. 10 and can be initiated when the print head mounted on the carriage M4001 is a newly installed one. For example, when the user puts the print head onto the carriage M4001 and turns the power on, the CPU of the printer body (printer control unit PRC) reads the data stored in the EEPROM 200 on the print head side (step S3001) and refers the table developed on the EEPROM 100 on the printer body side (step S3003) to obtain an appropriate adjustment value for registration (step S3005).

FIG. 32 is an adjustment value for registration table stored in the EEPROM 100 on the printer body side, which is referred based on the ejection speed and the gap obtained above to determine the adjustment value for registration.

When, for example, a print head with an ejection speed of 11 m/s and a printer body with a gap of 1.4 mm are combined, the EEPROM of the print head is stored with a code "02" and the EEPROM of the printer body with a code "02". When the power is turned on, the adjustment value table for registration (FIG. 32) is referred and an adjustment value of "11 pixels" is determined based on the combination of these codes. In this way, even in the initial use of the printer after delivery, it is possible to obtain an image that has undergone proper registration processing without causing any particular trouble to the user.

As described above, with this embodiment, by simply storing the ink drop ejection speed in the EEPROM of the print head and the carriage-to-platen gap value in the EEPROM of the printer body, a high quality image adjusted by the bi-directional registration can be obtained without troubling the user immediately after the printer is delivered to the user.

12.2 Setting of Adjustment Value for Bi-directional Registration Considering Print Head Temperature Variations Next, another embodiment will be explained which automatically performs bi-directional registration processing in response to a temperature rise during printing.

As explained in FIG. 30, the adjustment value for registration varies depending on the ejection speed. It is also known that the ejection speed in practice depends not only on the characteristic variations of the individual print heads but also on the temperature rise of the print head caused when the print operations are carried out consecutively.

Figure 33:
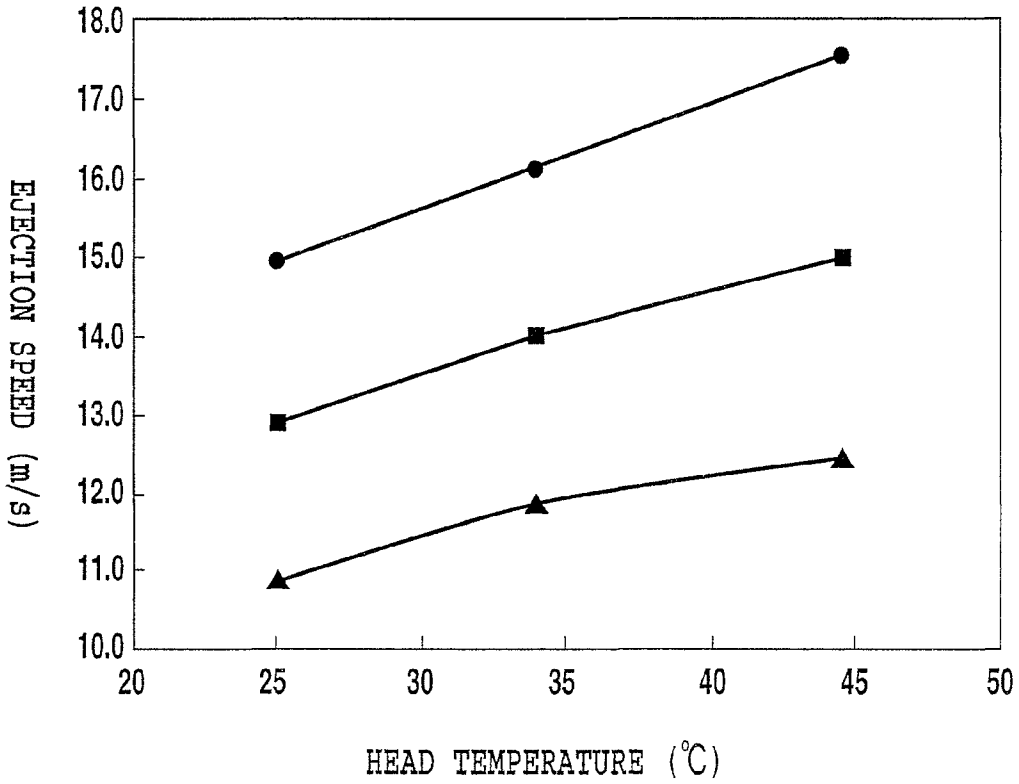
FIG. 33 is a diagram explaining how the ink ejection speed changes with the temperature of the print head.

FIG. 33 shows the relation between the print head temperature (° C.) on abscissa and the ejection speed (m/s) on ordinate. Experiments conducted by the inventors on a plurality of print heads have shown that printing several pages of print medium consecutively results in a gradual temperature rise of the print head. For example, when A4-size print medium is used, printing four or five pages of images with a relatively high duty (an image formed with a large number of ink ejections) raises the print head temperature to about 45° C. In that case, as shown in FIG. 33, the ejection speed of each print head changes according to the temperature. For example, for the print head with an ejection speed of 13 m/s at normal temperature (25° C.), the ejection speed will change to 15 m/s when the temperature rises to 45° C. Applying this fact to FIG. 30 shows that the adjustment value for registration will change by one or two pixels. Thus, even if the provision of memories to the print head and the printer body respectively can guarantee a properly adjusted image in the initial use after the printer has been delivered as in the above embodiment, printing 4-5 pages continuously can result in a perceivable deterioration of image quality.

Also to guarantee a proper registration even when there is a temperature rise, this embodiment adopts a configuration in which the printer body has a table by which to refer a registration adjustment value table according to the print head temperature.

FIG. 34 shows one such table that can be stored in the memory of the printer body (EEPROM 100). This table is a coded table showing how the ejection speed at normal temperature (initial ejection speed) written in the EEPROM 200 on the print head side changes according to the environmental temperature such as ambient temperature and as a result of continuous printing.

Consider a case, for example, where the user mounts a print head having an initial ejection speed of 12 m/s on a printer body whose carriage-to-platen gap is 1.4 mm. Before a printing for the first page is started, the CPU (printer control unit PRC) on the printer body checks the temperature of the print head. If the print head temperature falls in a range of 20-30° C., the ejection speed of "03" (12 m/s) is obtained from the table of FIG. 34. Based on this ejection speed, a reference is made to the corresponding column in the table of FIG. 32 and also to the row with a gap "02" (median value) to obtain the adjustment value of "10" for registration. Then, according to this adjustment value, one page of printing is completed. Before starting to print the next page, the print head temperature is detected again. If the head temperature is between 20° C. and 30° C. again, the adjustment value for registration is left at "10" and one page of printing is completed.

Suppose, after repeating this printing for several pages, a head temperature of 30-40° C. is detected. In that case, an ejection speed "04" (13 m/s) is determined from the table of FIG. 34. Then, referring to the table of FIG. 32, an adjustment value of "9" for registration is obtained. The next page of image is completed using this adjustment value.

As described above, before starting to print each page, the print head temperature is checked and the adjustment value for registration is automatically adjusted for each page to minimize degradation of image quality due to temperature change while printing.

Although the above-mentioned automatic adjustment for registration that is carried out upon delivery of a printer has been described to be corrected for each page, this correction may be made otherwise.

The registration processing initiated by the user's judgment (user registration), which was described referring to FIG. 17, may include a correction according to temperature changes. The user registration in this embodiment will be described in the following.

The user registration in this embodiment has the similar configuration to FIG. 16B and can be performed in the same manner as explained in FIG. 16A.

The user selects a registration mode in the utility of the printer driver PD on the host device HOST by using the input/display means CNSL (step S2201). The user then sets paper on the printer body and starts the print (step S2202). In response to this step, the printer control unit PRC sends predetermined data to the drive unit HD of the print head H1001 which forms a pattern for registration (FIG. 17) (step S2203). The user, after visually checking the printed pattern, enters an adjustment value into a predetermined area on the printer setting screen of the host device HOST (step S2004). The host device HOST, triggered by a command from the printer driver PD, transfers the registration data to the printer control unit PRC (step S2205). The transferred registration data is stored in the EEPROM 100 in the printer body (step S2206).

Figure 35:
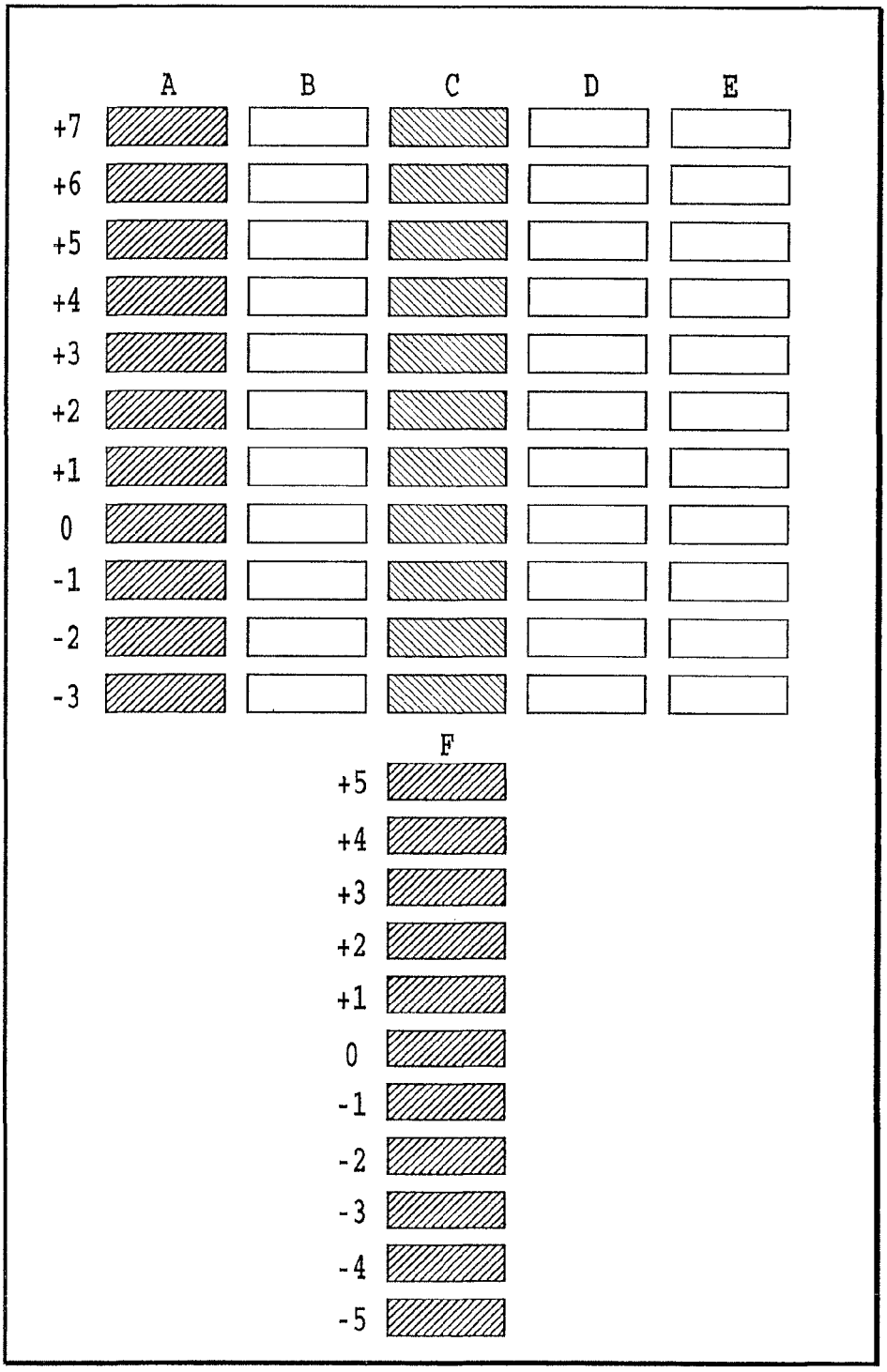
FIG. 35 is an example pattern output during the user registration processing considering characteristic variations of the printer body and the print head that affect bi-directional registration.

FIG. 35 shows a pattern that is output during the user registration process in this embodiment. Columns A to E in the figure represent O/E registration pattern of each color for the print head H1001. How the patterns are formed and the kinds of patterns are similar to those explained in FIG. 17.

A column F of FIG. 35 includes adjustment patterns for a bi-directional registration. The patterns of column F of this embodiment are also formed in the same manner as shown in FIG. 17 and their adjustment range is between "+5" to "−5" as indicated by the adjustment values attached to the left of the pattern. The bi-directional registration pattern corresponding to the "0" (default) value is printed with a value that is obtained by the embodiment explained in FIG. 32.

The patterns corresponding to "+5" to "−5" are printed by fixing the ejection timing during the forward scan and changing the ejection timing during the backward scan in increments of one pixel, as in the case of FIG. 17. All the patterns for bi-directional registration are printed by the 4-pass bi-directional printing. The reason that the 4-pass divided printing is used is to prevent a possible loss of pattern smoothness due to nozzle characteristic variations and others.

The bi-directional registration patterns and the printing method are also similar to those explained in FIGS. 19A and 19B. That is, because the O/E registration is also performed during a series of adjustments in this embodiment, the data is given only to the even-numbered rasters so that the printed patterns are not affected by the dot position deviations between the even- and odd-numbered columns. The even-numbered rasters are printed every other dot, which is a limit pixel pitch (distance) at which the adjoining dots do not overlap, so that even a slight dot positional deviation will show up sensitively in the printed image.

In this embodiment, too, each raster of an image is completed by four printing scans, with the first and third pass printed in the forward scan and the second and fourth pass printed in the backward scan. As shown in FIG. 19A, a 16-pixel-high forward print area and a 16-pixel-high backward print area are alternated, with each area printed in two divided passes, first and third passes, or second and fourth passes.

When a bi-directional dot position deviation occurs, a black or white line appears at a boundary between the forward print area and the backward print area as shown in FIG. 19B. The width of each print area is about 336 μm and these vertical white lines are actually perceived visually as gray scale variations appearing at regular intervals in the lateral directions. The user can choose a uniform pattern with the fewest white lines.

The user registration described above can be performed whenever the user thinks it necessary. It may however not be possible to cope with constantly occurring changes, such as dot landing position variations caused by the rising temperature as a result of continuous printing. Even under such a circumstance, a satisfactory image is obtained by using the table of FIG. 34 described earlier and changing the adjustment value for registration for each page.

With this embodiment described above, the ink ejection speed that changes according to the print head temperature is estimated and, based on this estimated value, an appropriate correction is made at any time to the normal-temperature adjustment value for registration currently being used to print.

12.3 Bi-Directional Registration Considering Changes in Drive Frequency

It is assumed that the printer applying this embodiment has three carriage speeds that can be selected according to use and situation: a HQ1 carriage speed mode for normal high image quality, a HQ2 carriage speed mode slightly slower than HQ1 and selected according to a rise in the print head temperature, and an HS carriage speed mode for fast scan. Normally, the printing is done at the HQ1 carriage speed. When the print head temperature rises to a level that will pose a problem to the image, as during continuous printing, the HQ2 carriage speed is used. When the print head temperature rises above the normal temperature, the ink drop ejection state becomes unstable, so that the drive frequency is lowered to an appropriate level to stabilize the image quality. The print head used in this embodiment performs the ejection operation at the drive frequency of 25 KHz during the normal printing (HQ1 carriage speed), at the carriage speed of 20.8 inches/sec. The print head temperature is checked for each page and when it is higher than 45° C., the drive frequency is set to 20 KHz from the next page. At this time, the carriage speed is set to 16.7 inches/s.

The HS mode is specified by the user when he or she wants a quick printout. The carriage speed in this mode is 29.2 inches/s.

To deal with such print media as thick sheets and envelopes, the printer of this embodiment has a mechanism that can adjust the carriage-to-platen gap in two positions: a standard position for normal printing and a thick sheet position for printing thick sheets. The gap is adjusted by the user operating the gap adjust lever M2015. There is the gap sensor E0008 to check whether the present gap is in the thick sheet position or the standard position, and thus the printer body can perform the print control that matches the present gap.

Figure 36:
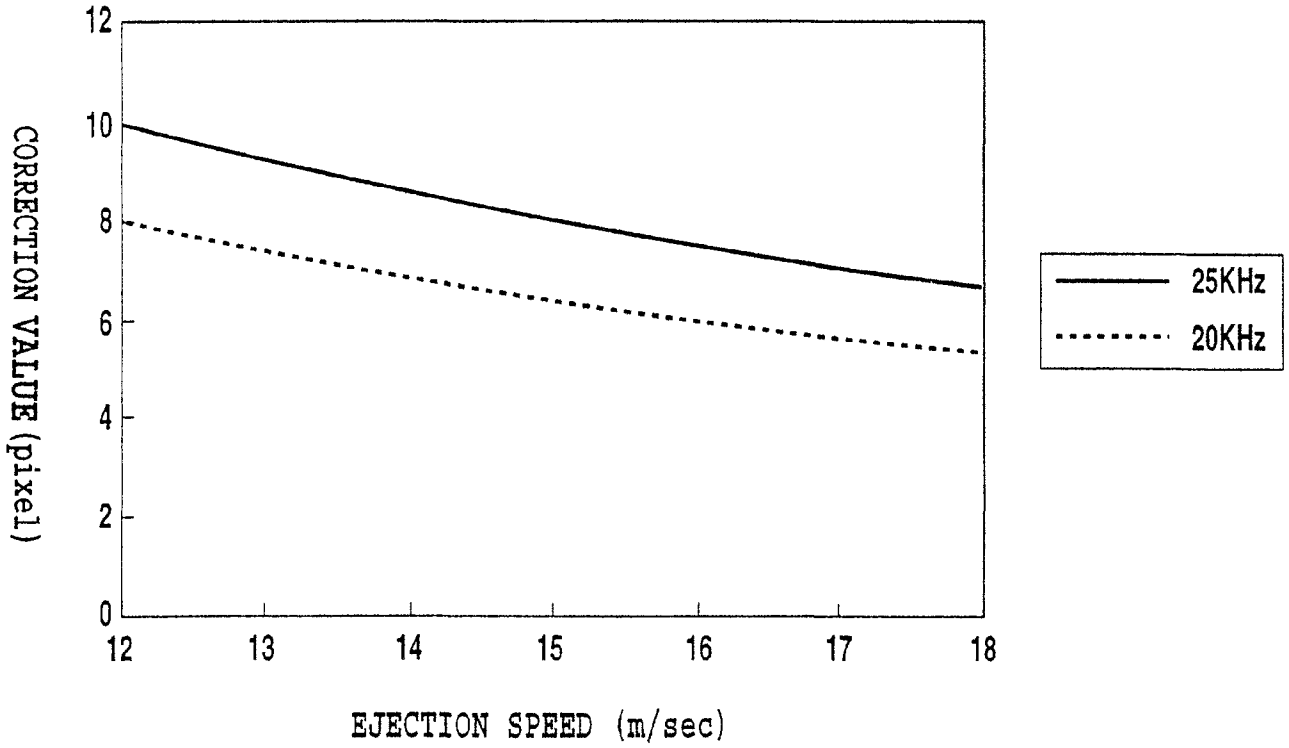
FIG. 36 is a diagram explaining changes in the bi-directional registration value with respect to the ink ejection speed for different drive frequencies.

FIG. 36 shows adjustment value curves for bi-directional registration with respect to the ejection speed for different settings. This is tabulated in FIG. 37. Like the above embodiment, this embodiment, too, estimates an ejection speed, from moment to moment, from the initial ejection speed and the present print head temperature. Further, from the table of FIG. 37 an adjustment value for registration corresponding to the head drive frequency is selected.

In the case of a print head with an initial ejection speed of 13 m/s, for example, the EEPROM 200 of the print head H1001 is stored with a code "04". When the initial print head temperature is about 25° C., the ejection speed of 13 m/s is obtained from the table of FIG. 34. Because at the print head temperature of 25° C. the drive frequency is 25 KHz, FIG. 37 indicates the adjustment value of "9" for registration. Using this value, the first page is printed.

The print head temperature gradually rises as the printing continues. Suppose the print head temperature is 35° C. before starting the third page printing. At this time, from the table of FIG. 34 the ejection speed of "05" (14 m/s) is obtained. Since the drive frequency in this embodiment is switched from 25 KHz to 20 KHz when the print head temperature is 45° C. or higher, the drive frequency is 25 KHz at 35° C. Here, referring to the table of FIG. 37, the adjustment value of "9" for registration is obtained. The third page is printed using this value.

Suppose the print head temperature of 47° C. is detected when a fifth page is to be printed. In the same way as described above, the table of FIG. 34 is referred to determine the ejection speed of "06" (15 m/s). Because at 45° C. or higher the drive frequency is 20 KHz, a row of 20 KHz in the table of FIG. 37 is checked and an adjustment value of "6" for registration is obtained.

In this embodiment, at the head of each page the print head temperature is checked and the ejection speed at that time is determined from the matrix of the initial ejection speed and the print head temperature. Further, from the detected print head temperature, a drive frequency for that page is determined and then a final adjustment value for registration is obtained from the determined drive frequency and the calculated ejection speed.

This makes it possible to produce the similar effect to that of the above-described embodiment, i.e., to be able to cope in real time with the registration deviations caused by temperature changes which are difficult to adjust with the initial setting or the user registration. In addition, the above-described method also makes it possible to form a stable image without burdening the print head even when the temperature rises as a result of continuous printing.

In this embodiment, although for the sake of simplicity no explanation has been given as to the adjustment using the table of gap tolerance that was considered in the preceding embodiment, this adjustment can of course be performed. The effect similar to that described above can be obtained if the gap is classed into three categories, large, medium and small gaps, for each drive frequency.

As explained in this section where three embodiments have been described, a memory means for storing dot position information associated with the characteristic variation or individuality of the printer body is installed in the printer body and a memory means for storing dot position information associated with the characteristic variation or individuality of the print head is installed in the print head; and when the print head is mounted on the printer body to print an image, the contents of both memory means are referred to to determine the information for use in the dot position adjustment. This makes it possible to properly correct characteristic variations due to tolerances of carriage-to-platen gap and ejection speed.

Further, during the bi-directional registration, the ink ejection speed is estimated according to the detected print head temperature and, based on the estimated ejection speed, the information used for adjusting print position on the print medium is determined. This processing enables an appropriate adjustment value to be determined in real time in response to a change resulting from the state of the printing operation.

13. Further Descriptions

One form of the head to which the present invention can be effectively applied is the one that utilizes thermal energy produced by an electrothermal transducer to cause film boiling in liquid thereby generating bubbles.

In the embodiment described above, the printer driver PD on the host computer HOST side supplies image data to the printing apparatus. The data of registration pattern as shown in FIG. 17 may be stored in the printing apparatus or supplied from the host device.

The scope of the present invention also includes a print system in which program codes of software or printer driver that realize the function of the above embodiment are supplied to the computer in a machine or system to which various devices including the printing apparatus are connected, and in which the program code stored in the computer in the machine or system are executed to operate a variety of devices, thereby realizing the function of the above-described embodiment.

In this case, the program codes themselves realize a novel function of the present invention and therefore the program codes themselves and means to supply the program code to the computer, such as storage media, are also included in the scope of this invention.

The storage media to supply the program codes include, for example, floppy disks, hard disks, optical disks, CD-ROMs, CD-Rs, magnetic tapes, nonvolatile memory cards and ROMs.

The scope of this invention includes not only a case where the function of the above-described embodiment is realized by executing the program codes read by the computer but also a case where an operating system running on the computer performs, according to directions of the program codes, a part or all of the actual processing and thereby realizes the function of this embodiment.

Further, the scope of this invention includes a case where the program codes read from a storage medium are written into a memory in a function expansion board inserted in the computer or into a memory in a function expansion unit connected to the computer, after which, based on directions of the program codes, a CPU in the function expansion board or function expansion unit executes a part or all of the actual processing and thereby realizes the function of this embodiment.

As described above, according to the present invention, a mechanism is provided that enables the inter-raster registration to be initiated by the user as required and to be adjusted highly precisely by using the high resolution print head formed with a plurality of nozzle columns arranged side by side in the main scan direction or by performing a bi-directional interlaced printing method. This mechanism makes it possible to maintain high image quality at all times after the printing apparatus has been received.

Further, it is also possible to set the dot position adjustment value properly and in real time according to characteristic variations, within tolerance, of the print head and the printer body as well as according to the state of the printing operation.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications as fall within the true spirit of the invention.

What is claimed is:

1. A printing apparatus comprising:

a print head including a first array of a plurality of first ejection openings for ejecting a liquid of a predetermined color and being arrayed in a predetermined direction and a second array of a plurality of second ejection openings for ejecting the liquid of the predetermined color and being arrayed in the predetermined direction, the first and second ejection openings corresponding respectively to a plurality of first elements and a plurality of second elements for generating energy used to eject the liquid of the predetermined color, the first array and the second array being arranged in a direction crossing the predetermined direction, wherein relative movement between the print head and a print medium is effected in at least one scan direction crossing the predetermined direction;

a pattern printing unit configured to cause the print head to print a pattern on a print medium by driving the first and second print elements at a predetermined relative drive timing between the first elements and the second elements during the relative movement between the print head and the print medium in a predetermined one scan direction;

an obtaining unit configured to obtain information on relative deviation between a print position by the first elements and a print position by the second elements in the relative movement in the predetermined one scan direction, the information being based on the printed pattern;

a setting unit configured to set a relative drive timing between the first elements and the second elements for the relative movement in the predetermined one scan direction based on the information obtained by the obtaining unit; and a driving control unit configured to drive the first elements and second elements according to the relative drive timing set by the setting unit in the relative movement in the predetermined one scan direction for printing on the print medium.

2. The printing apparatus according to claim 1, wherein the first print elements and the second print elements print different rasters on the print medium during the relative movements.

3. The printing apparatus according to claim 1, wherein the liquid of the predetermined color is ink of the predetermined color.

4. The printing apparatus according to claim 1, wherein each of the second ejection openings is provided at a position between two of the first ejection openings that are adjacent in the predetermined direction.

5. The printing apparatus according to claim 1, wherein the pattern printing unit controls the print head to print a first pattern portion with a first relative drive timing between the first elements and the second elements and controls the print head to print a second pattern portion with a second relative drive timing between the first elements and the second elements to form the pattern.

6. The printing apparatus according to claim 1, wherein the first elements and the second elements are formed on a same substrate.

7. The printing apparatus according to claim 1, wherein the first ejection openings and the second ejection openings are formed on a same nozzle member.

8. The printing apparatus according to claim 1, wherein the first elements and the second elements of the print head are driven by block distributed driving.

9. The printing apparatus according to claim 1, wherein the print head scans over the print medium.

10. The printing apparatus according to claim 1, wherein the relative movement between the print head and the print medium is effected in a forward direction and a reverse direction which is opposite to the forward direction, and the pattern printing unit causes the print head to print the pattern by the relative movement in either the forward direction or the reverse direction, the information on relative deviation between a print position by the first elements and a print position by the second elements is an adjustment value for correcting the relative deviation between a print position by the first elements and a print position by the second elements in the relative movement in the predetermined one scan direction.

11. The printing apparatus according to claim 1, wherein the pattern printing unit causes the print head to print a plurality of patterns, each including one pattern printed by driving an element of the first elements and another pattern printed by driving an element of the second elements such that the relative drive timings between the first element and the second element for each of the plurality of patterns are different from each other.

12. The printing apparatus according to claim 1, wherein the obtaining unit comprises an accepting unit configured to accept an input by a user relating to the pattern, wherein the setting unit sets the predetermined relative drive timing according to the input which is accepted by the accepting unit.

13. The printing apparatus according to claim 12, wherein the pattern printing unit controls the print head to print a first pattern with a first relative drive timing between the first elements and the second elements and controls the print head to print a second pattern with a second relative drive timing between the first elements and the second elements, and the setting unit sets the relative drive timing according to whether the input from the user accepted by the accepting unit is an input corresponding to the first pattern or an input corresponding to the second pattern.

14. A printing method using a print head including a first array of a plurality of first ejection openings for ejecting a liquid of a predetermined color and being arrayed in a predetermined direction and a second array of a plurality of second ejection openings for ejecting the liquid of the predetermined color and being arrayed in the predetermined direction, the first and second ejection openings corresponding respectively to a plurality of first elements and a plurality of second elements for generating energy used to eject the liquid of the predetermined color, the first array and the second array being arranged in a direction crossing the predetermined direction, wherein relative movement between the print head and a print medium is effected in at least one scan direction crossing the predetermined direction, the method comprising:

printing a pattern on a print medium by driving the first and second print elements at a predetermined relative drive timing between the first elements and the second elements during the relative movement between the print head and the print medium in a predetermined one scan direction;

obtaining information on a relative deviation between a print position by the first elements and a position by the second elements in the relative movement in the predetermined one scan direction, the information being based on the printed pattern;

setting a relative drive timing between the first elements and the second elements for the relative movement in the predetermined one scan direction based on the information obtained in the obtaining step; and driving the first elements and second elements according to the relative drive timing in the relative movement in the predetermined one scan direction for printing on the print medium.

15. The printing method according to claim 14, wherein the first print elements and the second print elements print different rasters on the print medium during the relative movements.

16. The printing method according to claim 14, wherein the liquid of the predetermined color is ink of the predetermined color.

17. The printing method according to claim 14, wherein each of the second ejection openings is provided at a position between two of the first ejection openings that are adjacent in the predetermined direction.

18. The printing method according to claim 14, wherein the print head is controlled to print a first pattern portion with a first relative drive timing between the first elements and the second elements and a second pattern portion with a second relative drive timing between the first elements and the second elements to form the pattern.

19. The printing method according to claim 14, wherein the first elements and the second elements of the print head are driven by block distributed driving.

20. The printing method according to claim 14, wherein the relative movement between the print head and the print medium is effected in a forward direction and a reverse direction which is opposite to the forward direction and in the printing the print head prints the pattern by the relative movement in either the forward direction or the reverse direction.

21. The printing method according to claim 14, further comprising:

a process that a pattern printing unit causes the print head to print a plurality of patterns, each including one pattern printed by driving an element of the first elements and another pattern printed by driving an element of the second elements such that the relative drive timings between the first element and the second element for each of the plurality of patterns are different from each other.

22. A printing method according to claim 14, wherein the obtaining step comprises a step of accepting an input by a user relating to the pattern, wherein the predetermined relative drive timing is set according to the accepted input.

23. The printing method according to claim 22, wherein the print head is controlled to print a first pattern with a first relative drive timing between the first elements and the second elements and to print a second pattern with a second relative drive timing between the first elements and the second elements, and the setting step sets the relative drive timing according to whether the accepted input from the user is an input corresponding to the first pattern or an input corresponding to the second pattern.

* * * * *